US006712458B2

(12) United States Patent
Hatasa et al.

(10) Patent No.: US 6,712,458 B2
(45) Date of Patent: Mar. 30, 2004

(54) LIQUID CONTAINER, ELASTIC MEMBER FOR LIQUID CONTAINER, AND RECORDING APPARATUS

(75) Inventors: Nobuyuki Hatasa, Kawasaki (JP); Hajime Yamamoto, Yokohama (JP); Eiichiro Shimizu, Yokohama (JP); Takeshi Kohno, Yokohama (JP); Hiroshi Koshikawa, Kawasaki (JP); Tatsuo Nanjo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 10/067,203

(22) Filed: Feb. 7, 2002

(65) Prior Publication Data

US 2002/0122104 A1 Sep. 5, 2002

(30) Foreign Application Priority Data

Feb. 9, 2001 (JP) ..... 2001-033560
Dec. 18, 2001 (JP) ..... 2001-384679

(51) Int. Cl.[7] ..... B41J 2/175
(52) U.S. Cl. ..... 347/86
(58) Field of Search ..... 347/85, 86, 87; 604/87, 533

(56) References Cited

U.S. PATENT DOCUMENTS 4,516,967 A * 5/1985 Kopfer ..... 604/87
5,126,767 A * 6/1992 Asai ..... 347/85
5,721,576 A * 2/1998 Barinaga ..... 347/85
6,079,823 A * 6/2000 Droege ..... 347/85
6,162,206 A * 12/2000 Bindokas et al. ..... 604/533
6,540,342 B2 4/2003 Koshikawa et al. ..... 347/86
2002/0109761 A1 8/2002 Shimizu et al. ..... 347/86
2002/0122103 A1 9/2002 Yamamoto et al. ..... 347/85
2003/0085968 A1 5/2003 Shimizu et al. ..... 347/86

FOREIGN PATENT DOCUMENTS

| | | |
|---|---|---|
| EP | 791463 | 8/1997 |
| EP | 853001 | 7/1998 |
| EP | 1013444 | 6/2000 |
| JP | 5-162333 | 6/1993 |

* cited by examiner

*Primary Examiner*—Anh T. N. Vo
(74) *Attorney, Agent, or Firm*—Fitzpatrick, Cella, Harper & Scinto

(57) ABSTRACT

A liquid container for an ink jet recording apparatus includes a connection opening connectable with an outside; an elastic member provided in the connection opening, the elastic member being adapted to be penetrated by a cylindrical member for fluid communication with the outside; the elastic member including a compressed region and a substantially non-compressed region in a state without the cylindrical member penetrated, disposed in this order in a direction of insertion of the cylindrical member, wherein the compressed region and the non-compressed region are capable of being compressed when they are penetrated by the cylindrical member.

16 Claims, 40 Drawing Sheets

(a)

(b)

(c)

LIQUID CONTAINER, ELASTIC MEMBER FOR LIQUID CONTAINER, AND RECORDING APPARATUS

FIELD OF THE INVENTION AND RELATED ART

The present invention relates to a replaceable liquid container, an elastic member for plugging the connective hole which connects the inside and outside of the container, and an ink jet recording apparatus equipped with a replaceable liquid container.

As a replaceable liquid container in accordance with the prior arts, the ink container for an ink jet recording apparatus, which is disclosed in Japanese Laid-open patent Application 5-162333, has been known. The drawings disclosed in this patent application are present in this specification, as FIGS. 44, 45, and 46, to depict an example of a conventional replaceable liquid container, or the replaceable liquid container in accordance with the prior arts.

As shown in FIGS. 44–46, in the case of the first example of the conventional liquid container, an ink drawing member 72 is held in the space formed by the recess 81*a* of the top portion 62A of the liquid container shell, and the recess 83 of the retaining portion of the bottom portion of the liquid container shell, the ink drawing member 72 is placed in the recess 81*a*, and the top and bottom portions L2A and 62B are joined in a manner to compress the ink drawing member 72. The members in other examples of a conventional liquid container, and in the embodiments of the present invention, which are equivalent to the ink drawing member 72 in this first example of a conventional liquid container, will be referred to as "elastic member" to better describe them regarding their characteristics; a name "ink drawing member" is used in the description of the first example of a conventional liquid container, after the name used in the specification of the aforementioned patent application.

FIG. 44 is a perspective view of the ink drawing member 72 used for the first example of a conventional liquid container. This ink drawing member 72 has an ink drawing portion 72*f* through which the ink drawing needle on the main assembly side of a recording means is inserted into the liquid container, a positioning portion with a diameter larger than that of the ink drawing portion 72*f*, an ink pouch (unshown), and a connective portion 72*g*.

Referring to FIG. 44, the diameter Y of the ink drawing portion 72*f* of the ink drawing member 72 is greater than that of the portion of the recess of the retaining portion of the bottom portion 62B of the liquid container shell. Thus, when the top and bottom portions 62A and L28 are joined, the ink drawing portion 72*f* of the ink drawing member 72 is compressed only, or mainly, in its radius direction. After assembly, the liquid container is structured as shown in FIG. 46.

The positioning portion 72*e* with the diameter accurately positions the ink drawing member 72 relative to the top and bottom portions 62A and 62B of the liquid container shell, and prevents the ink drawing member 72 from shifting.

FIGS. 47 and 48 show the second example of a conventional replaceable liquid container for an ink jet recording apparatus. FIG. 47 is a sectional view of the ink container, at the plane which divides the ink container into two symmetrical portions, and shows the details thereof. FIG. 48 is a schematic sectional view of the ink outlet portion of the ink container, more specifically, a plug for the connective portion, which connects the inside and outside of the ink container, and its adjacencies.

Referring to FIGS. 47 and 48, an ink container 100 has an ink storage chamber 101 and a waste ink storage chamber 102. One end of the ink storage chamber 101 is provided with two rubber plugs, through which the ink drawing needle (unshown) is put. Similarly, one end of the waste ink storage chamber 102 is provided with one rubber plug 104. These rubber plugs are parts of the connective portion. Except for the portion facing the ink passage portion 3 through which the ink drawing needle is put, each rubber plug 104 is confined by the wall of the rubber plug holding recess 105 and a rubber plug pressing member 107.

The waste ink storage chamber 102 has two storage portions (top and bottom portions in FIG. 47) connected to each other at one end of the chamber. The aforementioned portion, through which the ink drawing needle for the waste ink storage portion is put, corresponds in position to the bottom storage portion. In other words, the waste ink delivery needle connected to the waste ink delivery path of an ink jet recording apparatus is put through, so that the waste ink discharged through an ejection performance recovery process or the like is allowed to flow into the bottom storage portion of the waste ink storage chamber 102. Virtually the entire space of the waste ink storage chamber 102 is occupied by an absorbent member 108. Thus, after flowing into the bottom storage portion of the waste ink storage chamber 102, the waste ink is absorbed by the absorbent member 108. As the waste ink flows into the waste ink storage chamber 102, the waste ink gradually soaks the absorbent member 108, and reaches the portion of the absorbent member 108 in the top storage portion, soaking this portion as well. Eventually, it begins to seep out of the absorbent member 108. The top storage portion of the waste ink storage chamber 102 is provided with a partitioning wall 102A, which is located close to the end of the absorbent member 108. Thus, as long as the amount of the waste ink does not exceed the waste ink retaining capacity of the absorbent member 108, the aforementioned waste ink which seeps out of the absorbent member 108 does not spill over into the space on the right side of the partitioning wall 102A, that is, the portion of the top storage portion which does not contain the absorbent member 108. As the cumulative amount of the waste ink exceeds the capacity of the absorbent member, the waste ink which seeps out of the absorbent member 108 spills over into the space on the right side of the partitioning wall 102A, for the first time, and accumulates in the space. Eventually, the top surface of the body of the waste ink in the space on the right side of the partitioning wall 102A reaches a waste liquid detection electrode (unshown) located at a predetermined level. As a result, it is detected that the waste ink storage chamber 102 is filled up with the waste ink. Then, a user is prompted to replace the ink container 100. Further, the waste ink storage chamber 102 is provided with an air vent 109, which is located in the top rear corner. The waste ink storage chamber 102 is allowed to breath through this air vent.

Referring to FIG. 48, before the placement of the rubber plug 104 in the recess 105, the external diameter of the rubber plug 104 is greater than the internal diameter of the recess 105. Thus, the rubber plug 104 is placed in the recess 105 in the direction indicated by an arrow mark B, while being kept compressed in its radius direction (indicated by an arrow mark A in FIG. 48) with the use of a predetermined apparatus.

In the case of the ink drawing member 72 in the first example of a conventional ink container, shown in FIG. 44, which is disclosed in the aforementioned patent application, however, its positioning portion 72*e* functions only to accurately position the ink drawing member 72, and the ink drawing portion 72*f* remains compressed.

Further, the connective portion 72*g* simply connects the ink drawing portion 72*f* and ink pouch. In other words, only the ink drawing portion 72*f* contributes to the connection between the ink container and the main assembly of a recording apparatus.

The ink drawing portion 72*f* is compressed and confined by the top and bottom portions k2A and 62B of the ink container shell during the manufacture of the liquid container. Therefore, even when the cylindrical needle is not penetrating the ink drawing portion 72*f*, compression pressure is always present in the ink drawing portion 72*f*. Thus, when the cylindrical needle is within the elastic member, the compression pressure in the ink drawing portion 72*f* is a total of the compression pressure when the cylindrical needle is not in the imp 72*f* and the compression pressure proportional to the volume of the cylindrical needle.

Generally speaking, the greater the compression pressure, and the longer the duration of the compression pressure, the greater the progression of creep (phenomenon that an elastic substance kept under compression pressure for a certain length time fails to revert to its original state; in other words, it becomes permanently deformed).

In other words, when the cylindrical needle is pulled out after remaining in the ink drawing member 72 for a long time, the ink drawing member 74 is likely to fail to revert to the original state, allowing the liquid within the liquid container to drip through the connective hole.

Referring to FIG. 49, in the case of the second example of a liquid container in accordance with the prior arts, and the second example of an ink jet recording apparatus in accordance with the prior arts, if the diameter of an ink delivery needle 127, which is put through the ink passage portion 129 of a liquid container 130, is large, an elastic member 128 is expanded in the direction in which the ink delivery needle 127 advances, and also, in the radius direction of the elastic member 128 (FIG. 49(*a*). The volume by which the elastic member 128 is expanded is equal to the volume of the portion of the ink delivery needle 127 within the elastic member 128. Then, even after the ink delivery needle 127 is withdrawn from the elastic member 128, the elastic member 128 does not revert to its original condition.

More concretely, on the needle entry side, the elastic member 128 remains indented around the path of the ink delivery needle 127, whereas on the side opposite to the needle entry side, the conical hole formed around the ink delivery needle 127 as the internal portion of the elastic member 128 was pushed out and partially dragged out of the elastic member 128 remains virtually intact (FIG. 49(*b*)). In this state, the sealing performance of the elastic member is at a low level. Thus, there is a possibility that the ink in the liquid container is allowed to drip from the ink delivery hole 131, and contaminates the area around the removed liquid container.

Further, when the elastic member 128 is in the above described state, the interface which is formed between the internal portion of the elastic member 128 and ink delivery needle 127 as the liquid container is remounted in the main assembly of a recording apparatus is smaller than other wise. Therefore, there is a possibility that ink will drip from the ink delivery hole 131 and contaminate the recording apparatus main assembly, and the area around the liquid container.

FIG. 50 is a plan view of a rubber plug for the ink passage portion of a liquid container, after having been penetrated a number of times by the ink delivery needle of the recording apparatus main assembly. It shows the ribs formed in the rubber plug.

When a liquid container in accordance with the prior arts is mounted in the main assembly of a recording apparatus in accordance with the prior arts, the ink delivery needle itself of the recording apparatus main assembly enters the liquid container by ripping through the elastic member 128, that is, the rubber plug, fitted in the ink delivery hole. If, for some reason or another, the user of the recording apparatus repeatedly mounts and dismounts the liquid container a number of times, the ink delivery needle 127 randomly tears the elastic member 128, resulting in tears 128*a*–128*c* shown in FIG. 50, each time the liquid container is mounted; in other words, the elastic member 128 is damaged.

If these tears become connected, or a small piece or pieces of the elastic member 128 become severed from the elastic member 128, it becomes impossible for the elastic member 128 to maintain a predetermined amount of compression pressure. In the worst case, the hatched portion 128*d* in the drawing falls out and leaves a hole. In particular, when an ink jet recording apparatus is equipped with an ink delivery needle with a large diameter, the tear made in the elastic member 128 by the ink delivery needle is wider, allowing the ink to drip from the ink delivery hole. Also in this case, as the liquid container is repeatedly mounted into, or dismounted from, the recording apparatus, the progression of the damage to the elastic member 128 results in the formation of a hole through the elastic member 128, making it impossible for the elastic member 128 to block the ink flow.

The above described problems are likely to occur to a commercial ink jet recording apparatus enabled to handle a large sheet of paper, for the following background. That is, in the case of a commercial ink jet recording apparatus, in order to inexpensively produce a large amount of prints, a print job is automatically carried out at night, generally without the presence of an operator, after the replacement of the ink container in the apparatus with an ink container completely filled with ink. Then, the partially empty ink container having been replaced by the ink container completely filled with ink, for the nigh job, is remounted into the recording apparatus during the daytime when more hands are available.

SUMMARY OF THE INVENTION

Thus, the primary object of the present invention is to provide a liquid container, the inside and outside of which become connected as a cylindrical needle is put through a predetermined portion of the wall of the liquid container, and which can be mounted into, or dismounted from, the main assembly of a recording apparatus, without allowing the ink therein to leak, even after it is left alone for a long period of time, or a cylindrical needle is left penetrating the liquid container for a long period time, as well as a recording apparatus compatible with such a liquid container.

The second object of the present invention is to secure a sufficient amount of contact surface between the elastic member of a liquid container and a cylindrical ink delivery needle, by preventing the phenomenon that as a cylindrical needle is pushed through the sealing member of a liquid container, the elastic member is deformed in such a manner that the portion of the elastic member around the needle, on the needle entry side of the sealing member, is pulled into the elastic member, whereas the portion of the elastic member around the needle, on the side opposite to the needle entry side, conically peels away from the needle, and thereby, to provide a liquid container, the inside and outside of which become connected as a cylindrical needle is put through a predetermined portion of the wall of the liquid container, and which can be mounted into, or dismounted from, the main assembly of a recording apparatus, without allowing the ink therein to leak, as well as a recording apparatus compatible with such a liquid container.

The third embodiment of the present invention is to provide a liquid container the inside and outside of which become connected as a cylindrical needle is put through a predetermined portion of the wall of the liquid container, and which can be mounted into, or dismounted from, the main assembly of a recording apparatus, without allowing the ink therein to leak, even after the liquid container is connected to the cylindrical needle a substantial number of times, as well as a recording apparatus compatible with such a liquid container.

Thus, the present invention for accomplishing the above described three objects, that is, for solving the three problems, the present invention essentially comprises three additional inventions. According to an aspect of the present invention, there is provided a liquid container for an ink jet recording apparatus, comprising a connection opening connectable with an outside; an elastic member provided in said connection opening, said elastic member being adapted to be penetrated by a cylindrical member for fluid communication with the outside; said elastic member including a compressed region and a substantially non-compressed region in a state without said cylindrical member penetrated, disposed in this order in a direction of insertion of said cylindrical member, wherein said compressed region and said non-compressed region are capable of being compressed when they are penetrated by said cylindrical member.

With this structure, the deterioration of elasticity of the elastic member in the non-compressed region with time is smaller than that in the elastic member in the compressed region. Therefore, the elastic member in the non-compressed region is relatively free of the phenomenon (creep phenomenon) in which when the cylindrical member is kept penetrating in the compressed and non-compressed region of the elastic member for a long term, the permanent strain is produced such that elastic member does not restore the original state even after the cylindrical member is removed. Therefore, even after the removal of the cylindrical member after long term penetration, the elastic member in the non-compressed region can avoid improper sealing of the connection opening. In addition, by the provision of the non-compressed region of the elastic member, the absolute area with which the elastic member is contacted to the cylindrical member, can be increased. Therefore, the sealing property of the connection opening against the pressure change inside or outside of the liquid container is improved.

With this structure, it may preferably be that a plane, perpendicular to the direction of insertion of the cylindrical member, of said compressed region of said elastic member is wider than a plane, perpendicular to the direction of insertion, of said non-compressed region of said elastic member in the state without said cylindrical member penetrated. In addition, it may preferably be that a length, measured in the direction of insertion of the cylindrical member, of said compressed region of said elastic member, is longer than a length, measured in the direction, of said non-compressed region of said elastic member in the state without said cylindrical member penetrated.

Additionally, it may preferably be that said compressed region and said non-compressed region of said elastic member are portions of a single member, in the state without the cylindrical member penetrated. In this case, it may preferably be that one of opposite end surfaces of said elastic member with respect to the direction of the insertion of said cylindrical member has a protruded form, and the other has a recessed form to provide a substantially uniform thickness, and wherein said non-compressed region has a configuration protruded toward said recessed form in the state without the cylindrical member penetrated. Furthermore, it may preferably be that the cylindrical member is inserted at the end having the protruded form.

Moreover, it may preferably be that there is further provided a housing, provided in said connection opening, for housing said elastic member, said housing having an inner diameter which is substantially equal to an outer diameter of said elastic member, wherein said elastic member is compressed toward a center of said elastic member by a fixing member compressing the end of the elastic member having the protruded form. With this structure, the compressive force is produced within the column configuration portion only when the cylindrical member is inserted into the column configuration portion of the elastic member, and therefore, permanent strain of the column configuration portion of the elastic member with time does not easily occur as compared with the portion of elastic member which is always placed in a compressed state. Therefore, even if the cylindrical member is removed after long term continuous penetration of the cylindrical member in the elastic member, the leakage of the liquid does not easily occur through the connection opening.

In addition, it may preferably be that when the end of said elastic member having the protruded form is compressed to the fixing member having an opening through which the cylindrical member is penetrated, the elastic member is not pressed into the opening of said fixing member. In this case, it may preferably be that the end having the protruded form has a conical portion at a top of the protruded form, or that the end having the protruded form has a flat surface substantially perpendicular to the direction of insertion of the cylindrical member or a stepped-down surface. With such structures, the direction in which the elastic member is pressed out by the cylindrical member when the elastic member is penetrated by the elastic member, can be limited to the direction of the diameter of the elastic member, and therefore, the depression of the elastic member attributable to the insertion of the cylindrical member can be more suppressed.

According to another aspect of the present invention, there is provided a liquid container for an ink jet recording apparatus, comprising a connection opening connectable with an outside; an elastic member plugged in said connection opening; a housing for housing said elastic member, said elastic member being adapted to be penetrated by a cylindrical member for fluid communication with the outside; a slit provided in said elastic member and extended from an end at which said cylindrical member is insertable in a direction of insertion of said cylindrical member, wherein said elastic member is compressed inwardly in said housing.

With this structure, the cylindrical needle enters along the slit, and therefore, the elastic member can be pierced in a constant state. Therefore, the possible damage to the elastic member upon the insertion of the cylindrical needle can be avoided, thus assuring the hermetical sealing of the connection opening.

In the structure, it may preferably be that said elastic member is in the form of a dome having a protruded form on one side and a recessed form on the other side in the direction of insertion of the cylindrical member, the dome having a substantially uniform thickness, and said elastic member is provided with a column configuration portion of the recessed form side, wherein the slit is within the column configuration portion. With the dome-like configuration of the elastic member, the state in which the elastic member is compressed toward the center thereof can be produced in the elastic member in the housing, when the elastic member is pressed by the fixing member. Therefore, the close contact between the elastic member and the cylindrical member when the cylindrical member is penetrated through the elastic member is improved, thus enhancing the reliability of the hermetical sealing of the connection opening. The column configuration portion of the dome configuration projects in the direction in which the cylindrical member is inserted, and therefore, when the cylindrical member is inserted into the elastic member, protrusion or the like, and therefore, the depression of the elastic member due to the insertion of the cylindrical member can be prevented. Therefore, as compared with the prior art structure, the contact area between the cylindrical member and the elastic member can be large. Additionally, the provision of the slit extending in the direction of the insertion of the cylindrical member, the cylindrical member can be guided by the slit. Therefore, the possible damage to the elastic member upon the insertion of the cylindrical member, can be avoided, thus assuring the hermetical sealing of the connection opening.

In this case, it may preferably be that only one such slit is provided. With the structure, the elastic member can be penetrated always at a constant position. Additionally, it may preferably be that said slit does not penetrates all through said elastic member. With this structure, the proper sealing of the connection opening can be maintained in the significant ambience condition changes during the distribution process from the manufacturing of the container to the beginning of the use of the container. Additionally, it may preferably be that a length of slit, measured in a direction perpendicular to the direction of insertion of the cylindrical member satisfies $2L>\pi D$, where D is a diameter of the cylindrical member. With this structure, a cylindrical needle is penetrated through the elastic member along the slit, the slit is prevented from enlarging.

According to another aspect of the present invention, there is provided a liquid container for an ink jet recording apparatus, comprising a connection opening connectable with an outside; an elastic member provided in said connection opening, said elastic member being adapted to be penetrated by a cylindrical member for fluid communication with the outside; said elastic member including a compressed region and a substantially non-compressed region in a state without said cylindrical member penetrated, disposed in this order in a direction of insertion of said cylindrical member, wherein said compressed region is in the form of a dome having a protruded form on one side and a recessed form on the other side in the direction of insertion of the cylindrical member, wherein a top portion of said protruded form has a flat surface substantially perpendicular to the direction of insertion of the cylindrical member or a stepped-down surface, wherein said non-compressed region is provided with a column configuration portion of the recessed form side, wherein the slit is within the column configuration portion, wherein said compressed region and said non-compressed region are capable of being compressed when they are penetrated by said cylindrical member. wherein said elastic member has a slit provided in said elastic member and extended from an end at which said cylindrical member is insertable in a direction of insertion of said cylindrical member, and the slit is within the column configuration portion, wherein said elastic member is compressed inwardly in said housing.

According to a further aspect of the present invention, there is provided a liquid container for an ink jet recording apparatus, comprising a connection opening connectable with an outside; an elastic member provided in said connection opening, said elastic member being adapted to be penetrated by a cylindrical member for fluid communication with the outside, said elastic member including a compressed region and a substantially non-compressed region in a state without said cylindrical member penetrated, disposed in this order in a direction of insertion of said cylindrical member, wherein said compressed region is in the form of a dome having a protruded form on one side and a recessed form on the other side in the direction of insertion of the cylindrical member, wherein a top portion of said protruded form has a flat surface substantially perpendicular to the direction of insertion of the cylindrical member or a stepped-down surface, wherein said non-compressed region is provided with a column configuration portion of the recessed form side, wherein said compressed region and said non-compressed region are capable of being compressed when they are penetrated by said cylindrical member, wherein said elastic member has a slit provided in said elastic member and extended from an end at which said cylindrical member is insertable in a direction of insertion of said cylindrical member, and the slit is within the column configuration portion, wherein said elastic member is compressed inwardly in said housing.

In these two aspects, with the dome-like configuration of the elastic member, the state in which the elastic member is compressed toward the center thereof can be produced in the elastic member in the housing, when the elastic member is pressed by the fixing member. Therefore, the close contact between the elastic member and the cylindrical member when the cylindrical member is penetrated through the elastic member is improved, thus enhancing the reliability of the hermetical sealing of the connection opening. In addition, by the provision of the column configuration portion, the depression of the elastic member due to the insertion of the cylindrical member can be avoided, and therefore, the contacted area between the cylindrical member and elastic member can be larger than in the conventional structure. Additionally, the provision of the slit extending in the direction of the insertion of the cylindrical member, the cylindrical member can be guided by the slit.

Additionally, in the second aspect of the present invention, it may preferably be that said fixing member is provided with an absorbing material for absorbing a droplet. In this case, it may preferably be that said fixing member is provided with grooves extending radially from said connection opening. With this structure, a small amount of droplets which are produced when the liquid container is disengaged from the cylindrical member (in the case that liquid accommodated in the liquid container is ink, they are droplets of ink), can be efficiently guided to the absorbing material by the capillary force. Therefore, the user of the ink jet recording apparatus, the recording device per se and the articles placed around the recording device can be protected effectively from contamination.

In the second, third and forth aspects, it may preferably be that there is further provided a fixing member for pressing and fixing said elastic member, said fixing member being provided with an absorbing material for absorbing a droplet and being provided with grooves extending radially from said connection opening, wherein at least one of said grooves extends along said slit. With this structure, the fine grooves on the surface of the elastic member and the grooves of the fixing member are continued, so that liquid droplets deposited on the surface of the elastic member (in the case of the liquid being ink, they are ink droplets) can be efficiently guided to the absorbing material. In the second and third aspects, it may preferably be that there is further provided a fixing member for pressing and fixing said elastic member, wherein a free end of the cylindrical member to be inserted into seven elastic member is tapered, and said affixing member has an opening contacted to the elastic member to guide insertion of the cylindrical member into said elastic member, wherein the opening has a length, measured in the direction of insertion of the cylindrical member, is larger than a length of the tapered portion of the cylindrical member. With this structure, it can be avoided that free end of the cylindrical member reaches the surface of the elastic member while the tapered portion at the free end of the cylindrical member is still in contact with the inside diameter of the opening of the fixing member for permitting the insertion of the cylindrical member. As a result, it is possible to guide the connecting needle to the center of the elastic member. In this case, it may preferably be that the plane perpendicular to the direction of insertion of the cylindrical member has a circular flat plane having a diameter larger than the diameter of the opening provided in the fixing member. With this feature, the compression stress toward the center of the drastic member upon the assembling operation, can be related by the contact surface between the flat surface of the fixing member and the flat surface of the elastic member, and therefore, uniform contacts and therefore uniform compressions stresses can be accomplished.

In the second and third aspects, it may preferably be that a lubricant exists on a surface of said elastic member. Additionally, it may preferably be that a lubricant exists on a surface of said elastic member open to an opening of a fixing member for pressing and fixing said elastic member, the cylindrical member being inserted through the opening of the fixing member; that a lubricant exists on contact surfaces between said elastic member and a fixing member for pressing and fixing said elastic member; that a lubricant exists on contact surfaces between inside of said housing and said elastic member; that a lubricant exists in a slit provided in said elastic member and extended in the direction of insertion of the cylindrical member; or that a lubricant exists on a surface of a fixing member for pressing and fixing said elastic member; that a lubricant on said elastic member comprises a glycol material.

With any of such a features, the friction between the elastic member and the leading edge portion of the cylindrical member is reduced, and the cylindrical member can be assuredly guided to the slit, and it is easy to insert the cylindrical needle into the elastic member by a powerless user. Articulate, it is preferable to the lubricant is applied in the slit extended in the insertion of the cylindrical member into the elastic member.

By the existence of the lubricant on the surface of the fixing member, or the contact surface between the fixing member and said elastic member, it can be avoided or suppressed that movement within the elastic member per se upon mounting of the elastic member, or upon insertion of the cylindrical member, occurs, or that upon the removal of the cylindrical member, the material of the elastic member per se is moved you to the friction between the elastic member and the fixing member. By applying the lubricant to the contact surfaces between the housing and the elastic member, the elastic member can be easily inserted.

In the first aspect of the present invention described above, it may preferably be that there is further provided a fixing member for pressing and fixing said elastic member, wherein a connecting portion configuration between said elastic member and said housing is substantially circular by the pressing of said fixing member. With this structure, the compressive force is easily concentrated on the center on elastic member, which is preferable.

In the second aspect of the present invention, it may preferably be that a plurality of such slits are provided and are crossed at a substantial center of said elastic member. When the plurality of slits are provided, it is preferable that slits are crossed with each other substantially at the center of the elastic member, since then the elastic member can be properly inserted into the cylindrical member, even if the inserting direction of the cylindrical member is not particularly regulated.

In the third aspect of the present invention, it may preferably be that the slits are generally linear or circular. The arcuate configuration is particularly preferable when the opening diameter of the cylindrical member cannot be large from standpoints of dimensions of the other parts.

In addition, in the second aspect, it may preferably be that a length measured in a direction perpendicular to the direction of insertion satisfied $1.5\ \pi D>L$, where D is a diameter of said cylindrical member. If the length of the slit, measured in the direction perpendicular to the direction of insertion of the cylindrical needle, is too large, the material of the elastic member at the intersection and the other material thereof are made separate, and therefore, the sealing property against the depression of the elastic member is deteriorated, and therefore, the relationship $1.5\pi R>L$ is preferable. According to a further aspect of the present invention, there is provided a liquid container comprising connection opening connectable with an outside, wherein said liquid container is brought into fluid communication with the outside by insertion of a cylindrical member through said connection opening; an elastic member plugged in said connection opening; and a guide for guiding the cylindrical member into a range within 0.5 D from a center of the elastic member, where D is a diameter of said cylindrical member. With this structure, the possibility of the damage to the elastic member can be further reduced.

According to a yet further aspect of the present invention, there is provided a recording apparatus using a liquid container as described above, comprising a mounting means for detachably mounting said liquid container, and the cylindrical member provided in the mounting means, said cylindrical member penetrates through said elastic member in said connection opening of said liquid container.

The recording apparatus preferably includes a recording apparatus using a liquid container as described above, further comprising an ink jet head for affecting recording by ejecting droplets of liquid supplied from said liquid container.

In this case, the ink jet head preferably includes means for ejecting the droplets of liquid by application of thermal or vibration energy to the liquid in models.

These and other objects, features, and advantages of the present invention will become more apparent upon consideration of the following description of the preferred embodiments of the present invention, taken in conjunction with the accompanying drawings.

DESCRIPTION OF PREFERRED EMBODIMENTS

Hereinafter, the preferred embodiments of the present invention will be described with reference to the appended drawings.

The first object of the present invention is to provide a liquid container, which can be mounted into, or dismounted from, the main assembly of an ink jet recording apparatus, without leaking the liquid therein, even after it is left alone for a long period of time, or it is left alone, with a cylindrical needle penetrating it, for a long period of time. The concrete examples of such a liquid container is disclosed in the description of the first embodiment of the present invention.

The second object of the present invention is to prevent the phenomenon that as a cylindrical needle is pushed through the sealing member of a liquid container, the elastic member is deformed in such a manner that the portion of the elastic member around the needle, on the needle entry side of the sealing member, is pulled into the elastic member, whereas the portion of the elastic member around the needle, on the side opposite to the needle entry side, conically peels away from the needle, and thereby, to provide a liquid container, which can be mounted into, or dismounted from, the main assembly of a recording apparatus, without allowing the ink therein to leak. The concrete examples of such a liquid container are disclosed in the description of the second and third embodiments of the present invention.

The third embodiment of the present invention is to provide a liquid container which can be mounted into, or dismounted from, the main assembly of a recording apparatus, without allowing the ink therein to leak, even after the liquid container is connected to the cylindrical needle a substantial number of times. The concrete examples of such a liquid container are disclosed in the description of the fourth and fifth embodiments of the present invention.

The gist of the present invention is related to the connective portion of a liquid container, by which the liquid container is connected to an ink jet recording apparatus, and is applicable to all the ink containers disclosed in the first to fifth embodiments of the present invention. Thus, the ink supplying system shown in FIG. 1 is common through all the embodiments.

Figure 1:
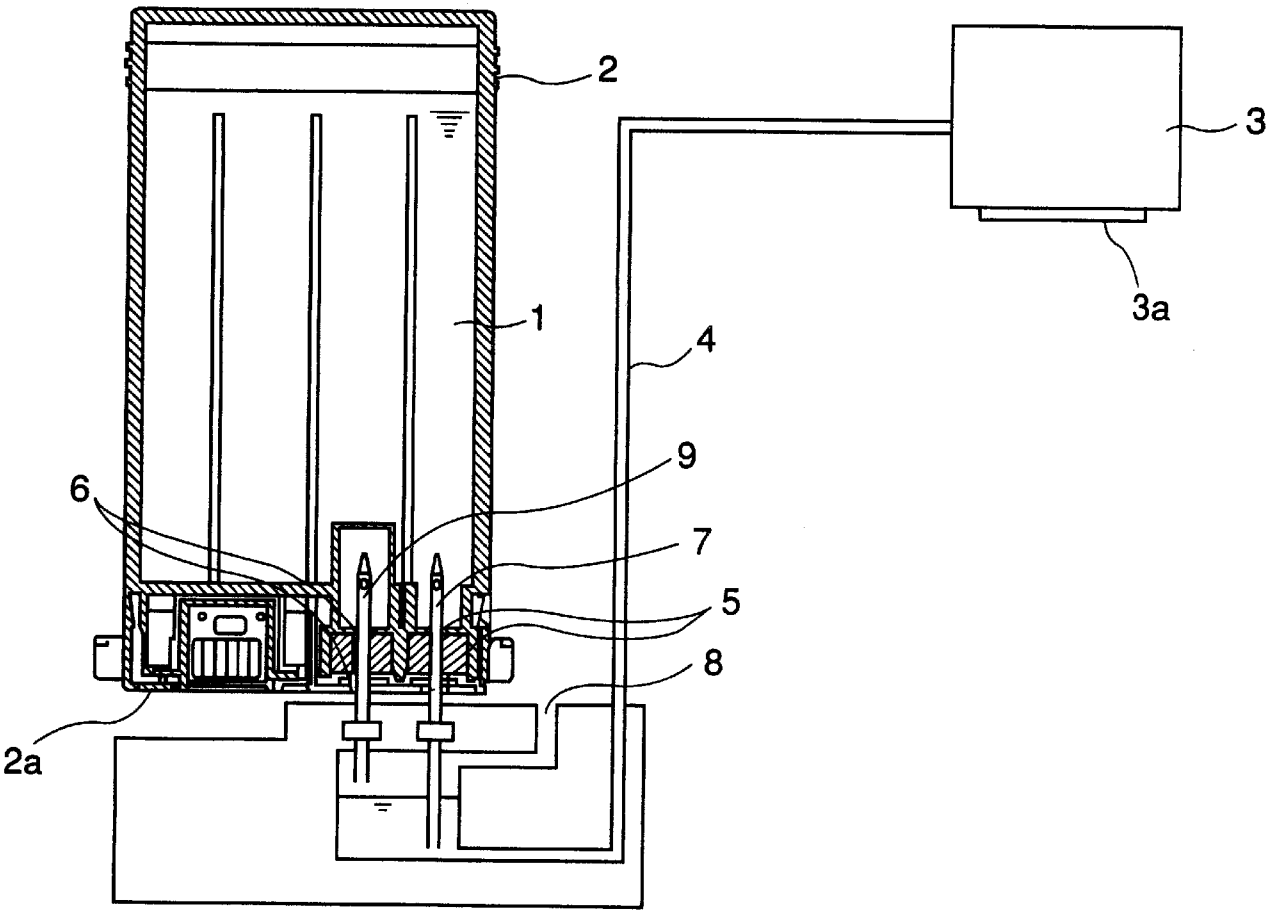
FIG. 1 is a schematic drawing of an example of an ink supplying system in an ink jet recording apparatus which uses a liquid container in accordance with the present invention.

Further, the present invention is applicable an ink supplying system other than the system shown in FIG. 1, as long as the ink supplying system employs a connective system comprising a connective needle (cylindrical member) and an elastic member.

FIG. 1 is a schematic drawing of an example of an ink supplying system for an ink jet recording apparatus which uses a liquid container in accordance with the present invention.

The ink supplying system shown in FIG. 1 comprises: a liquid container for storing ink 1; an ink jet head 3 which ejects the ink 1, in the form of droplets, onto recording medium (unshown), for recording an image; a liquid supplying tube 4 which is a tube for supplying the ink from the liquid container 2 to the ink jet head 3; a liquid drawing needle 7 (cylindrical member) which is inserted into the first joint 5 of the bottom portion 2*a* of the liquid container 2 in order to connect the liquid supplying tube 4 and liquid container 2; an ambient air drawing tube 8 for introducing ambient air into the liquid container by an amount equivalent to the amount by which ink is drawn out of the liquid container 2 through the liquid drawing needle 7; and an ambient air introducing needle 9 (cylindrical member) which is inserted into the second joint 6 of the bottom portion 2*a* of the liquid container 2, at the same time as the ink drawing needle 7 is inserted into the aforementioned first joint 5, in order to connect the ambient air drawing tube 8 and liquid container 2. The connective needles 7 and 9 are liquid supplying tubes with a pointed tip.

The ink ejection surface 3*a* (surface which has ink ejection orifices) of the ink jet head 3 is positioned at a level above the lowest point of the liquid drawing path connected to the liquid container 2, generating negative pressure in the liquid path in the ink jet head 3. With the presence of this negative pressure, the meniscus in each ink ejection orifice remains stable.

In this liquid supplying system, as ink is ejected from the ink jet head 3, the ink within the liquid container 2 is drawn out of the liquid container 2, and is delivered to the ink jet head 3 through the liquid drawing needle 7 and liquid delivery tube 4. The liquid container 2 is virtually in the form of a box, and does not deform in response to the drawing of the ink 1 within the liquid container 2. Therefore, as the ink 1 is drawn, atmospheric air enters the liquid container 2 by the amount equivalent to the amount by which the ink I is drawn, through the air drawing tube 8 and air drawing needle 9, making it possible to continuously supply the ink jet head 3 with ink, while always maintaining a predetermined amount of negative pressure within the liquid paths in the ink jet head 3. The ink in the nozzle is pushed (ejected) out of the nozzle by the thermal energy from an unshown heat generating element disposed in the nozzle, adjacent to the ink ejection orifice of the nozzle, or by the vibratory energy of an unshown vibratory element disposed in the nozzle, adjacent to the ink ejection orifice of the nozzle. Each time the ink is ejected, the nozzle is refilled with ink by the capillary force of the nozzle. As this ink ejection cycle, that is, a combination of the process in which ink is ejected from the nozzle and the process in which the nozzle is refilled with ink, is repeated, ink is drawn out of the liquid container 2 as necessary.

First, the liquid container, which is common through the first to fifth embodiments of the present invention, will be described with reference to FIGS. 2 and 3.

Figure 2:
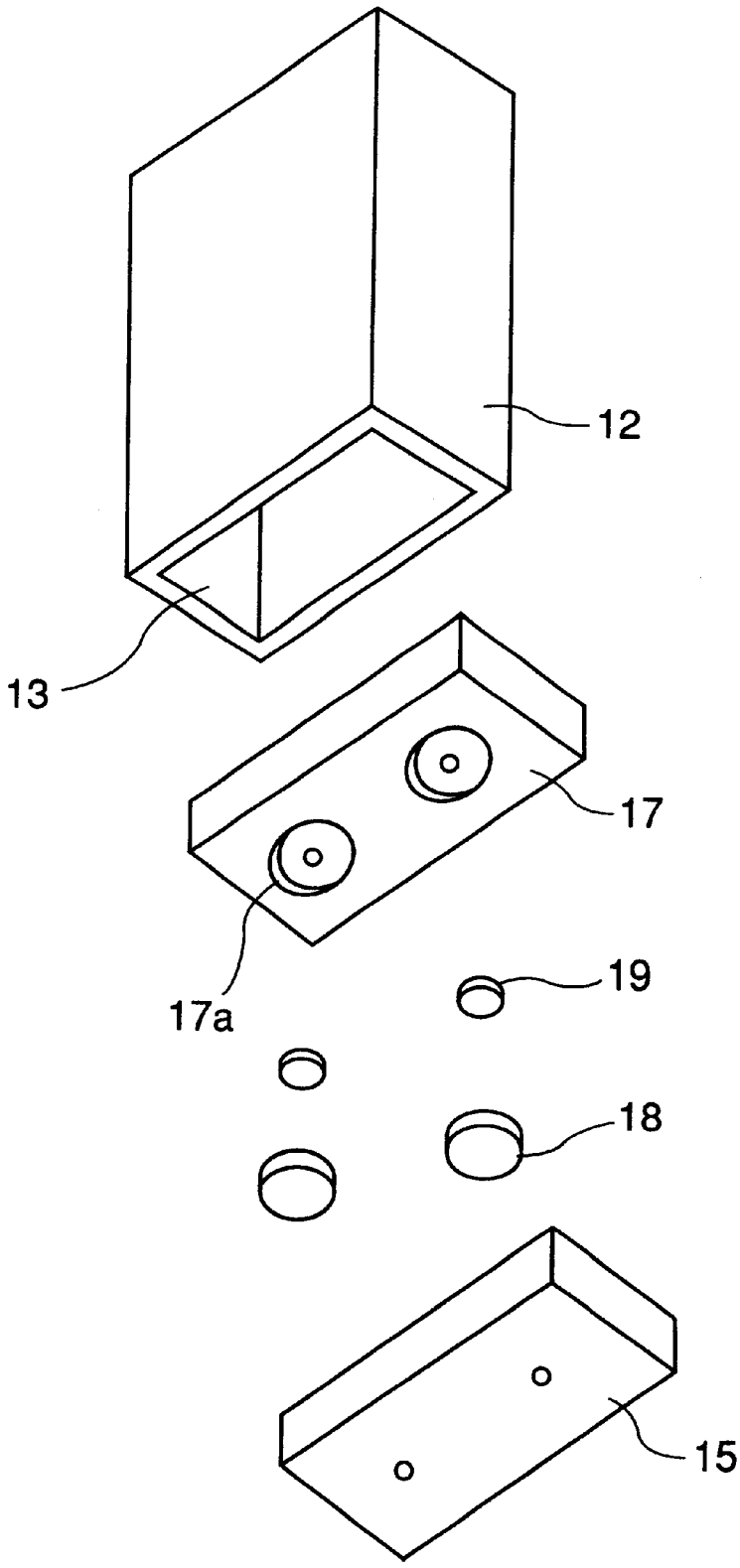
FIG. 2 is an exploded perspective view of the liquid container in the first embodiment of the present invention, shown in FIG. 1, and shows the structural components thereof.

FIG. 2 is an exploded perspective view of the liquid container shown in FIG. 1, and shows the structural components of the liquid container. FIG. 3 is a sectional view of the liquid container shown in FIG. 3, at a plane inclusive of the axial line of the liquid container.

Figure 3:
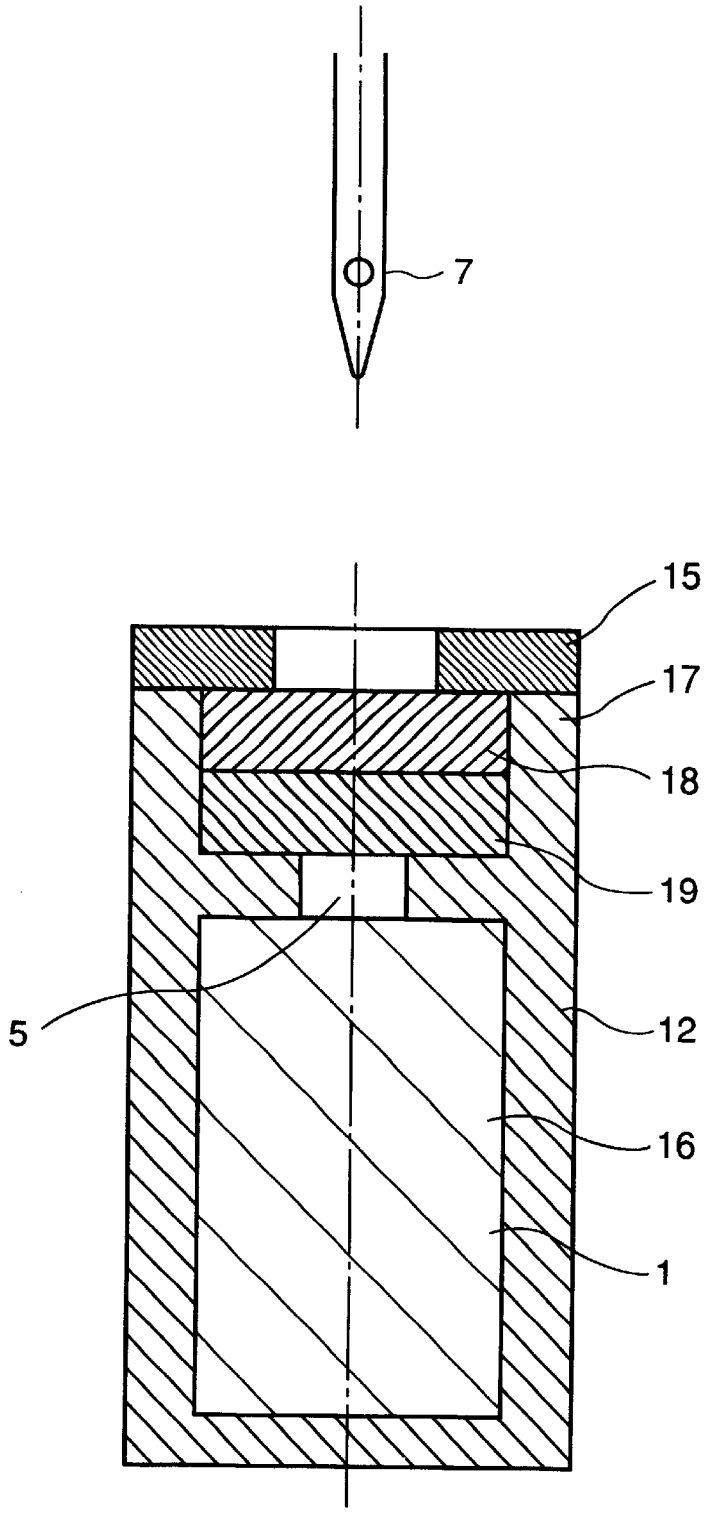
FIG. 3 is a sectional view of the liquid container in the first embodiment of the present invention, shown in FIG. 1, at a plane inclusive of the axial line of the container.

As shown in FIGS. 2 and 3, the liquid container 2 common through the first to fifth embodiments of the present invention comprises the ink 1, a liquid holding portion 12, a compressed elastic member 18, an uncompressed elastic member 19, an plastic member retaining member, and an elastic member storing portion 17.

Naturally, the compressed elastic member 18 and uncompressed elastic member 19 are not in the compressed state when they are not in the elastic Member storing portion 17.

Referring to FIG. 2, the liquid storing portion 12 in this embodiment is a container in which the ink 1 is directly stored. It comprises an opening 13, through which the liquid drawing connective needle 17 and air introducing connective needle 9 (FIG. 1) are inserted into the internal space of the liquid storing portion 12, which is shield from the ambience by the elastic member storing portion 17, through the compressed elastic member 18 and uncompressed elastic member 19.

The liquid storing portion 12 is formed by direct blow molding or injection molding. Its size may be varied according to the amount by which liquid needs to be contained therein.

The opening 13 of the liquid storage portion 12 is covered with the elastic member storing portion 17, which is attached to the liquid storage portion 12 with the use of ultrasonic welding or gluing. The elastic member storing portion 17 is provided with a pair of recesses 17*a* in which the compressed elastic member 18 and uncompressed elastic member 19 are housed.

In order to prevent the compressed elastic members 18 and uncompressed elastic members 19 housed in the recesses 17*a* from becoming dislodged from the recesses 17*a*, the elastic member retaining member 15 is attached to the elastic member storing portion 17 by ultrasonic welding, gluing, or the like, completing the liquid container 2.

Referring to FIG. 3, as the liquid container 2 is assembled as described above, the internal space of the liquid storage portion 12 becomes sealed, forming a sealed chamber, which constitutes a liquid chamber for storing one of the various inks used by an ink jet recording apparatus to record one of the various colors.

When the liquid container 2 is in an ink jet recording apparatus (FIG. 1), the liquid chamber lk constitutes the top side of the ink container 2. The t opening 13 of the liquid containing portion 12 is covered with the elastic member storing portion 17, which is attached to the liquid containing portion 12. The elastic member storing portion 17 is provided with a first connective hole 5 and a second connective hole 6 through which the liquid drawing connective needle 7 and air introducing connective needle 9 are placed into the liquid chamber 16. One end of the first connective hole 5 is covered with a combination of the compressed elastic member 18 and uncompressed elastic member 19, and one end of the second connective hole 6 is covered with another combination of the compressed elastic member 18 and uncompressed elastic member 19. The connective needles 7 and 9 are put through the corresponding combinations of the compressed elastic member 18 and uncompressed elastic member 19, establishing a pair of passages between the inside and outside of the liquid chamber 16.

(Embodiment 1)

Next, referring to FIGS. 2–9, the first embodiment of the present invention will be described.

In this embodiment, the compressed elastic member 18 is used as an elastic member which is subjected to compressive force as it is placed into the liquid container 2. In comparison, the uncompressed elastic member 19 is not subjected to compressive force as it is placed into the liquid container 2. It is subjected to compressive force for the first time as the connective needles (cylindrical members) are inserted.

In the following descriptions of the embodiments of the present invention, "uncompressed state" means such a state of the elastic member that the compression pressure generated in the elastic member by the external force is not present in the elastic member.

Figure 4:
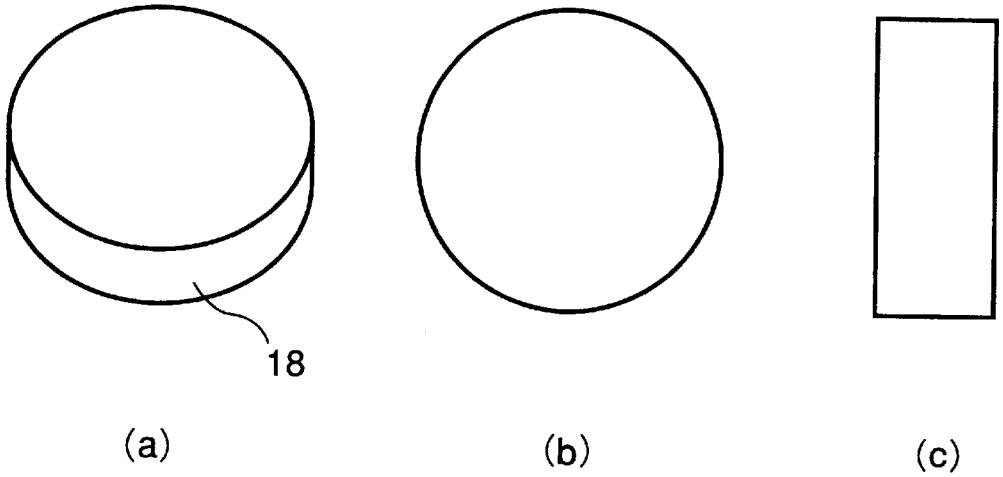
FIG. 4 is an external view of the portion of the elastic member shown in FIG. 2, which is placed, in the compressed state, in the recess of the elastic member of the liquid container: (*a*) is a perspective view; (*b*) is a plan view; and (*c*) is a side view.
Figure 5:
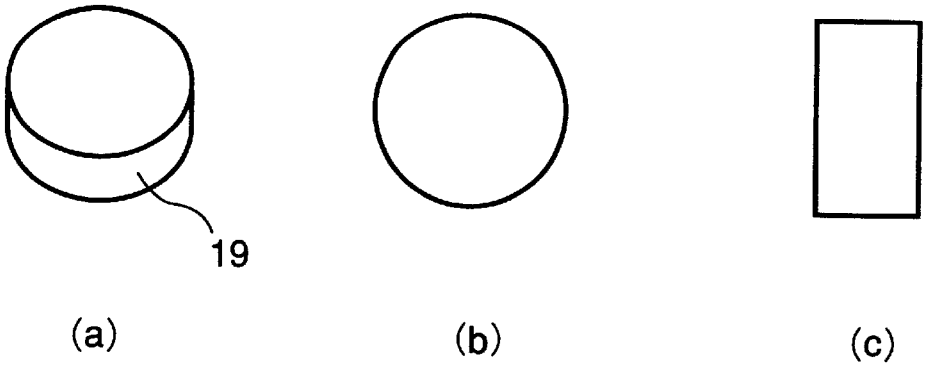
FIG. 5 is an external view of the portion of the elastic member shown in FIG. 2, which is placed, in the virtually uncompressed state, in the recess of the elastic member of the liquid container: (*a*) is a perspective view; (*b*) is a plan view; and (*c*) is a side view.

FIG. 4 is an external view of the compressed elastic member 18 shown in FIG. 2: FIG. 4(*a*) is a perspective external view; FIG. 4(*b*) is a plan view; and FIG. 4(*c*) is a side view. FIG. 5 is an external view of the uncompressed elastic member 19; FIG. 5(*a*) is a perspective external view; FIG. 5(*b*) is a plan view; and FIG. 5(*c*) is a side view.

Figure 6:
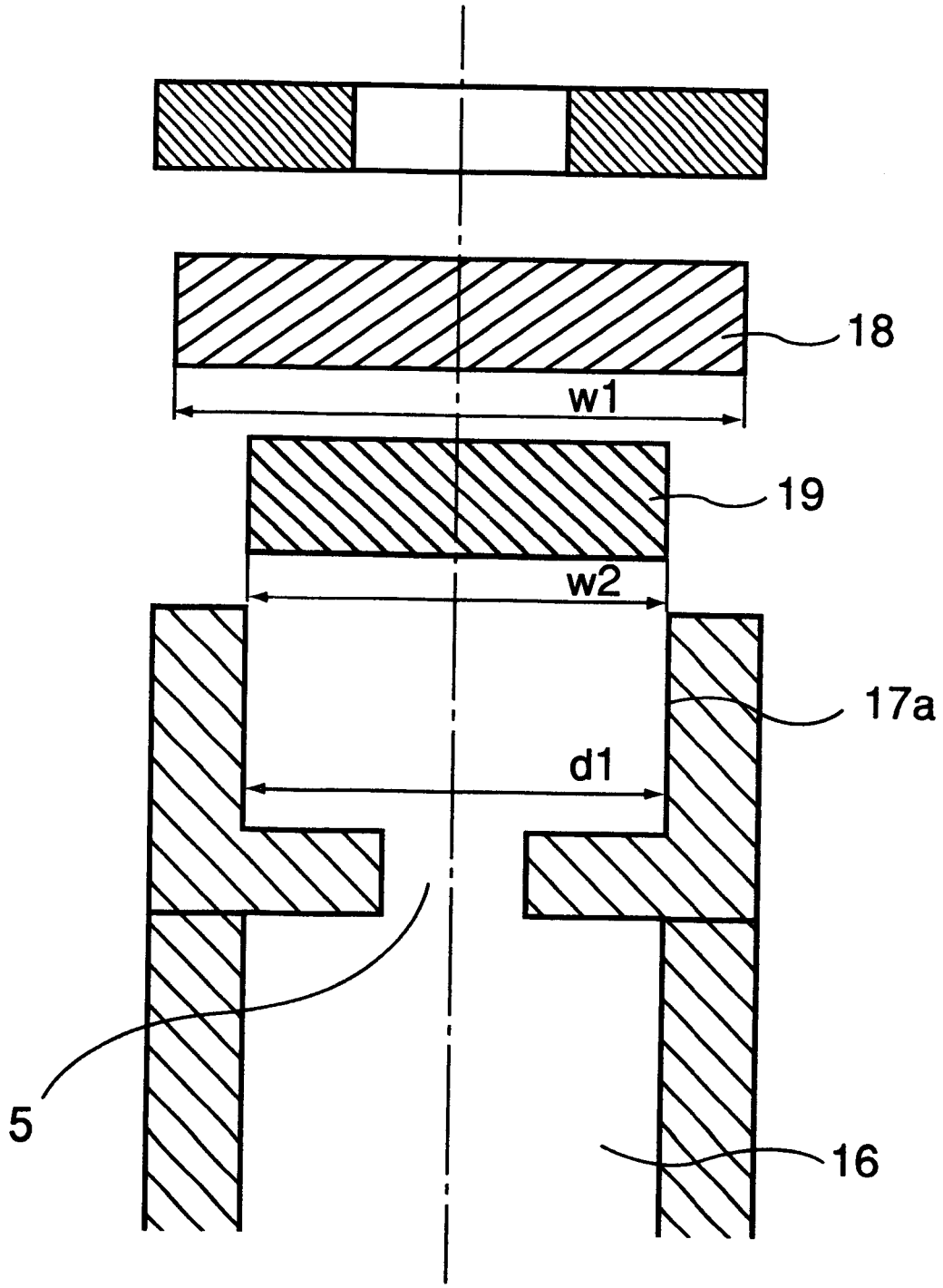
FIG. 6 is an enlarged sectional view of the connective portion of the liquid container, shown in FIG. 3, and shows the structural components thereof prior to the assembly of the liquid container.
Figure 7:
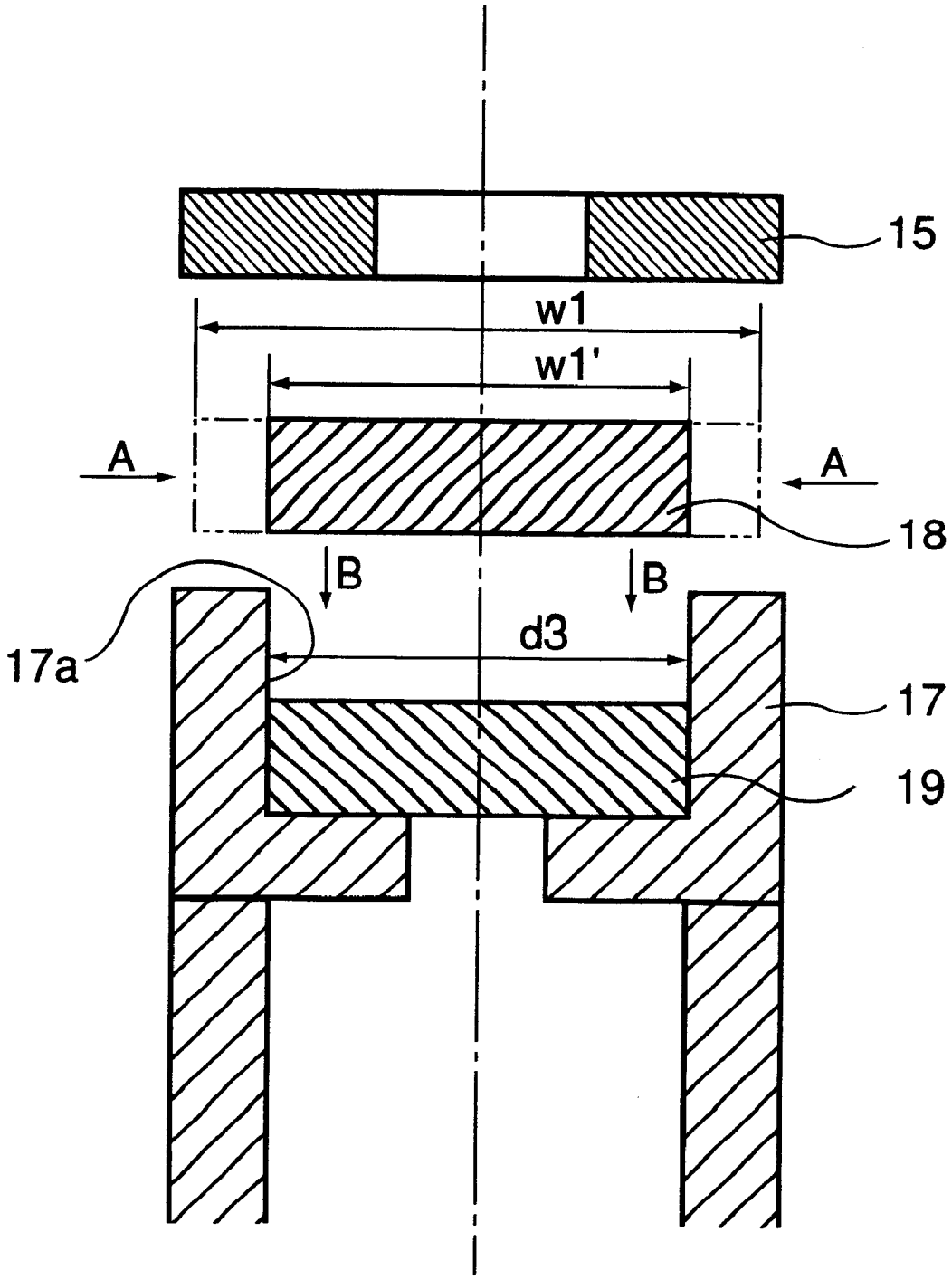
FIG. 7 is an enlarged sectional view of the connective portion of the liquid container, shown in FIG. 3, and shows the structural components thereof during the assembly of the liquid container.
Figure 8:
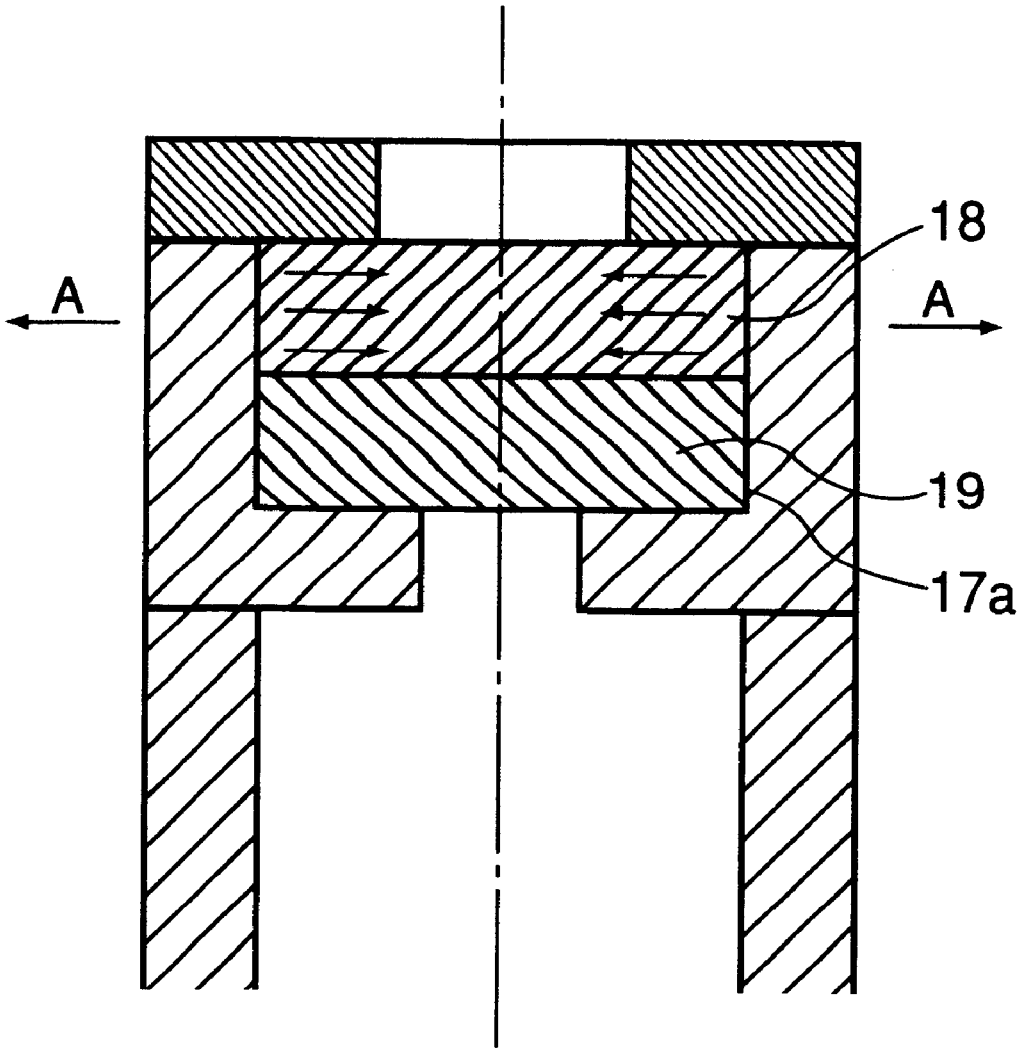
FIG. 8 is an enlarged sectional view of the connective portion of the liquid container, shown in FIG. 3, and shows the components thereof after the completion of the liquid container, that is, after the placement of the elastic member in the recess of the elastic member holding member of the liquid container.

FIG. 6 is a sectional view of the liquid container 2 shown in FIG. 3, before the connective holes 5 and 6 are covered with the combinations of the compressed elastic member 18 and uncompressed elastic member 19. FIG. 7 is a sectional view of the liquid container 2 shown in FIG. 3, after only the compressed elastic members 18 have been housed in the recesses 17*a* of the elastic member storing portion 17. FIG. 8 is a sectional view of the liquid container 2 shown in FIG. 3, after the combination of the compressed elastic member 18 and uncompressed elastic member 19 has been housed in the recesses 17*a* of the elastic member storing portion 17 to cover the connective holes 15 and 16.

Figure 9:
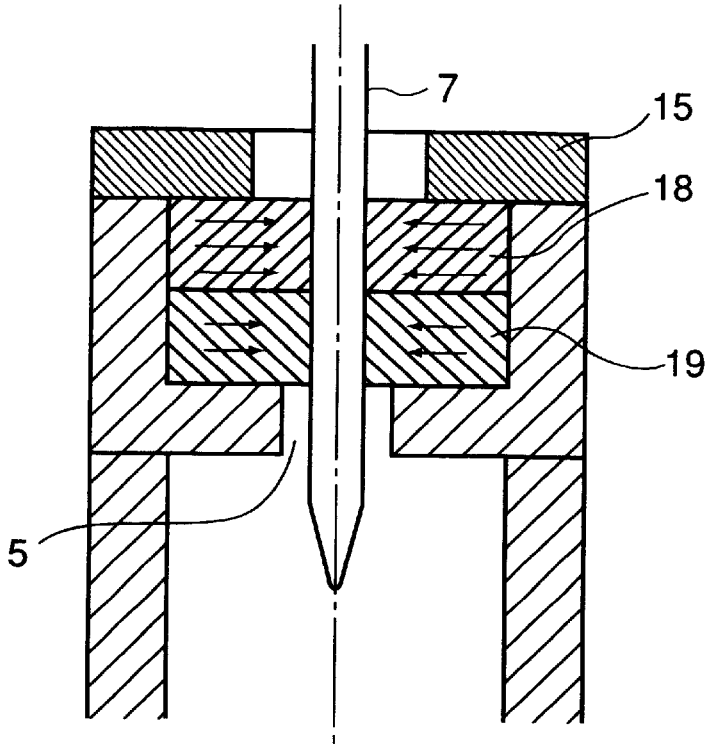
FIG. 9 is an enlarged sectional view of the connective portion of the liquid container, shown in FIG. 3, after a connective needle has been inserted into the liquid container.

FIG. 9 shows the state of the liquid container 2 after the insertion of the connective needle 7. FIGS. 6–9 only show how the elastic members are mounted to cover the connective hole 5, and how the elastic members are penetrated by the connective needle 7. However, the state of the liquid container 2 after the insertion of the connective needle 9 through the elastic members 18 and 19, how the elastic members are mounted to cover the connective hole 6, and how the elastic members 18 and 19 are penetrated by the connective needle 9, are the same as those shown in FIGS. 69.

Referring to FIGS. 4 and 5, the compressed elastic member 18 and uncompressed elastic member 19, as plugs for connective holes 5 and 6, respectively, which characterize this first embodiment, are approximately cylindrical. prior to their placement into the recesses of the elastic member storing portion 17, the diameter of the compressed elastic member 18 is greater than that of the uncompressed elastic member 19.

Next, referring to FIGS. 6–8, how the compressed elastic member 18 and uncompressed elastic member 19 shaped as shown in FIGS. 4 and 5 are placed into the recesses of the elastic member holding portion 17 to cover the connective holes 5 and 6 shown in FIGS. 2 and 3, will be described.

In FIG. 6, a referential code 17*a* designates a recess, in which the combination of the compressed elastic member 18 and uncompressed elastic member 19 is placed to cover the connective hole 5 which leads to the liquid chamber 16. The internal diameter d1 of the recess 17*a* is virtually the same the external diameter w2 of the uncompressed elastic member 19.

In comparison, the external diameter w1 of the compressed elastic member 18, prior to its placement in the recess 17*a*, is greater than the internal diameter d1 of the recess 17*a*. Before the placement of the compressed elastic member 18 and uncompressed elastic member 19 in the recesses 17*a*, no force is active in the compressed elastic member 18 and uncompressed elastic member 19.

Next, referring to FIG. 7, the uncompressed elastic member 19 is placed in the recess 17*a* of the elastic member holding portion 17. Since the internal diameter d1 of the recess 17*a* and the external diameter w2 of the uncompressed elastic member 19 are virtually identical, the uncompressed elastic member 19 is not compressed as it is placed in the recess 17*a*.

Next, the compressed elastic member 18 is placed in the recess 17*a* of the elastic member holding member 17. Unlike the uncompressed elastic member 19, the external diameter w1 of the compressed elastic member 18 prior to its placement in the recess 17*a* (contoured by a double-dot chain line in FIG. 7) is greater than the internal diameter d1 of the recess 17*a*.

Thus, without some modifications, the compressed elastic member 18 cannot be placed in the recess 17*a*. Therefore, the compressed elastic member 18 is placed in the recess 17*a* after it is compressed in the radius direction (direction indicated by an arrow mark A in FIG. 7) until its external diameter d1 is reduced to a diameter w1 (contoured by a solid line in FIG. 7), which is the same as, or slightly smaller than, the internal diameter d1 of the recess 17*a*.

Then, in order to prevent the compressed elastic member 18 and uncompressed elastic member 19 from becoming dislodged from the recess 17*a*, the retaining member 15 is attached to the elastic member holding member 17 as shown in FIG. 8. In this state, the resiliency of the compressed elastic member 18 generates such force that acts in the direction to expands the compressed elastic member 18 in the radius direction of the compressed elastic member 18 (direction indicated by an arrow A in FIG. 8). This force is confined by the wall of the recess 17*a*. As a result, reactive force acts toward the center of the compressed elastic member 18 as indicated by an arrow mark B in FIG. 8.

Figure 10:
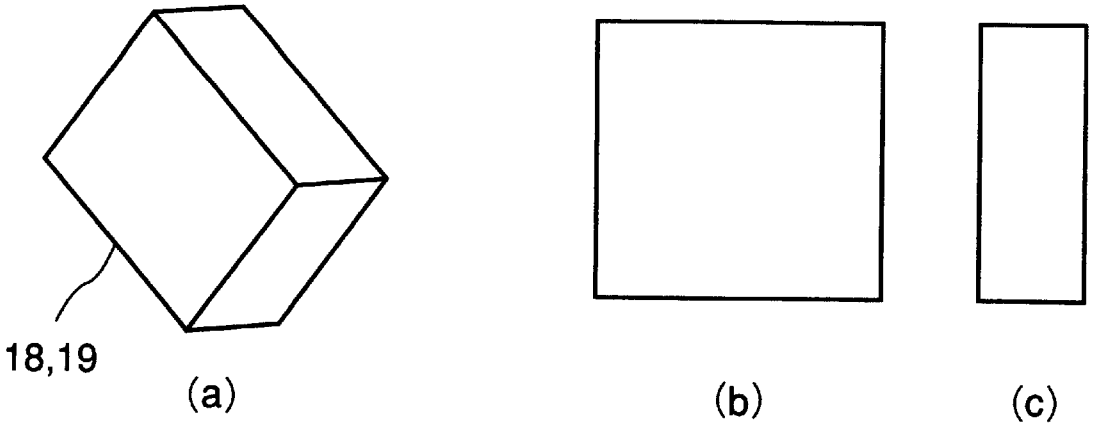
FIG. 10 shows a modified shape for the portion of the elastic member which is placed, in the compressed state, in the recess of the elastic member holding member of the liquid container, and also for the portion of the elastic member which is placed, in the virtually uncompressed state, in the recess of the elastic member holding member o the liquid container.

In consideration of the fact that giving the compressed elastic member 18 and 19 a cylindrical external shape (making cylindrical the interfaces between the peripheral surfaces of the elastic members and the side wall of the recess 17*a*) makes it easier for the compressive force to concentrate to the centers of the elastic members 18 and 19, the most desirable configuration for the elastic members 18 and 19 is a cylindrical one as shown in FIGS. 4 and 5. However, as long as a predetermined amount of compressive force is generated in the elastic members 18 and 19, the elastic members 18 and 19 do not need to be cylindrical; for example, they may be in the form of a square pillar, as shown in FIG. 10.

When the uncompressed elastic member 19 is in the state shown in FIG. 8, no compressive force is active in the uncompressed elastic member 19.

In comparison, when the compressed elastic member 18 is in the position shown in FIG. 8, the compressed elastic member 18 remains in the compressed state whether the connective needle is in the compressed elastic member 18 or not.

FIG. 9 shows the state of the liquid container 2 after the penetration of the connective needle 7 through the compressed elastic member 18 and uncompressed elastic member 19.

Compressive force is active in the compressed elastic member 18, as shown in FIG. 8, even before its penetration by the connective needle 7.

Therefore, as the connective needle 7 is put through the compressed elastic member 18, the compressive force within the compressed elastic member 18 is increased by an amount proportional to the volume of the portion of the connective needle 7 within the compressed elastic member 18.

In comparison, as the connective needle 7 is put through the uncompressed elastic member 19, the uncompressed elastic member 19, the external diameter of which is virtually the same as the diameter d1 of the recess 17*a*, expands in the radius direction of the recess 17*a*, being therefore subjected to the reactive force from the wall of the recess 17*a*. In other words, compressive force is active in the uncompressed elastic member 19 only when the connective needle 7 is in the uncompressed elastic member 19, and the amount of this compressive force in the uncompressed elastic member 19 is proportional to the volume of the portion of the connective needle 7 in the uncompressed elastic member 19. As is evident from the above description, the amount of the compressive force generated in the uncompressed elastic member 19 is smaller than that in the compressed elastic member 18. The compressive stress is present in the uncompressed elastic member 19 only when the connective needle 7 is in the uncompressed elastic member 19.

Therefore, during the period from when the liquid container 2 is manufactured to when the liquid container 2 is discarded, the cumulative length of the time in which the compression pressure is present in the uncompressed elastic member 19 is shorter than the cumulative length of time in which the compression pressure is present in the compressed elastic member 18.

Generally speaking, the greater the amount of the compressive pressure to which an elastic substance is subjected, and the longer the time an elastic substance is subjected to compressive pressure, the greater the amount of creep (degree of the gradual and permanent deformation of a body produced by a continued application of stress; degree of permanent deformation). In the case of the structure of the liquid container 2 in this embodiment of the present invention, the amount of the permanent compression deformation of the uncompressed elastic member 19 is smaller than that of the compressed elastic member 18. If the compressed elastic member 18 and uncompressed elastic member 19 are left undisturbed for a long time, with connective needle 7 penetrating them, creep occurs to both members 18 and 19. However, the amount of the creep which occurs to the uncompressed elastic member 19 is extremely small being virtually nil. In other words, it is assured that even after the uncompressed elastic member 19 is left undisturbed for a long time with the needle 7 left in the uncompressed elastic member 19, as soon as the needle 7 is pulled out of the uncompressed elastic member 19, the uncompressed elastic member 19 regains its original configuration; in other words, it reclaims the space which the needle 7 had been occupying in the uncompressed elastic member 19, preventing ink from dripping from the connective hole 5.

The effectiveness of the present invention is not affected by whether or not the ink jet head 3 and liquid container 2 are disposed apart from each other, or whether or not there is a space between the compressed elastic member 18 and uncompressed elastic member 19. However, when there is a space between the compressed elastic member 18 and uncompressed elastic member 19, the air within the space expands or contracts in response to the changes in ambience. This expansion or contraction of the air within the space affects the internal pressure of the compressed elastic member 18 and uncompressed elastic member 19. Thus, it is desired that there is no space between the compressed elastic member 18 and uncompressed elastic member 19 as in this embodiment.

Further, the effectiveness of the present invention is not affected by the number of the compressed elastic member 18 or uncompressed elastic member 19, the position of the compressed elastic member 18 or uncompressed elastic member 19 relative to the opening of the retaining member 1S, the order in which the compressed elastic member 18 and uncompressed elastic member 19 are placed with respect to the opening of the retaining member 15, or how the compressed elastic member 18 and uncompressed elastic member 19 are combined. However, for the effectiveness of the present invention, it is preferable that the uncompressed elastic member 19 is disposed on the side from which the needle 7 comes out first, that is, on the liquid holding portion side. With this structural arrangement, the reversion of the uncompressed elastic member 19 begins in the early stage of the removal of the liquid container 2, and ends before the connective needle 7 will have completely come out of the compressed elastic member 18.

The changes shown in FIG. 9, which occur to the elastic members 18 and 19 as the connective needle 7 is put through the elastic members 18 and 19, are the same as those which occur to the elastic members 18 and 19 as the connective needle 9 is put through the elastic members 18 and 19.

(Embodiment 2)

Next, referring to FIGS. 11–17, the second embodiment of the present invention will be described. The structural components in this embodiment, which are identical to those shown in FIGS. 1–3, are given the same referential codes as those given to the corresponding structural components in FIGS. 1–3, so that a part of the description of the first embodiment can be used as the description of some of the structural components in this embodiment.

Figure 11:
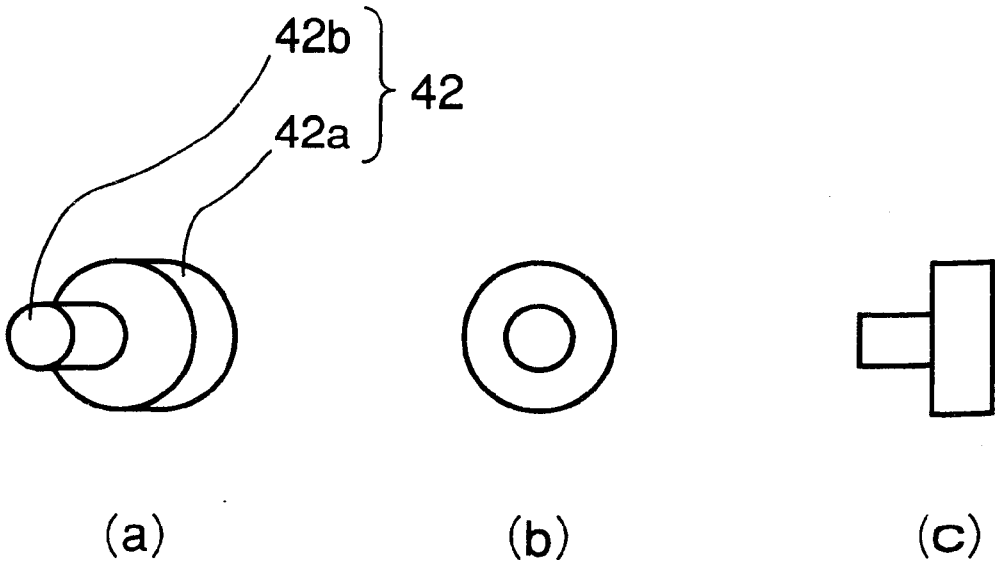
FIG. 11 is a drawing for describing the elastic member in the second embodiment of the present invention, different in shape from the one in the first embodiment, which is placed at the connective hole of the liquid container shown in FIG. 1: (*a*) is an external perspective view; (*b*) is a plan view; and (*c*) is a side view.

FIG. 11 is a schematic drawing for describing the configuration of the elastic member placed in the recess of the elastic member holding member 17 of the liquid container: FIG. 11(*a*) is an external perspective view of the elastic member; FIG. 11(*b*), a plan view of the elastic member; and FIG. 11(*c*) is a side view of the elastic member.

Figure 12:
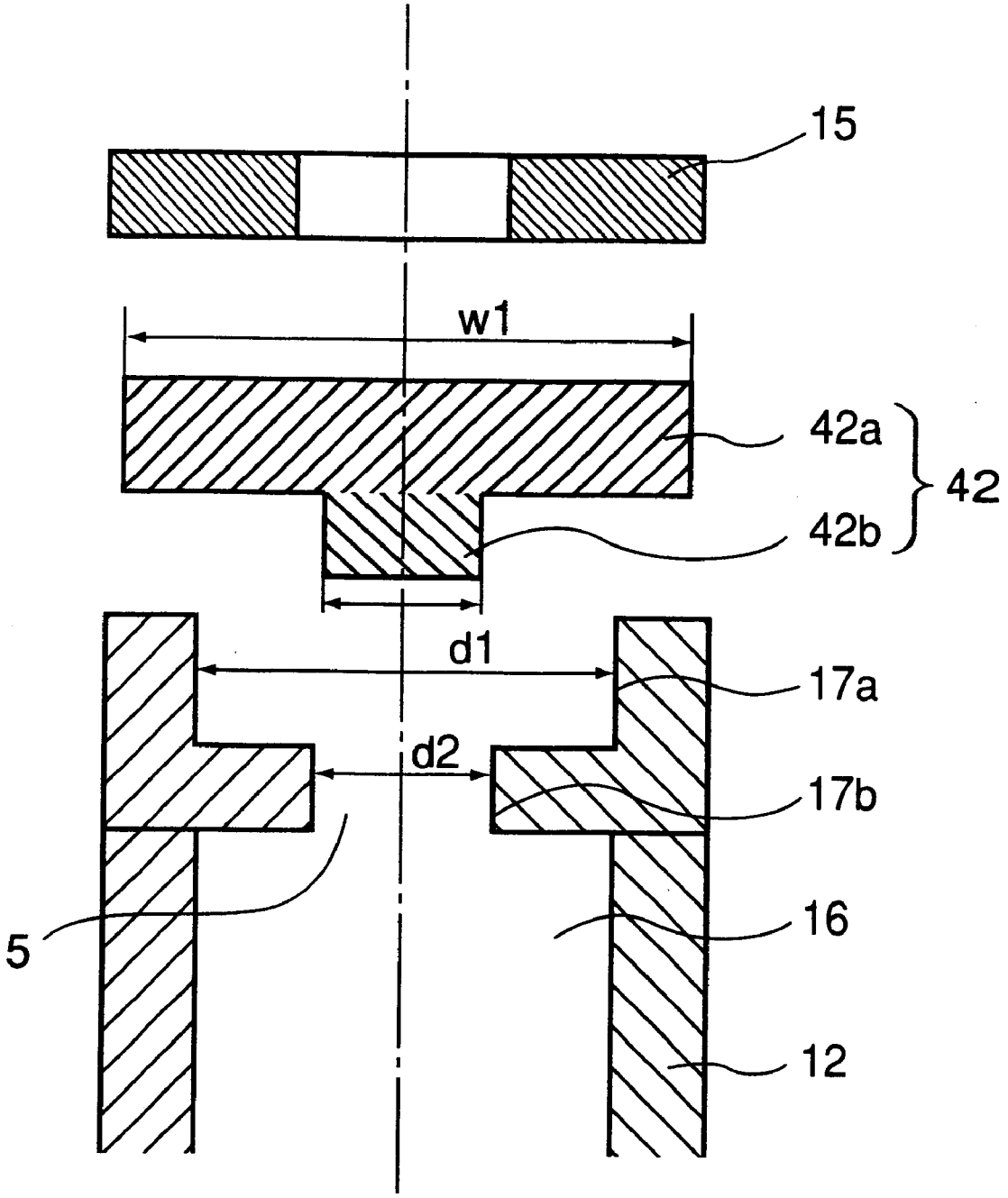
FIG. 12 is a drawing for showing the state of the elastic member shown in FIG. 11, prior to its placement in the recess of the elastic member holding member of the liquid container.
Figure 13:
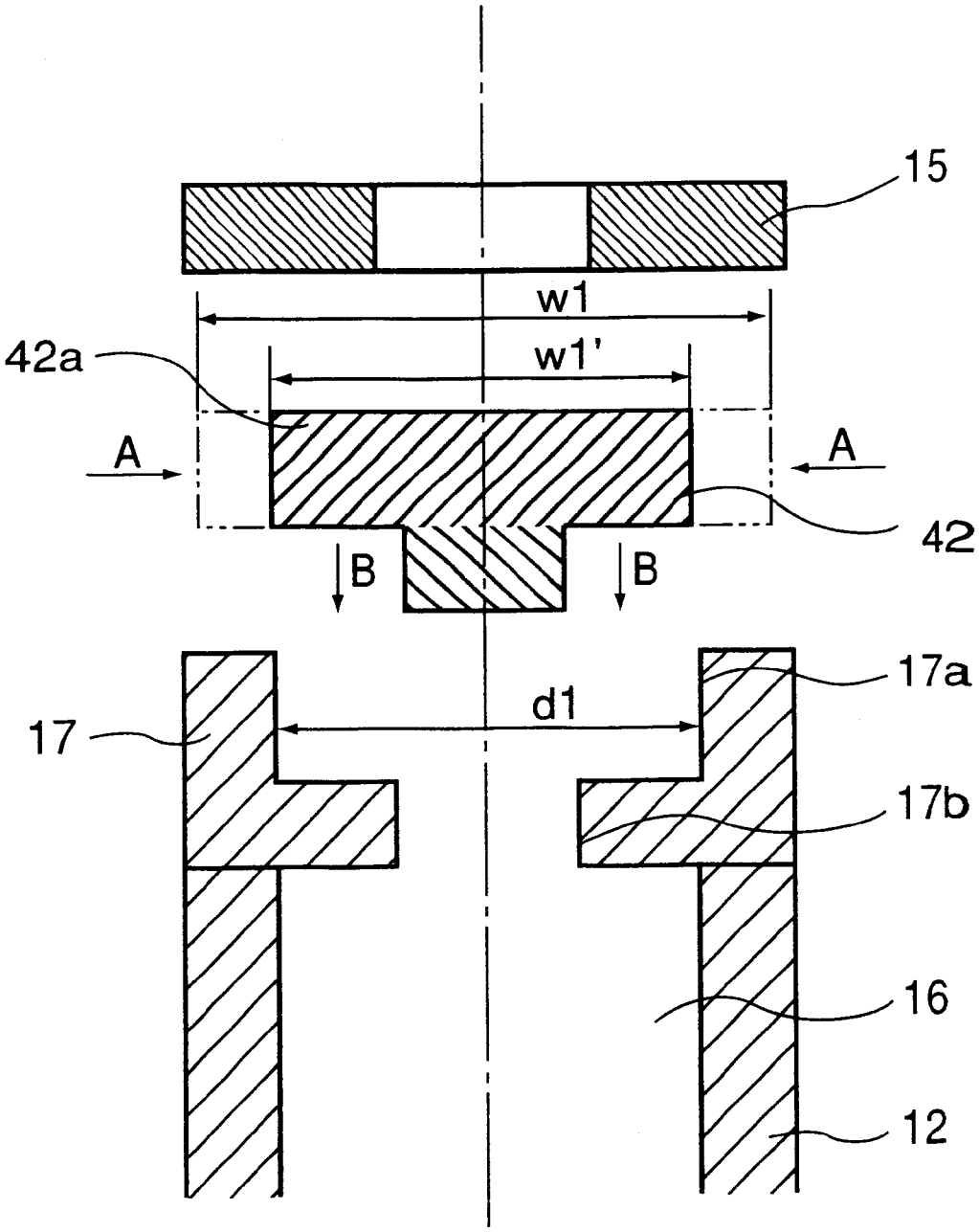
FIG. 13 is a drawing for showing the state of the elastic member shown in FIG. 11, after the elastic member is compressed toward its axial line in order to place it in the recess of the elastic member holding member of the liquid container.
Figure 14:
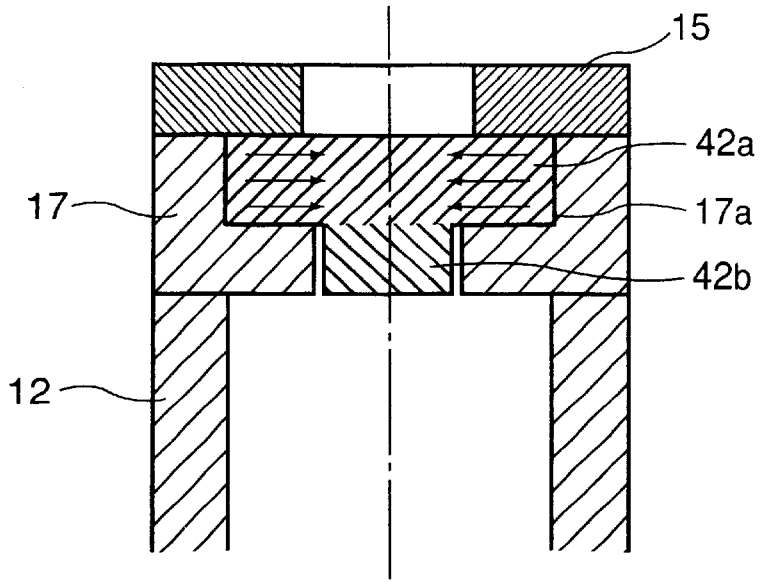
FIG. 14 is a drawing for showing the state of the elastic member shown in FIG. 11, after its placement in the recess.

FIGS. 12–14 show the various stages through which the elastic member 40 shown in FIG. 11 is placed in the recess 17*a* of the elastic member holding member 17 of the liquid container, and the retaining member 15 is fixed to the elastic member holding member 17. FIG. 12 shows the elastic member 42 before its placement in the recess 17*a*, and FIG. 13 shows the elastic member 42 which has been compressed toward its center in order to place it in the recess 17*a* of the elastic member holding member 17. FIG. 14 shows the elastic member 42 after the completion of its placement.

Figure 15:
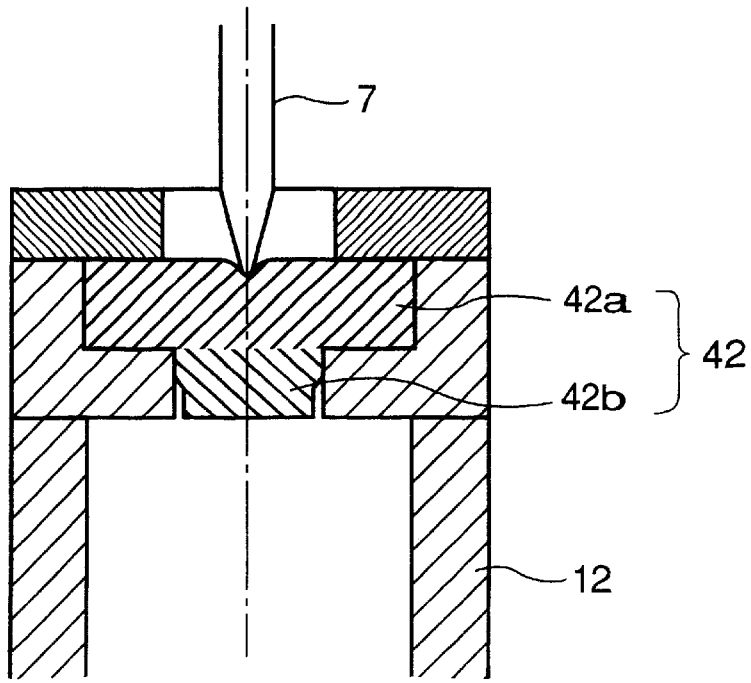
FIG. 15 is a drawing for showing the state of the elastic member in the liquid container, when a connective needle begins to be inserted into the elastic member.
Figure 16:
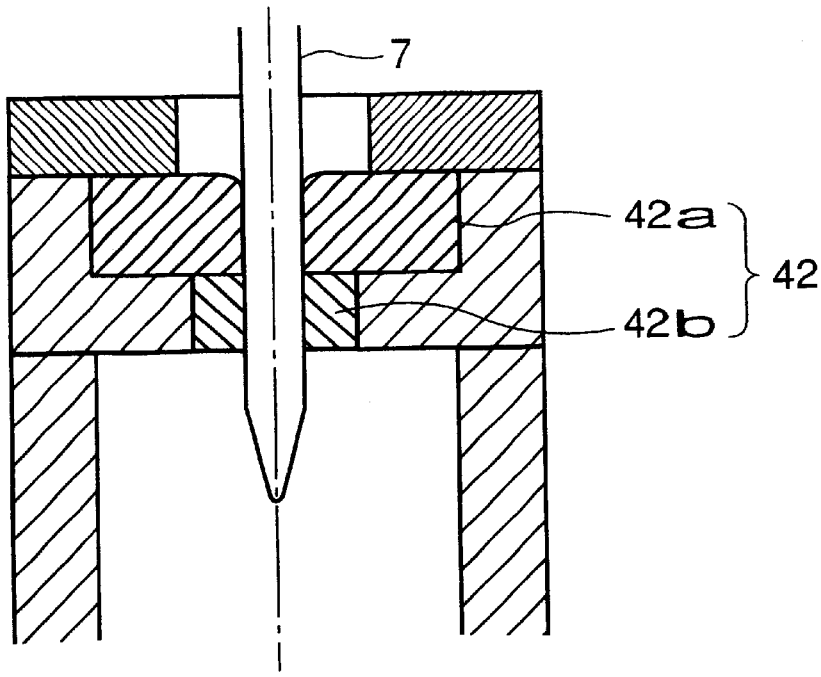
FIG. 16 is a drawing for showing the state of the elastic member in the liquid container, after the completion of the insertion of the connective needle into the liquid container through the elastic member.
Figure 17:
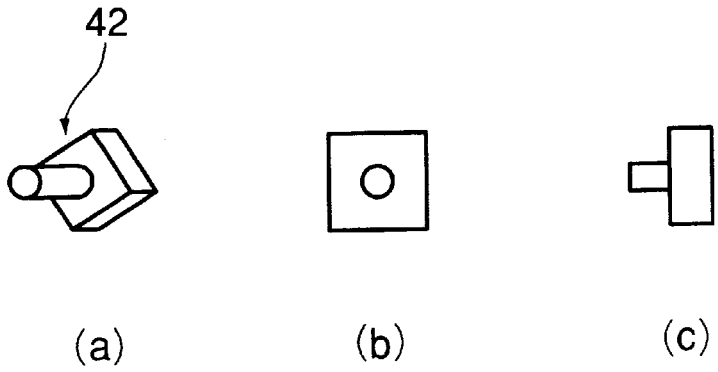
FIG. 17 is a drawing for showing a modified version of the elastic member shown in FIG. 11.

FIG. 15 shows the state of elastic member 42 when the connective needle begins to be inserted into the elastic member 42, and FIG. 16 shows the state of the elastic member 42 when the insertion of the connective needle 7 through the elastic member 42 has been completed.

In FIGS. 11–17, the placement of the elastic member 42 and the insertion of the connective needle are depicted with reference to the connective hole 5. The placement of the elastic member 42 in a manner to plug the connective hole 6, and the insertion of the connective needle through the elastic member 42 placed in a manner to plug the connective hole 6, are as shown in FIGS. 11–17 with reference to the connective hole 5.

Referring to FIG. 11, the elastic member 42 in this embodiment essentially comprises two portions: cylindrical main portion 42*a* and smaller cylindrical portion 42*b* smaller in diameter than the cylindrical main portion 42*a*. The smaller cylindrical portion 42*b* projects from the center of one of the end surfaces of the cylindrical main portion 42*a*.

FIG. 12 shows the state of the elastic member 42 before its placement in the recess 17*a* of the elastic member holding member 17, in which the elastic member 42 is to be placed in a manner to plug the connective hole 5 which leads to the liquid chamber 16. The external diameter w1 of the cylindrical main portion 42*a* is greater than the internal diameter d1 of the recess 17*a*, and the external diameter w2 of the smaller cylindrical portion 42*b* is smaller than the internal diameter d2 of the connective hole 5.

Referring to FIG. 13, which shows one of the stages through which the elastic member 42 is placed in the recess 17*a* of the liquid container 2, the external diameter w1 of the cylindrical main portion 42*a* of the elastic member 42 is greater than the internal diameter d1 of the recess 17*a*. Therefore, the elastic member 42 cannot be properly placed in the recess 17*a* unless the elastic member 42 is modified in a certain way.

Thus, pressure is applied to the cylindrical main portion 42*a* in the direction indicated by an arrow mark A in FIG. 13 so that the elastic member 42, the shape of which is contoured by a double-dot chain line in FIG. 13 is compressed into the shape contoured by the solid line in FIG. 13; in other words, the external diameter w1 of the cylindrical main portion 42*a* becomes the same as, or smaller than, the internal diameter d1 of the recess 17*a* (external diameter w1' of the cylindrical main portion 42*a* after its compression). Then, the elastic member 42 is placed in the recess 17*a* in the direction indicated by an arrow mark B in the drawing, while being kept in the above described compressed state.

Thereafter, the retaining member 15 is fixed to the elastic member holding portion 17, realizing the liquid container 2 shown in FIG. 14. In this state, the resiliency of the cylindrical main portion 42*a* acts in the direction to expand the cylindrical main portion 42*a* in the radius direction of the cylindrical main portion 42*a* (direction indicated by an arrow A in FIG. 8), applying pressure upon the wall of the recess 17*a*.

This pressure is confined by the wall of the recess 17*a*. As a result, reactive force from this pressure acts toward the center of the cylindrical main portion 42*a* as indicated by an arrow mark in FIG. 14.

Figure 47:
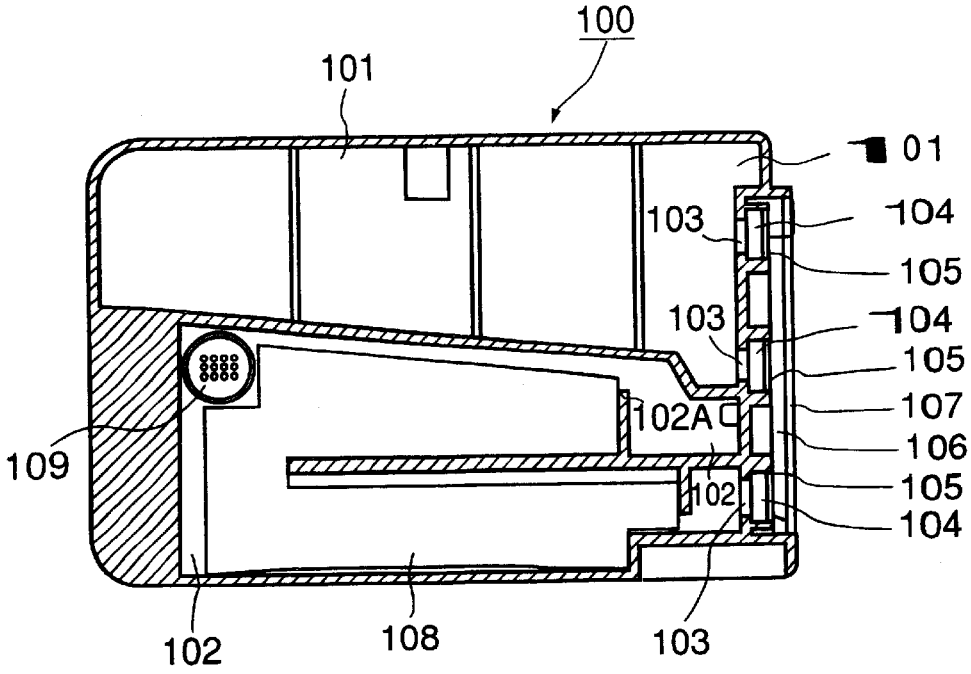
FIG. 47 is a sectional view of an example of a replaceable liquid container in accordance with the prior arts.
Figure 48:
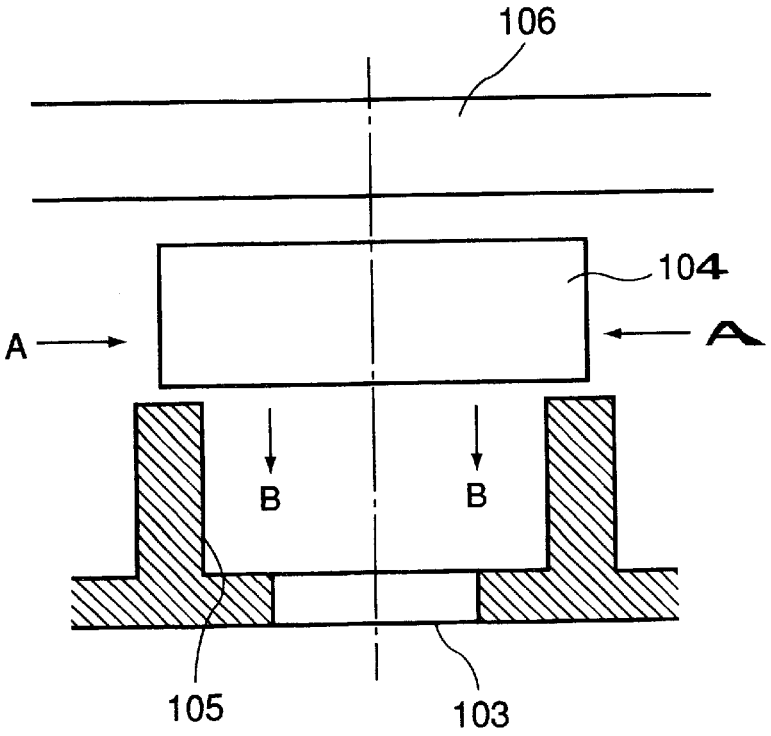
FIG. 48 is a drawing for showing how a rubber plug for the ink passage portion of the ink container, which connects the inside and outside of the ink container, is mounted.

In consideration of the fact that giving the main portion 42*a* a cylindrical external shape (making cylindrical the interfaces between the peripheral surfaces of the elastic members and the side wall of the recess 17*a*) makes it easier for the reactive force from the compression pressure to concentrate to the centers of the main portion 42*a*, the most desirable configuration for the main portion 42*a* is a cylindrical one as shown in FIGS. 11. However, as long as a predetermined amount of compression pressure is generated in the main portion 42*a*, the main portion 42*a* does not need to be cylindrical; for example, it may be in the form of a square pillar, as shown n FIG. 47.

FIG. 15 shows the elastic deformation of the elastic member 42 at the beginning of the insertion of the connective needle 7. As a relatively thick connective needle 7 begins to be inserted into the elastic member 42, the elastic member 42 deforms as shown in FIG. 15. if it were not for the small cylindrical portion 42*b*, the elastic member 42 would deform into the connective hole 5 in such a manner that the portion of the elastic member around the needle, on the needle entry side of the sealing member, is pulled into the elastic member, whereas the portion of the elastic member around the needle, on the side opposite to the needle entry side, conically peels away from the needle. In this embodiment, however, the connective hole 5 is occupied with the small cylindrical portion 42*b*, being disposed on the side toward which the connective needle 7 is inserted, that is, being in the connective hole 5 into which the elastic member 42 would be otherwise dislodged. This presence of the small cylindrical portion 42*b* in the connective hole 5, and the rigidity of the small cylindrical portion 42*b*, makes it less likely for the elastic member 42 in this embodiment to be dislodged into the connective hole 5, compared to an elastic member without the small cylindrical portion 42*b*. Therefore, the elastic member 42 is prevented from becoming permanently indented (FIG. 49(*b*)). Thus, the connective needle 7 can be desirably put through the elastic member 42 as shown in FIG. 16; it is possible to prevent the size of the contact area between the connective needle 7 and elastic member 42 from being reduced by the conical peeling of the elastic member 42, and the formation of the permanent indentation, in the direction in which the connective needle is inserted.

Further, the provision of the small cylindrical portion 42*b* increases the size of the contact area between the connective needle 7 and the elastic member 42, increasing the effectiveness of the elastic member 42 in sealing between itself and connective needle 7. In other words, the sealing performance of the elastic member 42 is less likely to be affected by the changes in the internal and/or external pressure of the liquid container.

In other words, the liquid container, which can be mounted or dismounted without allowing the liquid therein to leak, can be realized by securing the sufficient amount of contact surface between the elastic member 42 and connective needle 7 by preventing the phenomenon that the elastic member is deformed in such a manner that the portion of the surface of the elastic member surrounding the entry point of the connective needle is swallowed into the elastic member itself, and that the internal portion of the elastic member, the position of which coincides with the passage of the connective needle, conically peels away from the connective needle, on the side opposite to the entry point of the connective needle. As described before, the prevention of the above description is the second object of the present invention.

The effects of the second embodiment, which are similar to those of the first embodiment, are as follows. In other words, even when the connective needle 7 is pulled out of the liquid container after it was left in the elastic member 42 for a long period of time, the connective hole 5 remains satisfactorily sealed. When the elastic member 42 is in the state shown in FIG. 14, the cylindrical main portion 42*a* is in the compressed state. In comparison, in the small cylindrical portion 42*b*, compression stress is present only when the connective needle 7 is in the small cylindrical portion 42*b*. Therefore, referring to FIG. 16, in the case of the cylindrical main portion 42*a* in which compression pressure is present even before the insertion of the connective needle 7, as the connective needle 7 is inserted into the cylindrical main portion 42*a*, the compression pressure in the cylindrical main portion 42*a* is increased by the amount proportional to the volume of the portion of the connective needle 7 in the cylindrical main portion 42*a*.

In comparison, in the case of the smaller cylindrical portion 42*b*, the diameter of which is virtually the same as the internal diameter d2 of the recess 17*b*, as the connective needle 7 is inserted into the smaller cylindrical portion 42*b*, the connective needle 7 generates such force that acts in the direction to expand the smaller cylindrical portion 42*b* in the radius direction of the recess 17*b*. However, the smaller cylindrical portion 42*b* is confined in the recess 17*a*.

Therefore, it is prevented by the wall of the recess 17*a* from expanding in the radius direction of the recess 17*a*. As a result, it is compressed, generating compression pressure therein. In other words, compression pressure is present in the smaller cylindrical portion 42*b* only after the insertion of the connective needle 7 into the smaller cylindrical portion 42*b*, and the amount of this compression pressure is approximately proportional to the volume of the portion of the connective needle 7 in the smaller cylindrical portion 42*b*.

Thus, effects similar to those obtained by the first embodiment are also obtained by the second embodiment. The deterioration of the elasticity of the smaller cylindrical portion 42*b*, which occurs with elapse of time, is smaller than that of the cylindrical main portion 42*a*. This is for the following reason. If the elastic member 42 is left undisturbed for a long period of time, with the connective needle 7 penetrating it, creep occurs to the elastic member 42; in other words, the elastic member 42 fails to completely revert to its original shape and volume after the removal of the connective needle 7. This phenomenon, or creep, is less likely to occur to the smaller cylindrical portion 42*b*. Therefore, even when the connective needle 7 is pulled out of the elastic member 42 after being left therein for a long period of time, the connective hole 5 remains properly sealed by the cylindrical portion 42*b*.

(Embodiment 3)

Next, referring to FIGS. 18–25, the third embodiment of the present invention will be described. Any structural component in this embodiment which is the same as one of the structural components in the first embodiment shown in FIGS. 1–3, will be given the same referential code as the one given to the same component, so that the description of the same component in the first embodiment can be used as a reference.

Figure 18:
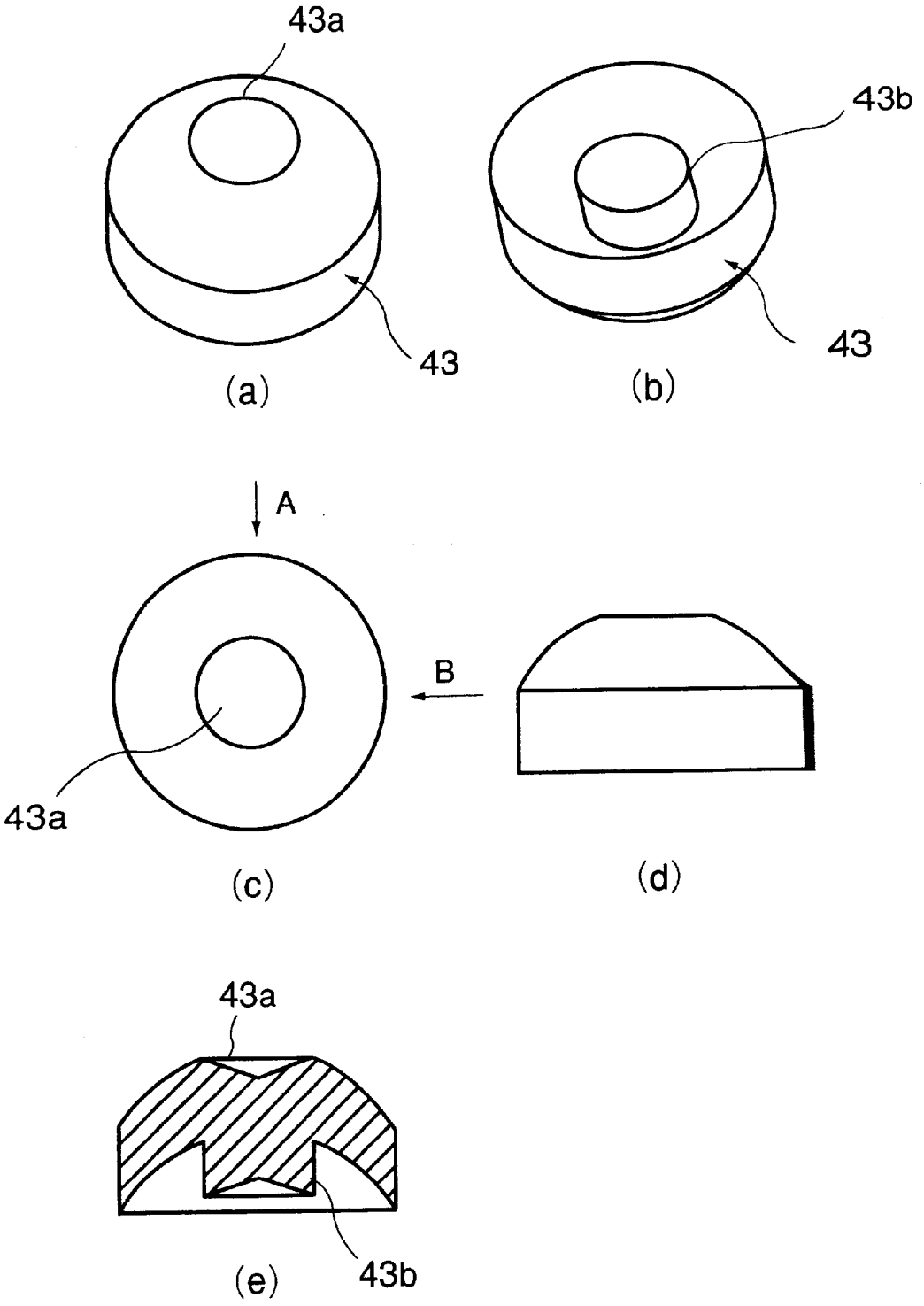
FIG. 18 is a drawing for showing the configuration of the elastic member used for the connective hole of the liquid container in the third embodiment of the present invention, shown in FIG. 1: (*a*) is a perspective view as seen from diagonally above the side from which the connective needle is inserted; (*b*) is a perspective view as seen from diagonally below the side opposite to the side from which the connective needle is inserted; (*c*) is a plan view as seen directly above the side from which the connective needle is inserted; (*d*) is a side view; and (*e*) is a sectional view as seen from the direction A, at a plane inclusive of the axial line of the elastic member.

FIG. 18 is a drawing for describing the configuration of the elastic member for the connective hole of the liquid container shown in FIG. 1: (*a*) is a perspective view as seen from diagonally above the side from which the connective needle is inserted; (*b*) is a perspective view as seen from diagonally above the side opposite 2 to the side from which the connective needle is inserted; (*c*) is a plan view as seen from the side from which the connective needle is inserted; (*d*) is a side view; and (*e*) is a sectional view as Seen from the direction A in (*c*).

As shown in FIGS. 18(*a*)–18(*b*), the elastic member 43 in this embodiment is approximately semispherical (dome-shaped), bulging toward the direction from which the connective needle is inserted. The top portion of the elastic member 43, that is, the portion equivalent to the top of a dome, is conically recessed forming a conically recessed portion 43*a*. On the other hand, the concaved bottom side, or the side opposite to the side from which the connective needle is inserted, is provided with a cylindrical portion 43*b*, which is located at the bottom, or the center, of the concaved surface.

Figure 19:
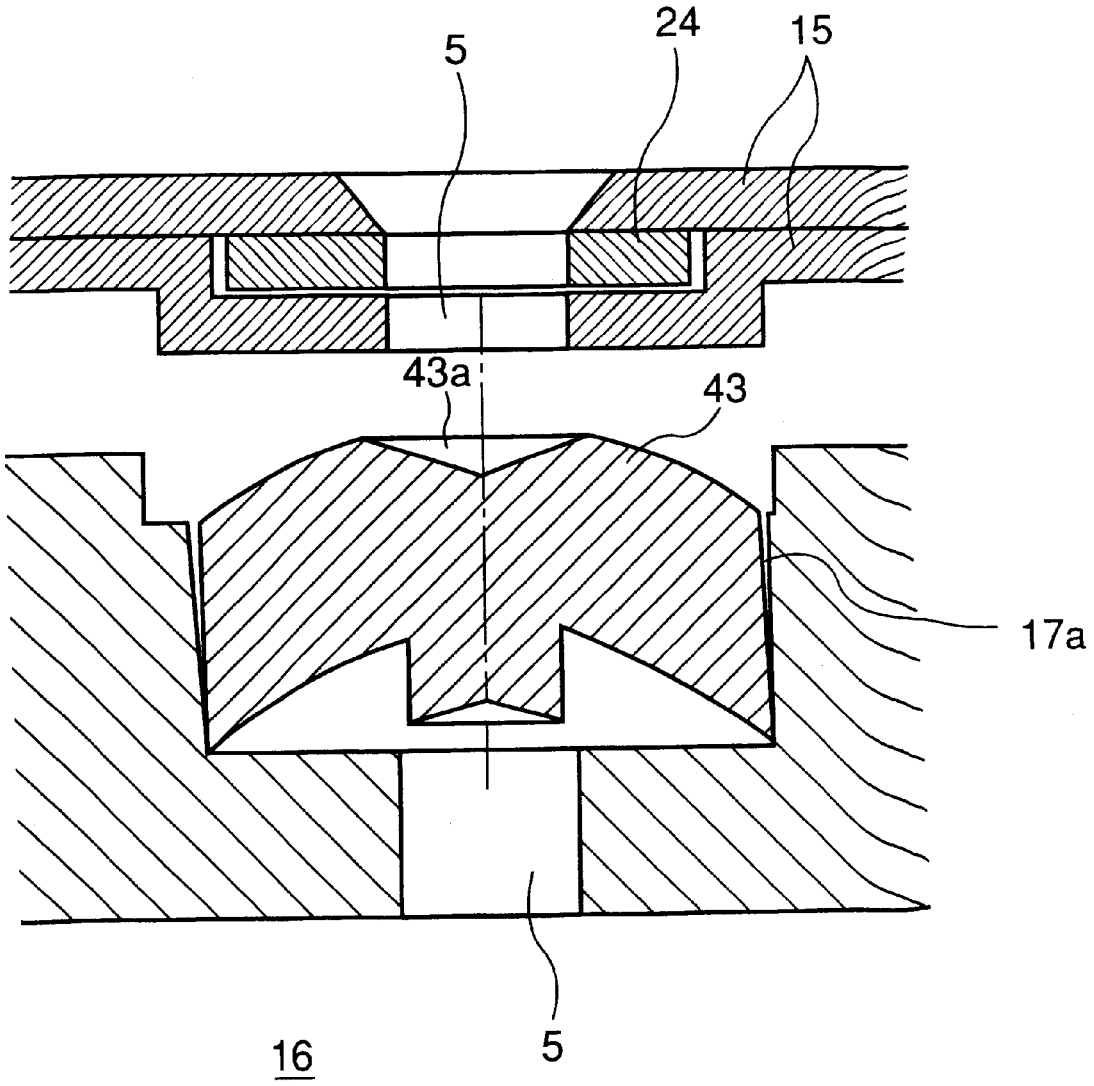
FIG. 19 is a drawing for showing the state of the elastic member shaped as shown in FIG. 18, after its placement in the recess of the connective hole of the liquid container shown in FIGS. 2 and 3.
Figure 20:
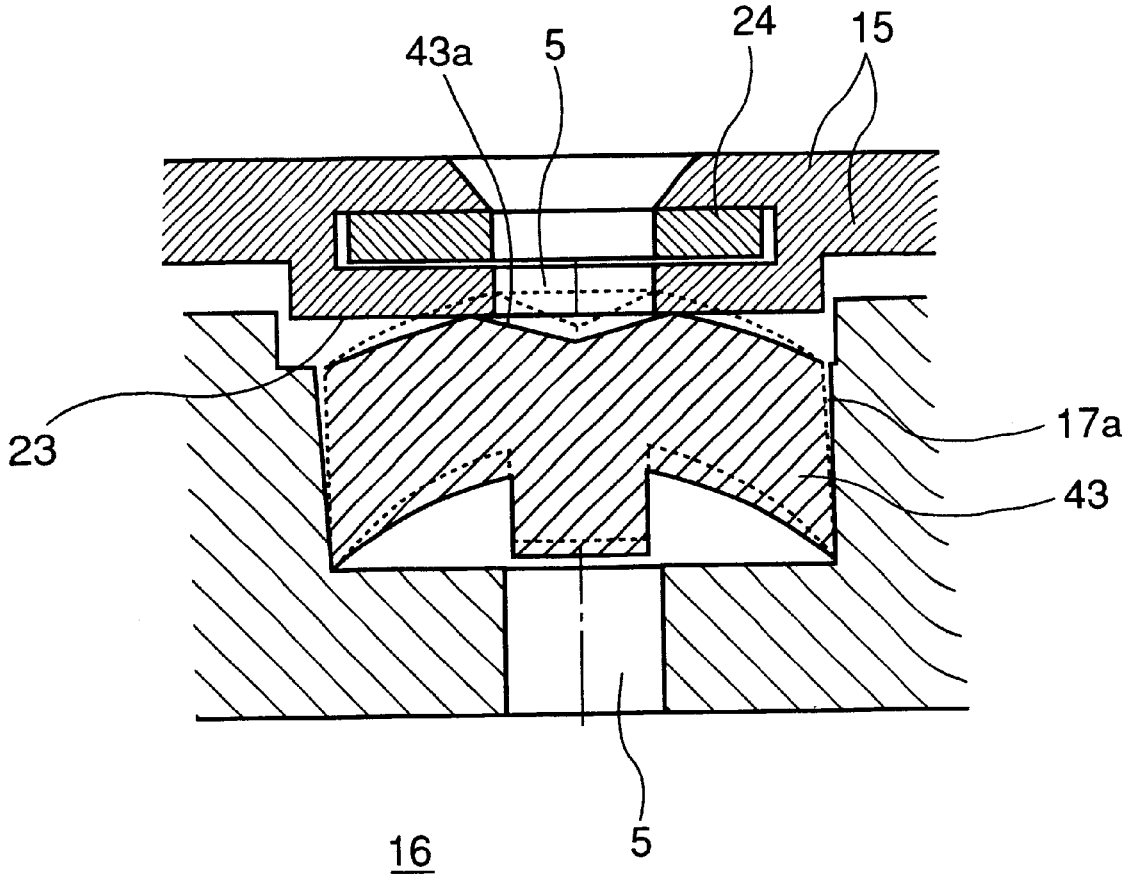
FIG. 20 is a drawing for showing the state of the elastic member shaped as shown in FIG. 18, while the elastic member is pressed into the recess.
Figure 21:
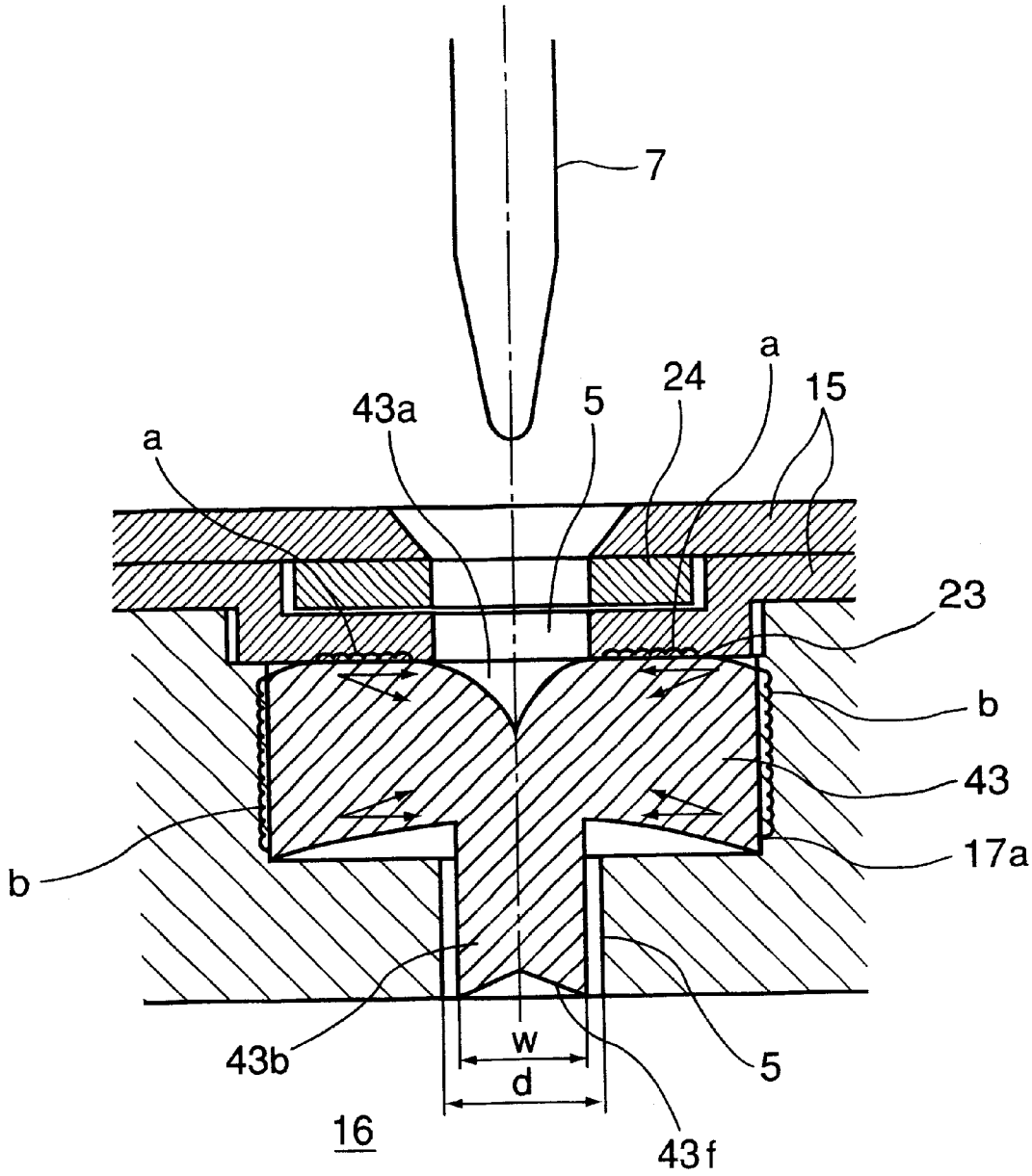
FIG. 21 is a drawing for showing the state of the elastic member shaped as shown in FIG. 18, after its placement in the recess of the connective hole of the liquid container shown in FIGS. 2 and 3.

FIGS. 19 and 20 show how the elastic member 43 shown in FIG. 18 is placed in the recess 17*a* of the elastic member holding portion 17 in a manner to plug the connective holes 5 and 6 of the liquid container shown in FIGS. 2 and 3, and how the retaining member 15 is attached to the elastic member holding portion 17 to keep the elastic member 43 in the recess 17*a*. FIG. 19 shows the state of the elastic member 43 after its placement in the recess 17*a* in a manner to cover the connective holes 5 and 6, and FIG. 20 shows the elastic member 43 which is being pressed down by the retaining member 15. FIG. 21 shows the state of the elastic member 43 after the completion of its placement in the recess 17*a*.

Although these drawings show only the connective hole 5 as the hole to be covered with the elastic member 43, the connective hole 6 also is covered with the elastic member 43 (different from the one covering the hole 5).

Referring to FIG. 19, the recess 17*a* is where the elastic member 43 is placed to plug the connective hole 5 leading to the liquid chamber 16. The internal diameter of the recess 17*a* is virtually the same as the external diameter of the elastic member 43. If the external diameter of the elastic member 43 is slightly smaller than the internal diameter of the recess 17*a*, it is easier to place the elastic member 43 in the recess 17*a*.

Even if the external diameter of the elastic member 43 is greater than the internal diameter of the recess 17*a*, this does not cause any problem (it is not difficult to place the elastic member 43 in the recess 17*a* unless the diameter of the elastic member 43 is disproportionately larger than the internal diameter of the recess 17*a*), since the shape of the elastic member 43 can be easily changed by the application of force. The elastic member 42 is a monolithic member, and in the form of a dome with a predetermined curvature.

Referring to FIG. 20, as the retaining member 15 is attached to the liquid container, the elastic member 43 is pressed down by the pressing portion 23 of the retaining member 15. The length of the ridge line of the budging side of the dome-shaped elastic member 43 is greater than the internal diameter of the recess 17*a*. Therefore, not only does the pressure applied to the elastic member 43 by the retaining member 15 act in the direction to press the elastic member 43 down, but also in the direction to spread the elastic member 43 in the radius direction of the recess 17*a*.

However, the elastic member 43 is confined in the recess 17*a*, being prevented from spreading in the radius direction, by the wall of the recess 17*a*.

As a result, pressure is generated in the elastic member 43 in the direction to concentrate to the center of the elastic member 43.

Figure 26:
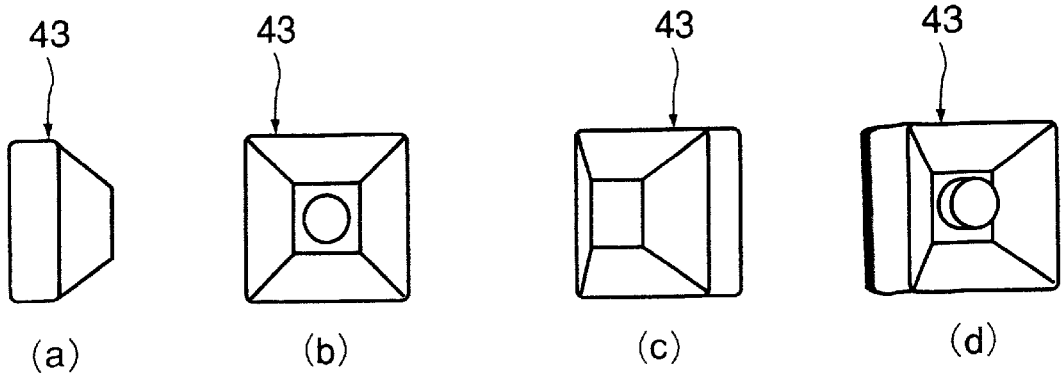
FIG. 26 is a drawing for showing a modified shape for the elastic member shown in FIG. 18.

As for the external configuration of the elastic member 43, from the standpoint of directing the internal pressure of the elastic member 43 toward its center, the cross section of the elastic member 43 perpendicular to its axial line is desired to be circular as shown in FIG. 18. However, it does not need to be circular as long as a predetermined amount of internal pressure can be concentrated to the center of the elastic member 43. for example, it may be square as shown in FIG. 26.

Next, referring to FIG. 21, after the completion of the placement of the elastic member 43 in the recess 17*a*, the compression pressure, which is generated in the direction to concentrate to the axial line of the elastic member 43 by the pressure from the pressing portion 23 of the retaining member 15 and the wall of the recess 17*a*, is present only in the very portion of the elastic member 43, which was dome-shaped prior to the placement of the elastic member 43 in the recess 17*a*. In comparison, there is no compression pressure in the cylindrical portion 43*b* of the elastic member 43, since the external diameter W of the cylindrical portion 43*b* is smaller than the internal diameter d of the connective hole 5.

Figure 22:
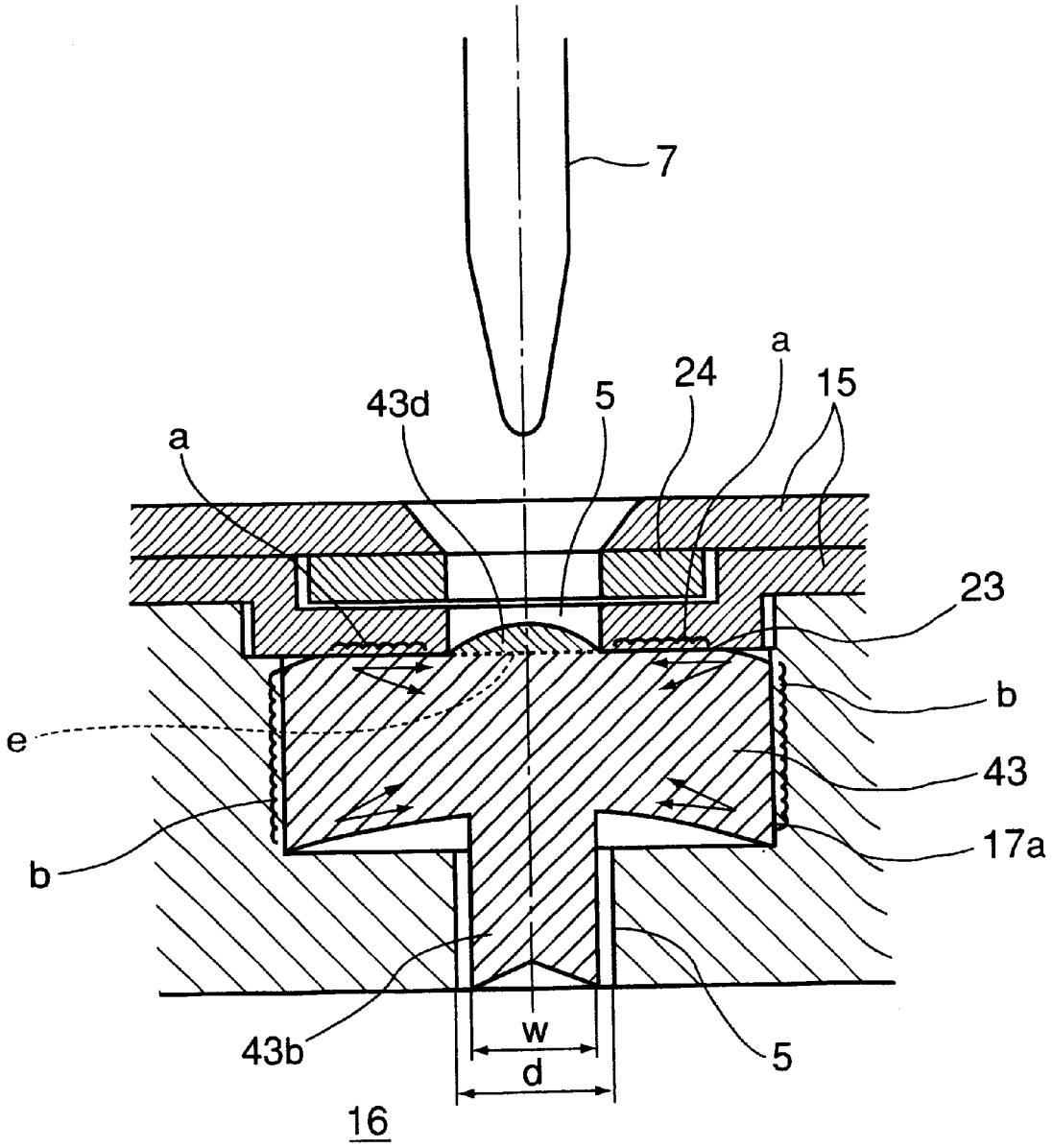
FIG. 22 is a drawing for showing the state of the elastic member (which is not provided with a conical recess) shaped as shown in FIG. 18, after its placement in the recess of the connective hole of the liquid container shown in FIGS. 2 and 3.

If the surface of the top portion of the elastic member 43, or the portion through which the connective needle 7 is put, is not conically recessed as shown in FIG. 20, in other words, if it is consistent with the curvature of the dome-shaped portion of the elastic member 43, it will bulge into the hole of the retaining member 15 as shown in FIG. 22, as it is pressed down by the retaining member 15, since the top portion of the elastic member 43 does not come into contact with the retaining member 15, being therefore not pressed down by the retaining member 15.

Referring to FIG. 22, if an attempt is made to insert the connective needle 7 into the elastic member 43 through the connective hole 5 when the elastic member 43 is in the state shown in FIG. 22, the portion 43*d* (hatched portion) of the elastic member 43, which has bulged into the hole of the retaining member 15, is not allowed to move in the radius direction. Therefore, the portion 43*d* of the elastic member 43 is pushed back into the portion of the elastic member 43 in the recess 17*a*, making it likely for this portion of the elastic member 43 to be conically indented following the movement of the connective needle 7 into the elastic member 43.

This is why the top portion of the dome-shaped elastic member 43, that is, the portion correspondent to the hole of the retaining member 15-1 is conically indented, eliminating the portion of the elastic member 43 which otherwise would be pushed into the portion of the elastic member 43 in the recess 17*a* by the connective needle 7.

With the provision of this structural arrangement, the elastic member 43 does not bulge in the form of a dome (portion 43*d*) into the hole of the retaining member 15 as shown in FIG. 22.

Instead, the top portion of the elastic member 43 becomes virtually flat or slightly indented as represented by a portion 43*a* in FIG. 21, as the retaining member 15 is pressed down onto the elastic member 43. Therefore, it does not occur that as the connective needle 7 is inserted into the elastic member 43, the portion of the elastic member 43 around the entry point of the connective needle into the elastic member 43 is conically pulled into the elastic member 43 by the connective needle 7.

Regarding the configuration of the top portion of the dome-shaped elastic member 43, as long as it does not cause the elastic member 43 to bulge into the hole of the retaining member 15 as shown in FIG. 22, it does not need to be conically indented, although the effectiveness of the elastic member 43 in this embodiment varies depending on the configuration. Further, the portion 43*d* bulging above the contact surface between the retaining member 15 and elastic member 43 may be simply cut off to make this portion of the elastic member 43 flat.

If the angle of the taper of the conically indented portion 43*a* of the elastic member 43 (inclination of the side wall) is made virtually the same as the angle a of the taper of the tip of the connective needle 7, there will be virtually no object which resists the tip of the connective needle 7 as the connective needle 7 is inserted into the conically indented portion 43*a* of the elastic member 43 through the connective hole 5 when the elastic member 43 is in the state shown in FIG. 21. Therefore, the connective needle 7 can be smoothly inserted.

Figure 24:
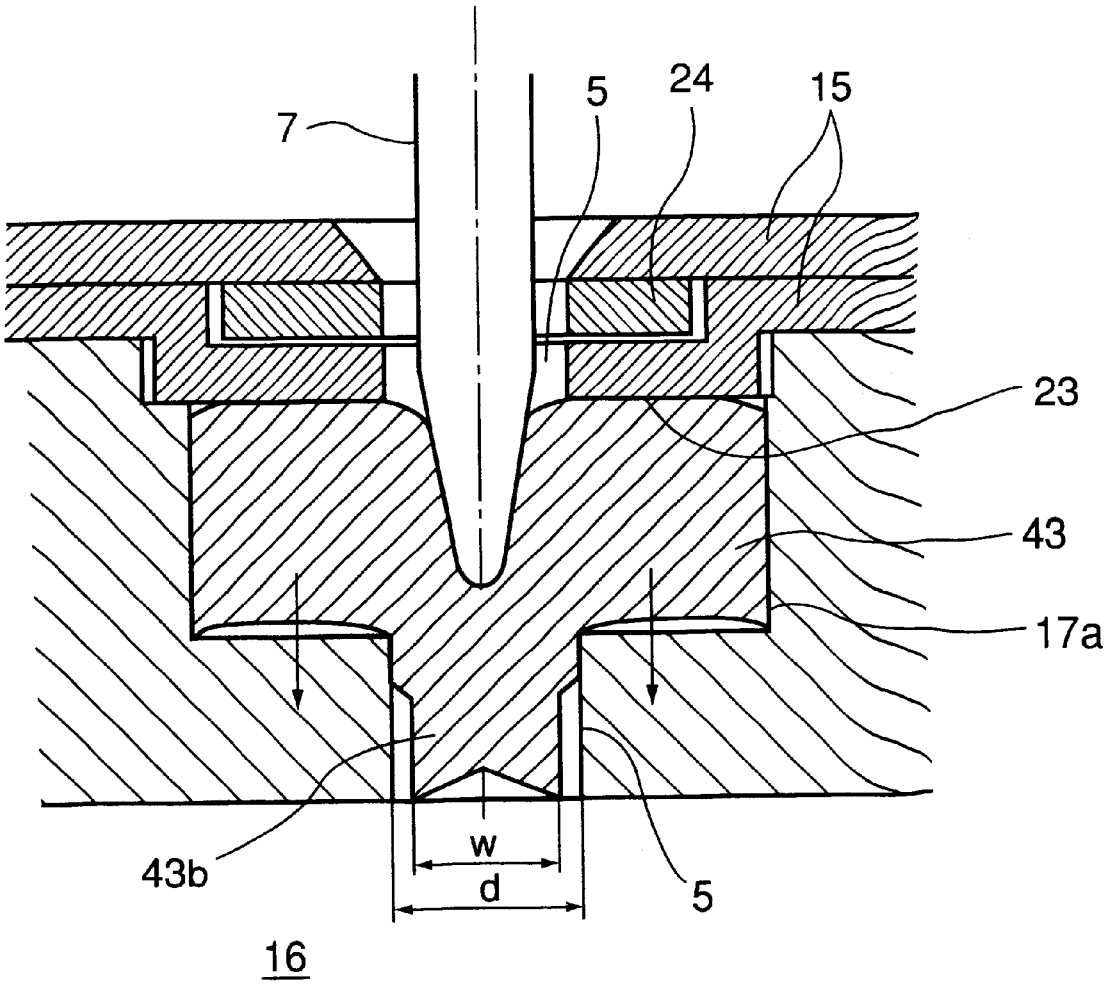
FIG. 24 is a drawing for showing the behavior (elastic deformation) of the elastic member shaped as shown in FIG. 18, while the connective needle is inserted into the elastic member in the recess of the elastic member holding member of the liquid container.

The portion 43*a* of the elastic member 43 through which the connective needle 7 is inserted is conically indented. Therefore, the force applied to the elastic member 43 by the connective needle 7 in the direction parallel to the axial direction of the elastic member 43 as the connective needle 7 is pushed into the elastic member 43 is diverted in the radius direction of the elastic member 43 by a substantially larger amount than it is diverted in the axial direction of the elastic member 43, making it less likely for the portion of the elastic member 43 around the connective needle 7 to be conically pulled into the elastic member 43 itself by the movement of the connective needle 7 into the elastic member 43. In other words, the provision of the conically indented portion 43*a* prevents the connective needle entry portion of the elastic member 43 from being pulled into the elastic member 43 itself. FIG. 24 shows the behavior (elastic deformation) of the elastic member 43 which occurs to the elastic member 43 during the insertion of the connective needle 7. As shown in FIG. 24, as an attempt is made to insert a relatively thick connective needle 7 into the elastic member 43, the elastic member 43 deforms.

However, the elastic member 43 is provided with the cylindrical portion 43*b*, the diameter W of which is smaller than the diameter of the connective hole 5, and which is located on the downstream side in terms of the direction in which the connective needle 7 is inserted. Further, the cylindrical portion 43*b* is confined in the connective hole 5, the diameter of which is smaller than the diameter d1 of the recess 17*a*.

Therefore, the portion of the elastic member 43 around the connective needle 7 is not likely to follow the connective needle 7 as the connective needle 7 is pushed through the elastic member 43.

Figure 49:
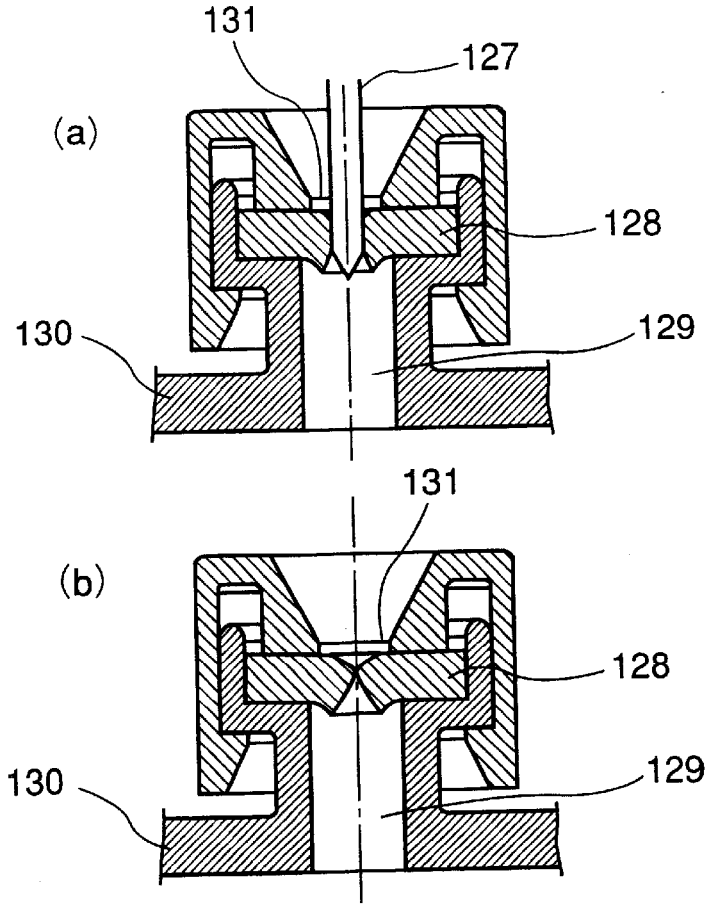
FIG. 49 is a drawing for describing the problem regarding the structural arrangement, shown in FIGS. 47 and 48, of the connective hole of the liquid container in accordance with the prior arts.
Figure 50:
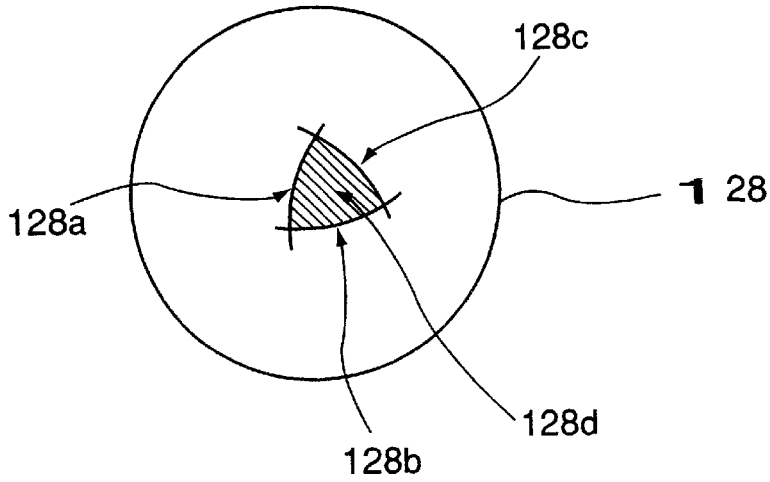
FIG. 50 is a drawing for describing also the problem regarding the structural arrangement, shown in FIGS. 47 and 48, of the connective hole of the liquid container in accordance with the prior arts.

Therefore, the portion of the elastic member 43 around the exit point of the connective needle 7 from the elastic member 43 is not likely be conically peels away from the connective needle 7 (FIG. 49(*b*)). In other words, according to this embodiment, the amount by which the contact area between the connective needle 7 and elastic member 43 is reduced by the occurrence of the conical peeling and conical indentation is much smaller compared to an elastic member in accordance with the prior arts.

The provision of the cylindrical portion increases the contact area between the connective needle 7 and elastic member 43, improving the elastic member 43 in its ability to prevent the liquid within the liquid container from being leaked by the changes in the internal or ambient pressure of the liquid container.

To sum up, according to this second embodiment of the present invention, the portion of the elastic member 43 around the connective needle entry point is prevented from being pulled into the elastic member 43 itself, and also, the hole created in the elastic member 43 by the connective needle 7 is prevented from conically widening, on the leading end side of the elastic member 43 in terms of the direction in which the connective needle 7 is inserted. Therefore, the contact area formed between the connective needle 7 and elastic member 43 as the connective needle 7 is inserted into the elastic member 43 is substantially larger than that formed between the connective needle 7 and a conventional elastic member as the connective needle 7 is inserted into the conventional elastic member. Therefore, it is assured that the ink jet head 3 and liquid container 2 can be connected or disconnected without leaking liquid.

The effects of the third embodiment, some of which are peculiar to the third embodiment, and the other of which are the same as those of the first embodiment, are as follows. In other words, the third embodiment also assures that the connective hole 5 remains properly sealed even when the connective needle 7 is pulled out after it is left in the elastic member 43 for a long period of time. When the elastic member 43 is in the state shown in FIGS. 21 and 22, no compression pressure is present in the cylindrical portion 43*b* of the elastic member 43. In comparison, the dome-shaped portion of the elastic member 43 is always in the compressed state, whether or not the connective needle is in it.

Figure 25:
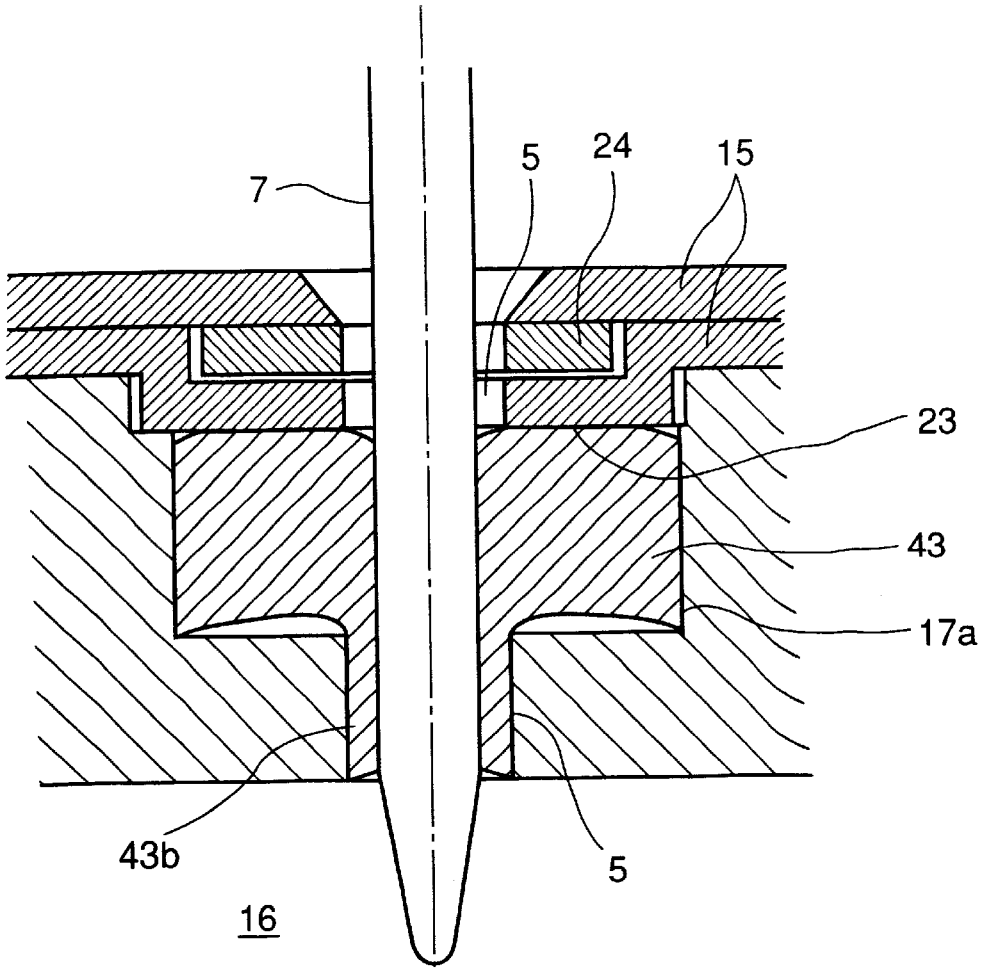
FIG. 25 is a drawing for showing the state of the elastic member shaped as shown in FIG. 18, after the connective needle is completely inserted into the elastic member in the recess of the elastic member holding member of the liquid container.

FIG. 25 shows the state of the elastic member 43 after the complete penetration of the connective needle 7 through the elastic member 43.

As is shown in FIG. 25, in the case of the dome-shaped portion of the elastic member 43 in which compression pressure is present even before the insertion of the connective needle 7, as the connective needle 7 is inserted into the dome-shaped portion of the elastic member 43, the compression pressure in the dome-shaped portion of the elastic member 43 is increased by the amount proportional to the volume of the portion of the connective needle 7 in the dome-shaped portion of the elastic member 43. In comparison, in the case of the cylindrical portion 43*b*, the diameter of which is smaller than the internal diameter of the connective hole 5, as the connective needle 7 is inserted into the cylindrical portion 43*b*, the cylindrical portion 43*b* expands in the radius direction of the connective hole 5, and presses upon the wall of the connective hole 5. As a result, it is compressed, generating compression pressure therein. In other words, compression pressure is present in the cylindrical portion 43*b* only after the insertion of the connective needle 7 into the cylindrical portion 43*b*, and the amount of this compression pressure is approximately proportional to the volume of the portion of the connective needle 7 in the cylindrical portion 43*b*.

As is evident from the above description, the compression pressure generated in the dome-shaped portion of the elastic member 43 is greater than that generated in the cylindrical portion 43*a* of the elastic member 43.

Further, compression stress is present in the cylindrical portion 43*b* only when the connective needle 7 is inserted into, or in, the cylindrical portion 43*b*. Therefore, during the period from when the liquid container 2 is manufactured to when the liquid container 2 is discarded, the cumulative length of the time in which the compression pressure is present in the dome-shaped portion of the elastic member 43 is longer than the cumulative length of time in which the compression pressure is present in the cylindrical portion 43*b*.

Thus, effects similar to those obtained by the first embodiment are also obtained by the third embodiment. The deterioration of the elasticity of the cylindrical portion 43*b*, which occurs with elapse of time, is smaller than that of the dome-shaped portion of the elastic member 43. This is for the following reason. If the elastic member 43 is left alone for a long period of time, with the connective needle 7 penetrating it, creep occurs to the elastic member 43; in other words, the elastic member 43 fails to completely revert to its original shape and volume after the removal of the connective needle 7. This phenomenon, or creep, is less likely to occur to the cylindrical portion 43*b*. Therefore, even when the connective needle 7 is pulled out of the elastic member 43 after being left therein for a long period of time, the connective hole 5 remains properly sealed by the cylindrical portion 43*b*.

Figure 23:
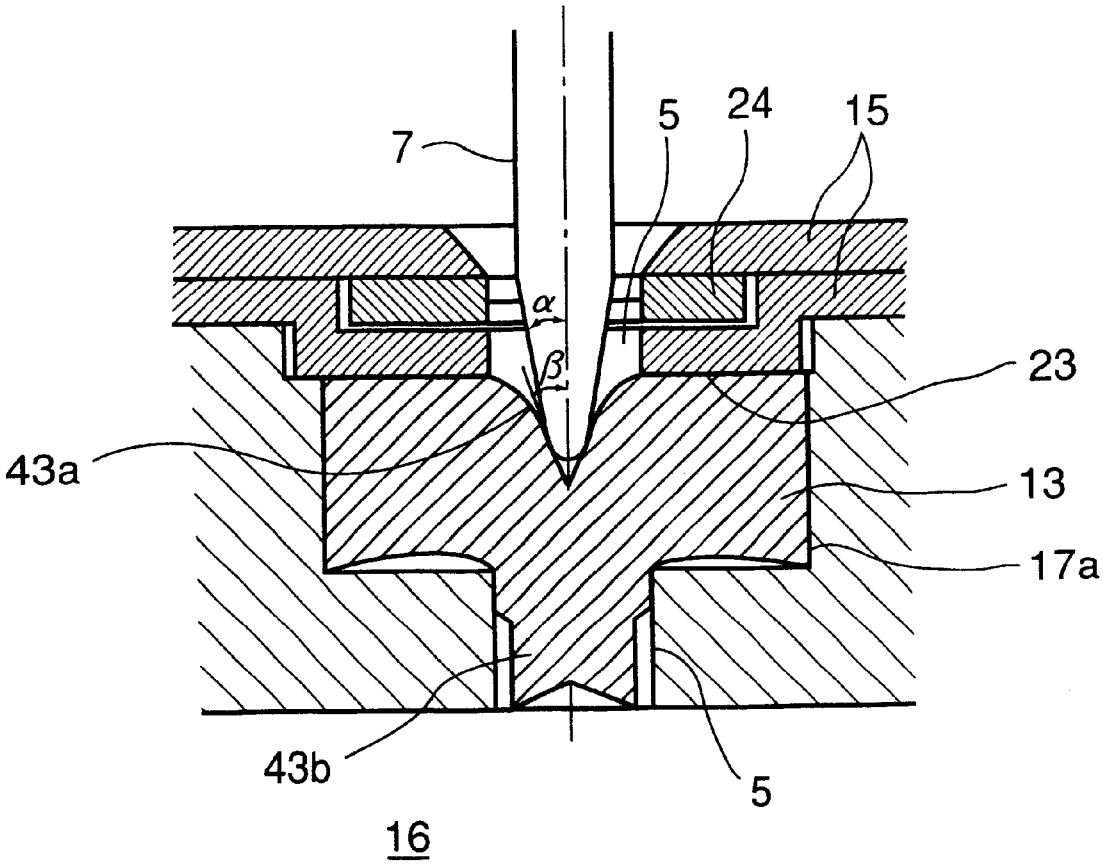
FIG. 23 is a drawing for describing the relationship between the taper angle (angle of inclined wall) of the conically recessed portion of the elastic member, in the state shown in FIG. 21, and the taper angle of the leading end portion of the connective needle.

Incidentally, the changes, which occur to the elastic member for the connective hole 6 as the connective needle 9 is inserted into the elastic member, are the same as those shown in FIGS. 23–25, which occur to the elastic member 43 as the connective needle 7 is inserted into the elastic member 43.

(Embodiment 4)

Next, referring to FIGS. 27–32, the fourth embodiment of the present invention will be described. Any structural component in this embodiment which is the same as one of the structural components in the first embodiment shown in FIGS. 1–3, will be given the same referential code as the one given to the same component, so that the description of the same component in the first embodiment can be used as a reference.

The external configuration of the elastic member in the fourth embodiment, the relationship between this elastic member and recess 17*a*, and how the elastic member is placed and kept in the recess 17*a*, are the same as those in the first embodiment.

Figure 27:
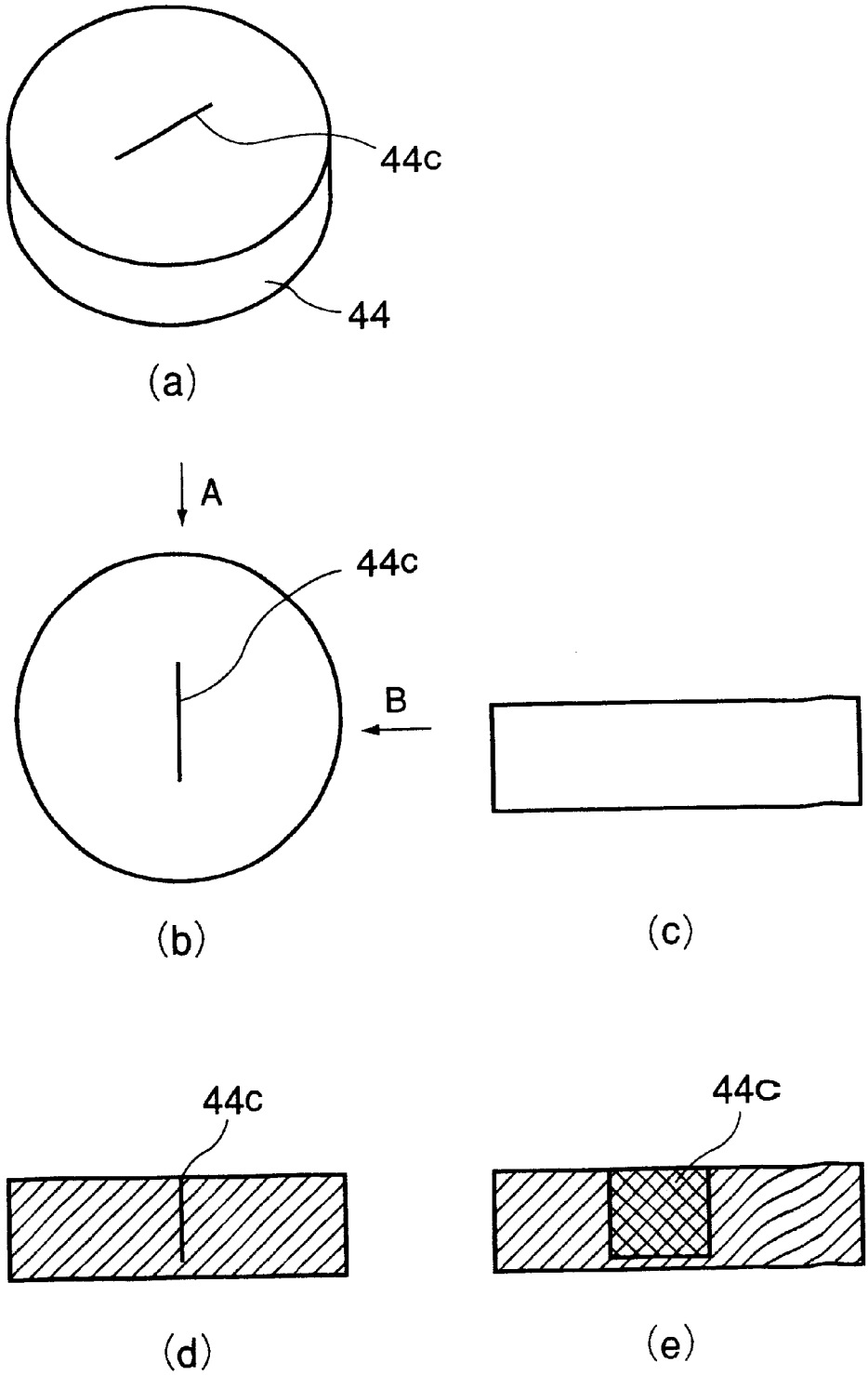
FIG. 27 is a drawing for describing another shape, as the fourth embodiment of the present invention, for the elastic member for the connective hole of the liquid container in FIG. 1: (*a*) is a perspective view as seen from above the side from which the connective needle is inserted; (*b*) is a plan view as seen directly above the side from which the connective needle is inserted; (*c*) is a side View as Seen from the direction A in (*b*); (*d*) is a vertical sectional view as seen from the direction parallel to the direction B; and (*e*) is a vertical sectional view as seen from the direction perpendicular to the direction B.

FIG. 27 is a drawing for describing the configuration of the elastic member for the connective hole of the liquid container shown in FIG. 1: (*a*) is a perspective view as seen from diagonally above the side from which the connective needle is inserted; (*b*) is a plan view as Seen from directly above the side from which the connective needle is inserted; (*c*) is a side view; (*d*) is a sectional view as seen from the direction A in (*b*); and (*e*) is a sectional view as seen from the direction B in (*b*).

FIGS. 27–31 show processes through which the connective needle 7 is inserted through an elastic member 44 after the elastic member 44 shaped as shown in FIGS. 27 is placed in the recess 17*a* to plug the connective hole 5 (or 6) shown in FIG. 1. More specifically, FIG. 27 is a sectional view of the elastic member 44, at the plane which coincides with a slit 44*c* of the elastic member 44. The arrow mark in FIG. 27 represents the force acting on the slit 44*c* before the penetration of the elastic member 44 by the connective needle 7.

FIG. 3D shows the elastic deformation of the elastic member 44 during the insertion of the connective needle 7, and of the elastic member 44 after the insertion of the connective needle 7.

As shown in FIGS. 27(*a*)–27(*e*), the elastic member 44 is approximately cylindrical. It is provided with the slit 44*c* (gapless cut), which is in the surface on the side from which the connective needle 7 is inserted. The slit 44*c* does not reach the other side of the elastic member 44.

Figure 28:
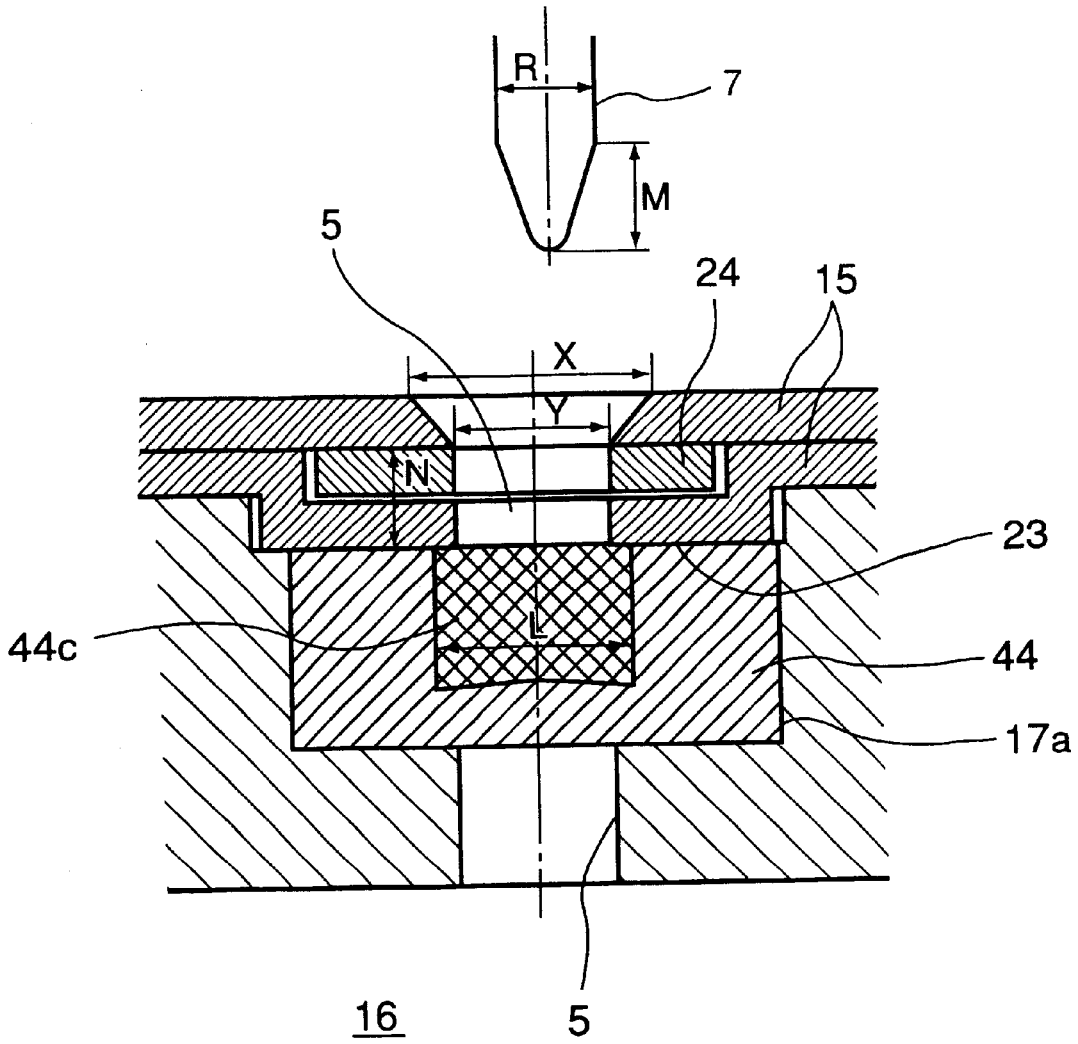
FIG. 28 is a drawing for showing the first stage of the insertion of the connective needle into the elastic member, shaped as shown in FIG. 27, after the placement of the elastic member at the connective hole of the liquid container shown in FIG. 1.
Figure 29:
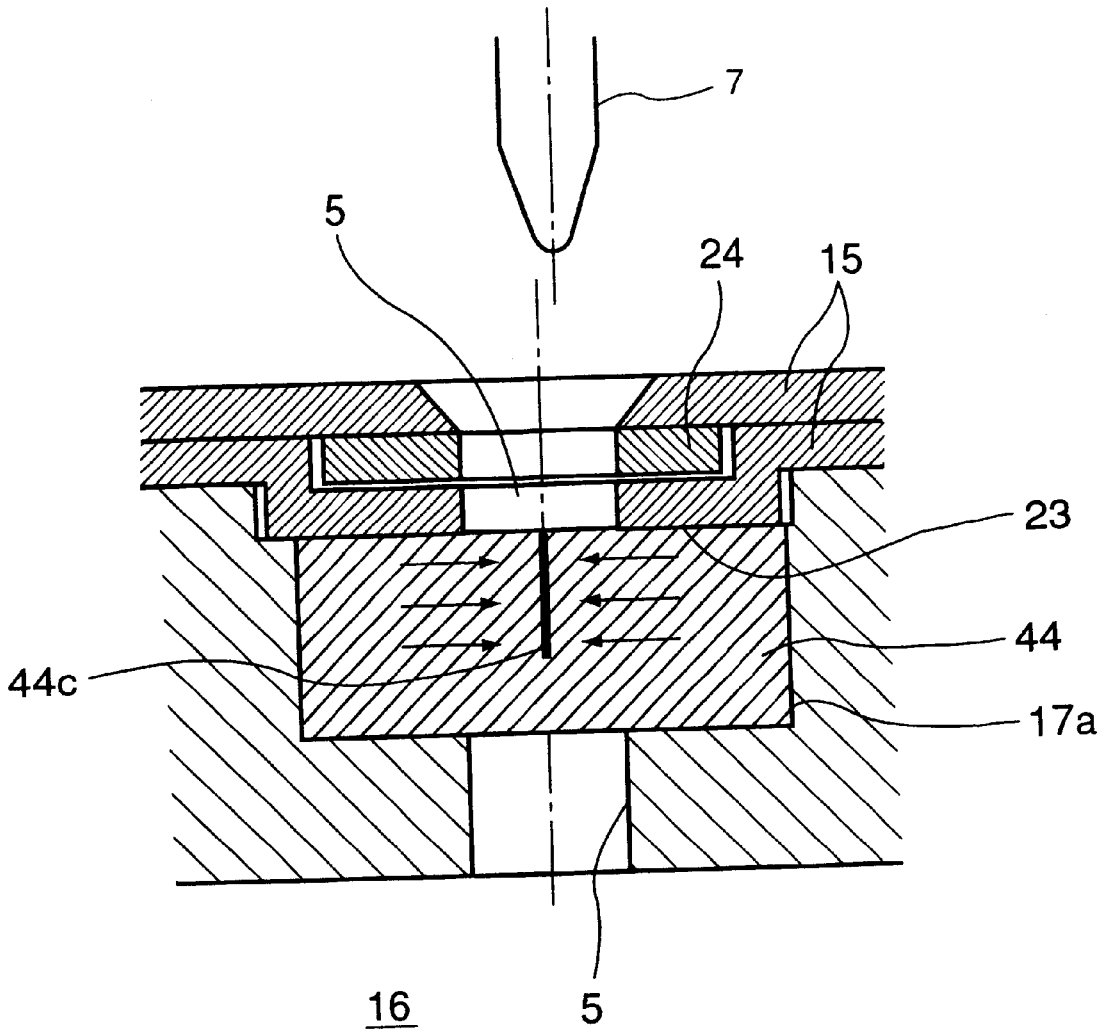
FIG. 29 is a drawing for showing also the first stage of the insertion of the connective needle into the elastic member, shaped as shown in FIG. 27, after the placement of the elastic member at the connective hole of the liquid container shown in FIG. 1.

Referring to FIGS. 28 and 29, the retaining member 15 is fixed to the elastic member holding portion 17 in a manner to cover the recess 17*a*.

It is provided with a pressing portion 23 for pressing the elastic member 44 in the direction virtually perpendicular to the diameter direction of the elastic member 44. After the elastic member 44 is placed in the recess 17*a*, and the retaining member 15 is fixed to the elastic member holding member 17, compression pressure is present in the elastic member 44. This compression pressure acts toward the center of the elastic member 44, that is, in the direction indicated by an arrow mark in FIG. 29, in the elastic member 44.

Figure 30:
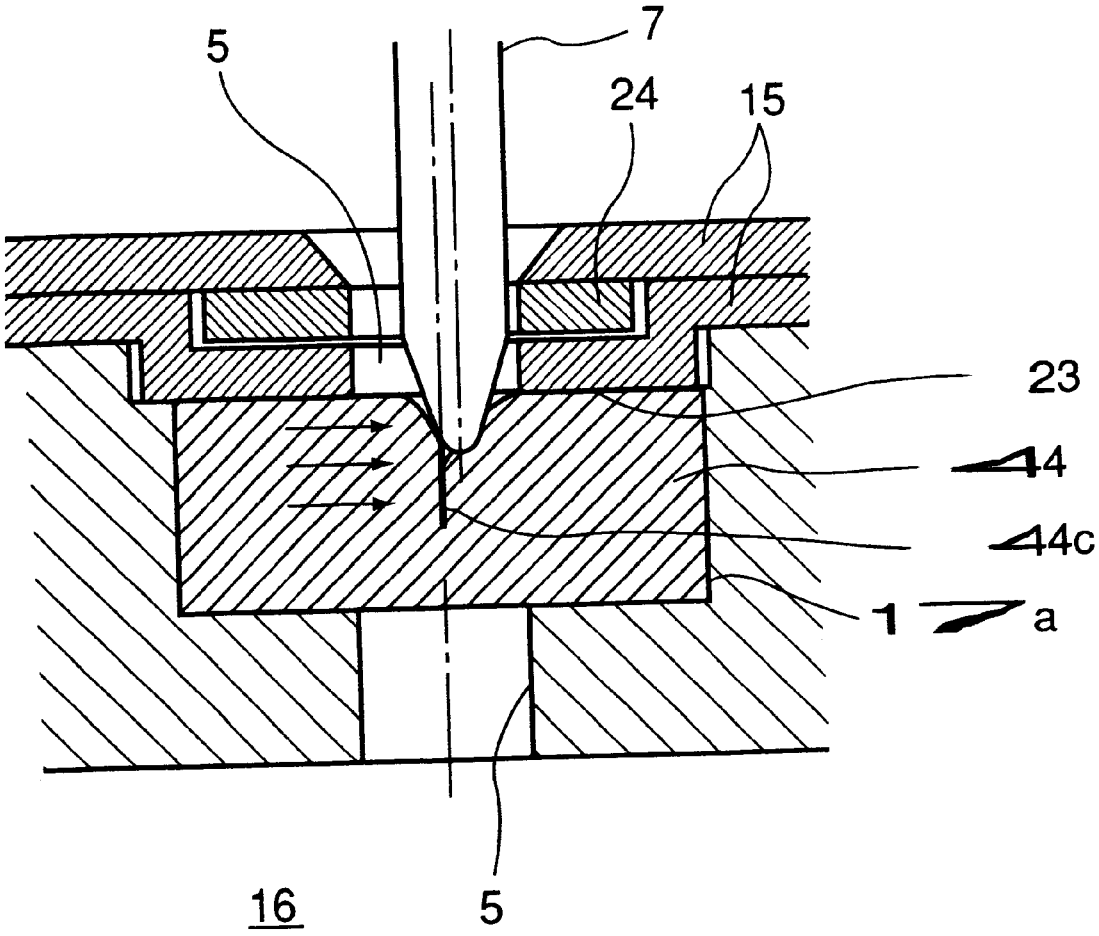
FIG. 30 is a drawing for showing the second stage of the insertion of the connective needle into the elastic member, shaped as shown in FIG. 27, after the placement of the elastic member at the connective hole of the liquid container shown in FIG. 1.
Figure 31:
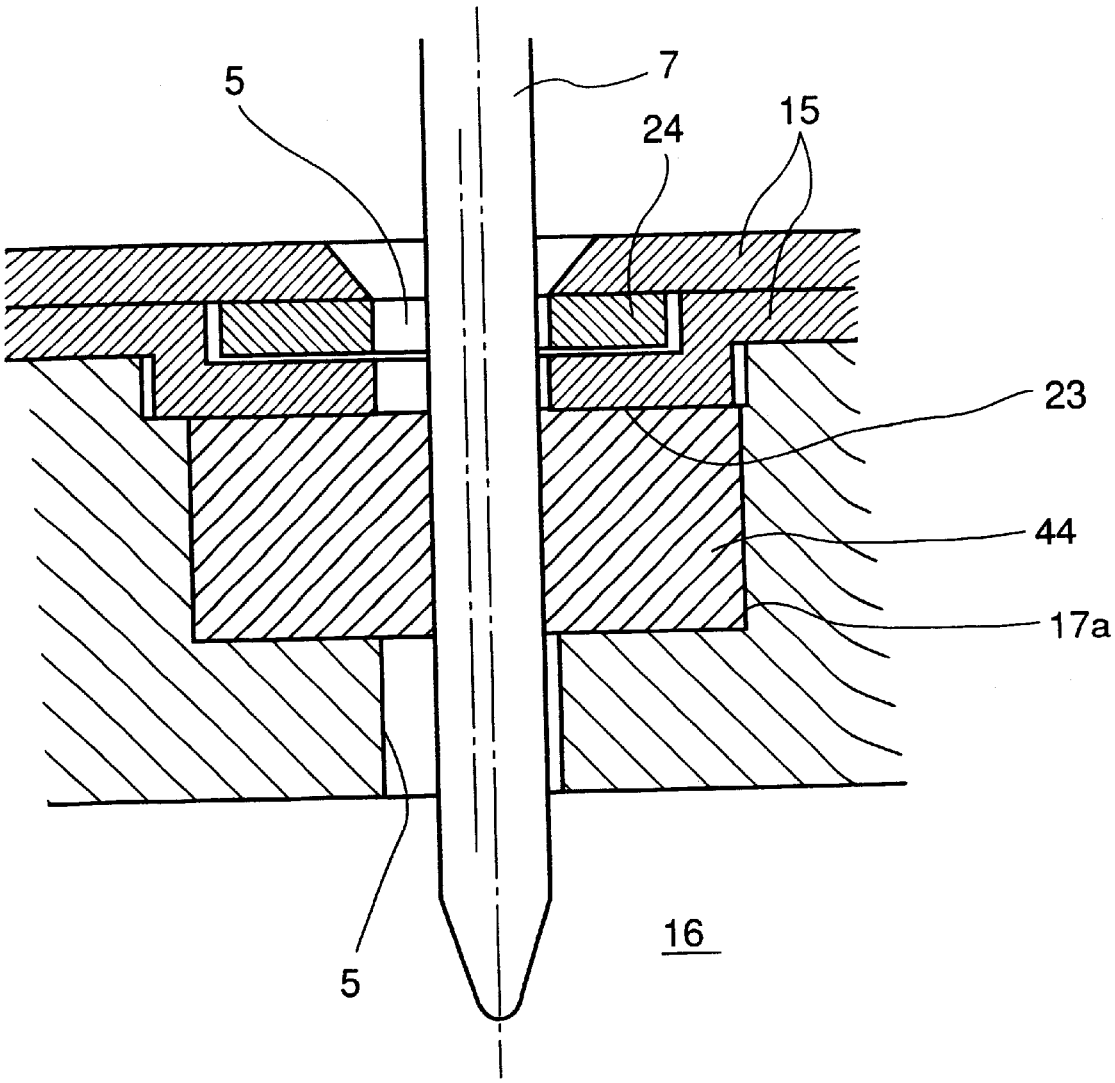
FIG. 31 is a drawing for showing the final stage of the insertion of the connective needle into the elastic member, shaped as shown in FIG. 27, after the placement of the elastic member at the connective hole of the liquid container shown in FIG. 1.

Next, referring to FIG. 30, when the connective needle 7 is inserted into the elastic member 44, if the point of the surface of the elastic member 44, with which the tip of the connective needle 7 comes into contact at first, is off the slit 44*c*, the slit 44*a* moves to the connective needle 7 as the connective needle 7 is pressed upon the elastic member 44, since the aforementioned compression pressure, which is acting toward the center of the elastic member 44, deforms the elastic member 44 so that the slit 44*c* moves to the connective needle 7. To state inversely, the connective needle 7 is guided into the slit 44*c*. Then, the connective needle 7 penetrates the elastic member 44 after passing through the slit 44*c*, as shown in FIG. 31.

In other words, with the provision of the above described structural arrangement, the connective needle 7 is made to penetrate the elastic member 44 always through the same spot, that is, the slit 44*c*, regardless of the initial contact point between the connective needle 7 and elastic member 44, preventing the damage to the elastic member 44 by the connective needle 7. In addition, without the damage to the elastic member 44, the compression force, which is constantly acting toward the center of the elastic member 44, in the elastic member 44 after the placement of the elastic member 44 in the recess 17*a*, remains intact, assuring that after the removal of the connective needle 7, the slit 44*c* reverts to the original state, or the state of being perfectly shut. Therefore, the content of the liquid container 2, that is, ink, is prevented from seeping out through the elastic member 44.

Incidentally, the elastic deformations which occur to the elastic member 44 during the insertion of the connective needle 9 through the elastic member 44 covering the connective hole 6 are the same as the elastic deformations of the elastic member 44 which occur to the elastic member 44 during the insertion of the connective needle 7 through the elastic member 44 covering the connective hole 5, which are shown in FIGS. 28–31.

When the elastic member 44 is in the recess 17*a*, the mutually facing walls of the slit 44*c* of the elastic member 44 remain pressed against each other by the compression pressure generated by the resiliency of the elastic member 44 and the wall of the recess 17*a*. Therefore, even after the extraction of the connective needle 7, the slit 44*c* is kept perfectly closed by the compression pressure in the elastic member 44. for this reason, the slit 44*c* may be such a slit that reaches from one end of the elastic member 44 to the other in terms of the connective needle insertion direction.

Further, after slipping into the slit 44*c*, the connective needle 7 is always guided to a predetermined point, that is, the connective hole 5, by the slit 44*c*. Thus, the tiny rip which is caused through the elastic member 44 by the penetration of the connective needle 7 aligns with the slit 44*c*. Therefore, the damage the elastic member 44 in this embodiment sustains from the insertion of the connective needle 7 never reaches the amount of the damage to the aforementioned elastic member in accordance with the prior arts.

The above described benefits of this embodiment are more apparent when a material, which is less likely to properly tear as the connective needle advances through it, is used as the material for the elastic member 44. For example, in the case of the elastic member 44 formed of chlorinated butyl rubber with a hardness of no more than 400, which is often used as the material for the elastic member 44 because of its gas-impermeability and also its compatibility with ink, the mutually facing surfaces of the tiny rip formed through the elastic member by the connective needle are rough. Therefore, even when the rip looks perfectly closed, there sometimes remain microscopic gaps between the mutually facing surfaces of the rip, allowing the liquid (ink) to leak. In comparison, in the case of the elastic member 44 provided with the above described slit 44*c*, it is unnecessary to worry about this kind of problem.

The possibility that the elastic member 44 might be damaged by the insertion of the connective needle can be further reduced by making such a structural arrangement that the connective needle 7 is guided by the hole of the retaining member 15 so that the distance between the axial lines of the connective needle 7 and elastic member 44 becomes no more than 0.5 D (D: diameter of connective needle 7).

Once the elastic member 44 is penetrated by the connective needle 7, the elastic member 44 is similar in structure to an elastic member, through which the slit 43*c* has been cut all the way from the top surface to the bottom surface with the use of a stabbing blade or like during its manufacture. The sealing performance of the elastic member 44 in this condition is not as good as that of an elastic member, the slit 43*c* of which does not reach all the way from the top surface to the bottom surface. In other words, an elastic member 44 with the blind slit 44*c* can deal with wider ranges of ambient temperature and pressure fluctuations. For this and following reasons, it is desired that the slit 44*c* is not cut from one end of the elastic member 44 to the other during the manufacture of the elastic member 44. That is, the period in which the ability of the elastic member 44 to keep sealed the connective hole of a liquid container which changes in the internal pressure of its liquid chamber in response to the changes in ambient temperature and pressure is most important is the period from when the manufacturing of a liquid container is completed to when the liquid container begins to be used by a user of an ink jet recording apparatus (FIG. 43), in particular, the period in which the liquid container is transported. It may be thought that the pressure and temperature changes, to which the liquid container is subjected after the liquid container begins to be used, are ordinary ones, that is, those which occur in an ordinary living or working environment. This is why the slit 44*c* should not be cut all the way through the elastic member 44 during the manufacture of the liquid container.

In order to prevent the slit 44*c* from being widened by the complete penetration of the elastic member 44 by the connective needle 7. The length L of the slit 44*c* of the elastic member 44 is desired to satisfy the following inequality (FIG. 28):

$$2L > \pi D$$

D: diameter of connective needle 7.

The connective needle entrance portion of the connective hole 5 is tapered; the diameter X at the top is greater than the diameter Y at the bottom edge. Therefore, it is assured that even if the connective needle 7 is slightly misaimed, it is guided to the approximate center of the elastic member 44.

Generally speaking, the connective needle 7 is tapered at the end. By making the distance M from the tip of the connective needle 7 to the straight portion (portion with an external diameter of R) of the connective needle 7, shorter than the distance N from the edge of the connective needle entrance portion of the connective hole 5, on the trailing side in terms of the connective needle insertion direction, which is Y in diameter, to the top surface of the elastic member 44 (FIG. 28), it is possible to prevent the tip of the connective needle 7 from coming into contact with the top surface of the elastic member 44 while the tapered portion of the connective needle 7 is still in contact with the edge of the entrance portion of the connective hole 5, on the trailing side in terms of the connective needle insertion direction, which is Y in diameter. With this arrangement, the connective needle 7 is guided to the approximate center of the top surface of the elastic member 44.

The following is true with the above described embodiment as well as the embodiments which will be described later. The amount of the friction between the elastic member 44 and tip of the connective needle 7 varies depending on the materials for the elastic member 44 and connective needle 7. When this friction is high, a substantial amount of force is necessary to mount an ink container in the main assembly of an ink jet recording apparatus, inconveniencing an incompetent user.

When this friction is extremely high, it is impossible to insert an ink container into the predetermined position. In such a case, it is possible that ink is not supplied to the ink jet head, resulting in printing failure.

In the worst case, the tip of the connective needle 7 fails to be guided to the center portion of the elastic member 44, that is, the position of the slit 44*c*, after the connective needle 7 comes into contact with the top surface of the elastic member 44. As a result, the connective needle 7 enters the elastic member 44 without going through the slit 44*c*, tearing through the elastic member 44, which sometimes reducing the ability of the elastic member 44 to keep the connective hole 5 sealed.

This problem can be avoided by coating the top surface of the elastic member 44 with lubricant, which reduces the aforementioned friction between the top surface of the elastic member 44 and the tip of the connective needle 7, making it possible for the tip of the connective needle 7 to slide on the top surface of the elastic member 44 to be guided into the slit 44*c*.

As the liquid lubricant usable for the above described purpose, there are silicone oil, and glycerine selected from among glycols. As the solid lubricant, solidified liquid silicone or the like are available. The properties, in addition to lubricity, which are required of the lubricant for the above described purpose, are that it is not affected in its properties by the environmental factors, for example, temperature, humidity, and the like, that it does not affect the properties of the object on which it is coated or the object with which it comes into contact, that it is not affected in properties by the object on which it is coated or the object with which it comes into contact, and also that it does not affect the properties of the liquid within the liquid container, or is not affected in properties by the liquid in the liquid container. In this embodiment, glycerine was used as the lubricant for satisfying the above described requirements.

Coating the top surface of the elastic member 44 with lubricant is most useful when it is impossible to make a structural arrangement for realizing a conical indentation of a sufficient size in the top surface of the elastic member 44 as the elastic member 44 is placed in the recess 17*a*, or it is impossible to make a structural arrangement for realizing a conical indentation in the top surface of the elastic member 44.

However, even when it is possible to make a structural arrangement for realizing a conical indentation of a sufficient size in the top surface of the elastic member 44 as the elastic member 44 is placed in the recess 17*a*, coating the top surface of the elastic member 44 with lubricant is still useful in that it allows the connective needle 7 to be smoothly inserted, since the fact that it reduces the friction between the connective needle 7 and elastic member 44 does not change.

The top surface of the elastic member 44 and the mutually facing internal surfaces of the slit 44*c* can be coated with lubricant by coating the sharp blade for cutting the slit 44*c*, with lubricant, when cutting the slit 44*c*.

Coating the mutually facing internal surfaces of the slit 44*c* with lubricant reduces the amount of the friction which occurs between the connective needle 7 and the mutually facing internal surface of the slit 44*c*, reducing therefore the possibility that the connective needle 7 will pierce into the one of the mutually facing surfaces of the slit 44*c*.

Lubricant may be placed between the bottom surface of the retaining member 15 and the top surface of the elastic member 43, as indicated by a referential code a in FIGS. 21 and 22. This reduces the possibility that the elastic member 43 is shifted by the friction, which occurs between the bottom surface of the retaining member 15 and the top surface of the elastic member 43, when the elastic member 43 is placed in the recesses 17*a*, or when the connective needle 7 is put through the elastic member 43 or extracted from the elastic member 43. Further, lubricant may be coated on the wall of the recess 17*a*, in which the elastic member 43 is placed, as indicated by a referential code b in FIGS. 20 and 21. This reduces the friction between the elastic member 43 and the wall of the recess 17*a*, making it easier for the elastic member 43 to be placed in the recess 17*a*.

(Embodiment 5)

Next, referring to FIGS. 32–41, the fifth embodiment of the present invention will be described.

Figure 32:
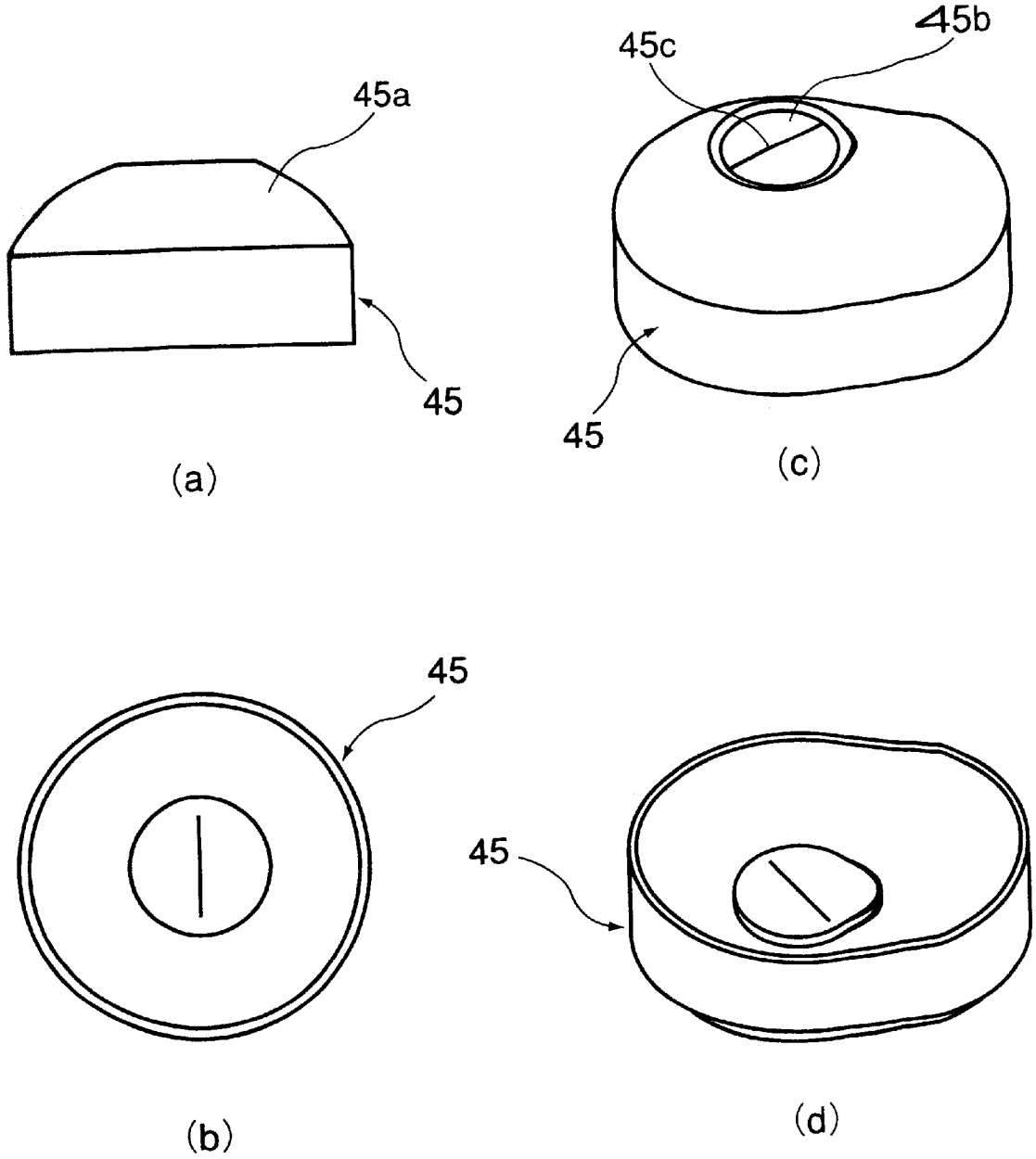
FIG. 32 is a drawing for showing the configuration of the elastic member in the fourth embodiment of the present invention, for the connective hole of the liquid container shown in FIG. 1: (*a*) is a side view; (*b*) is a bottom view (view as seen from the side opposite to the side from which the connective needle is inserted); (*c*) is a perspective view as seen from diagonally above the side from which the connective needle is inserted; and (*d*) is a perspective view as seen from diagonally below the side opposite to the side from which the connective needle is inserted.
Figure 33:
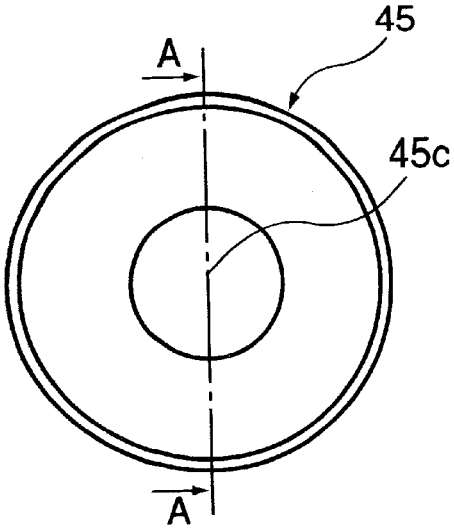
FIG. 33 is a drawing for showing also the elastic member in the fourth embodiment of the present invention: (*a*) is a bottom view (view as seen from the side opposite to the side from which the connective needle is inserted); and (*b*) is a sectional view at the plane A—A in (*a*).
Figure 33:
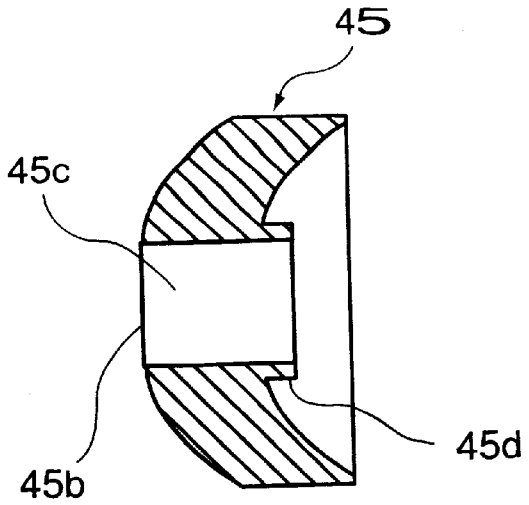
Figure 33:
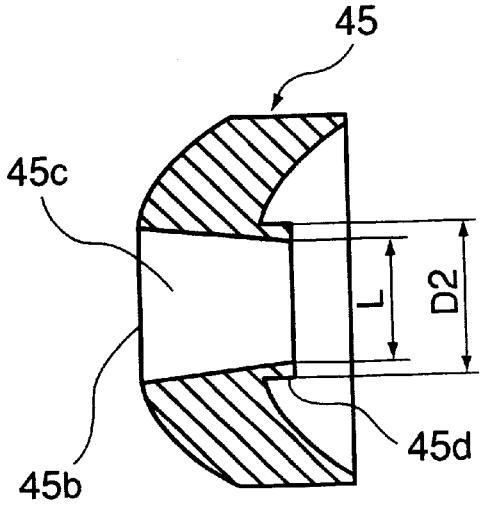

FIG. 32(*a*) is a side view of the elastic member; FIG. 32(*b*), a bottom view of the elastic member (view as seen from the side opposite to the side from which the connective needle is inserted); FIG. 32(*c*), a perspective view of the elastic member as seen from diagonally above the side from which the connective needle is inserted; and FIG. 32(*d*) is a perspective view of the elastic member as seen from diagonally below the side opposite to the side from which the connective needle is inserted. FIG. 33(*a*) is a bottom view of the elastic member (view as seen from the side opposite to the side from which the connective needle is inserted), and FIG. 33(*b*) is a sectional view of the elastic member at the plane A—A in FIG. 33(*a*).

Figure 34:
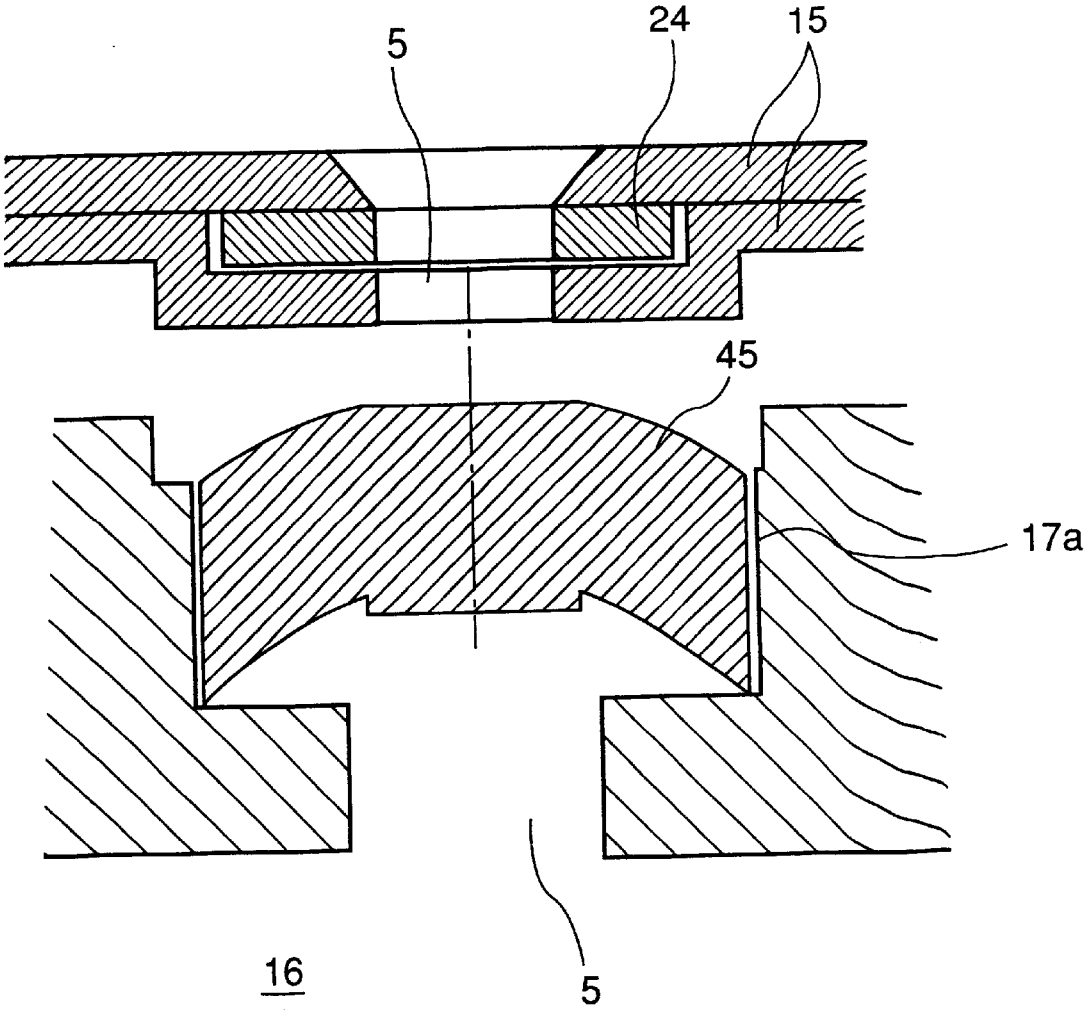
FIG. 34 is a drawing for showing the state of the elastic member shown in FIGS. 32 and 33, after the placement of the elastic member in the recess connected to the connective hole.
Figure 35:
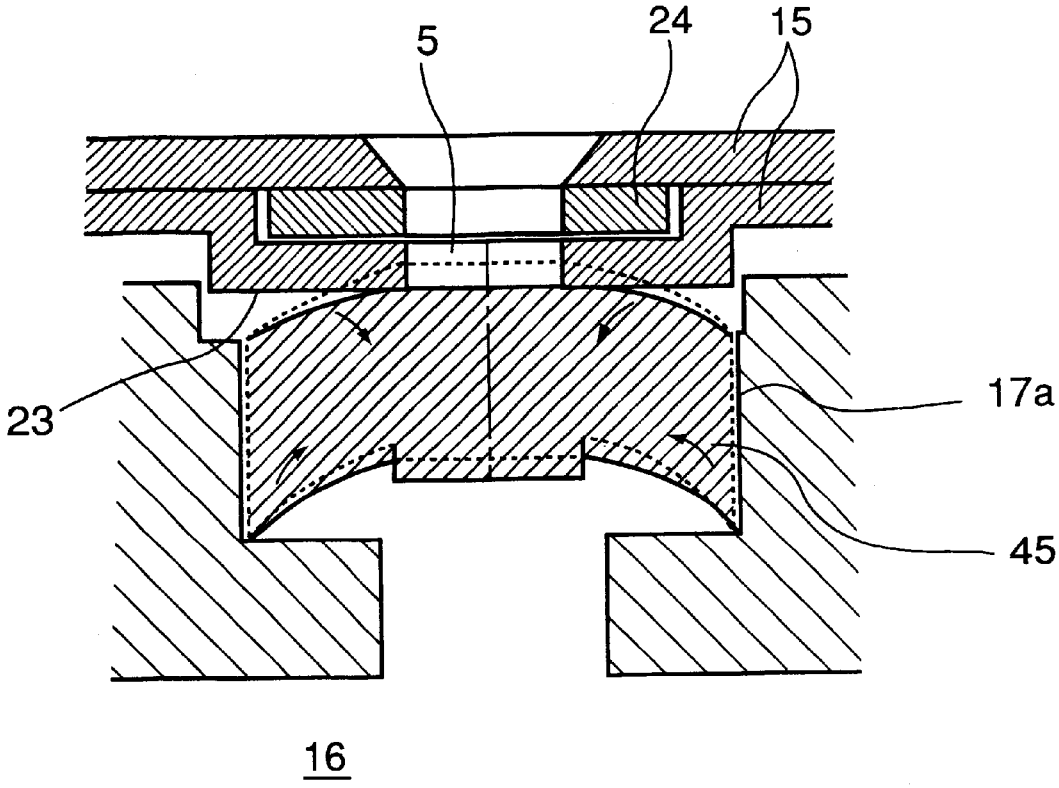
FIG. 35 is a drawing for showing the state of the elastic member shown in FIGS. 32 and 33, while the elastic member is pressed into the recess by the retaining member.
Figure 36:
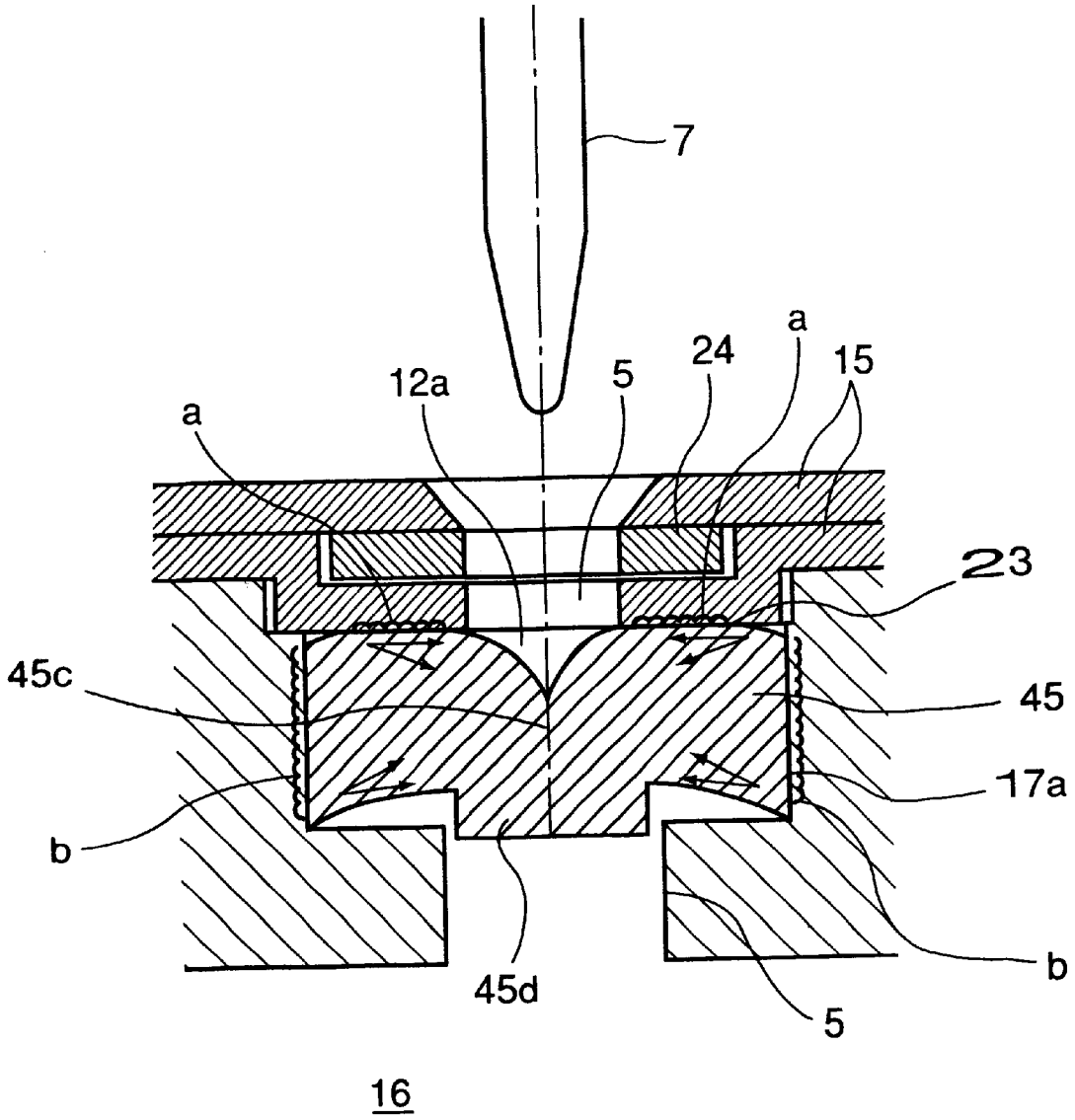
FIG. 36 is a drawing for showing the state of the elastic member shown in FIGS. 32 and 33, after the completion of the placement of the elastic member in the recess.

FIGS. 34–36 show processes through which the elastic member 45 shown in FIGS. 32 and 33 is placed in the recess 17*a* and is secured therein with the use of the retaining member 15. FIG. 34 shows the state of the elastic member 45 shows the state of the elastic member 45 after its placement in the recess 17*a* in a manner to cover the connective holes 5 and 6, and FIG. 35 shows the elastic member 45 which is being pressed down by the retaining member 15. FIG. 36 shows the state of the elastic member 45 after the completion of its placement in the recess 17*a*.

Although these drawings show only the connective hole 5 as the hole to be covered with the elastic member 43, the connective hole 6 also is covered with the elastic member 43 (different from the one covering the hole 5) as shown in these drawings.

Referring to FIG. 34, a referential code 17*a* designates a recess, in which the elastic member 45 for plugging the connective hole 5 leading to the liquid chamber lk is placed. The internal diameter of the recess 17*a* is virtually the same the external diameter of the elastic member 45.

If the external diameter of the elastic member 45 is slightly smaller than the internal diameter of the recess 17*a*, it is easier to place the elastic member 45 in the recess 17*a*. Even if the external diameter of the elastic member 45 is greater than the internal diameter of the recess 17*a*, this does not cause any problem (it is not difficult to place the elastic member 45 in the recess 17*a* unless the diameter of the elastic member 45 is disproportionately larger than the internal diameter of the recess 17*a*), since the shape of the elastic member 43 can be easily changed by the application of force. The elastic member 45 is a monolithic member, and in the form of a dome with a predetermined curvature, as shown in FIGS. 32 and 33.

Next, referring to FIG. 20, as the retaining member 15 is attached to the liquid container, the elastic member 45 is pressed down by the retaining member 15. The length of the ridge line of the budging side of the dome-shaped elastic member 45 is greater than the internal diameter of the recess 17*a*. Therefore, not only does the pressure applied to the elastic member 45 by the retaining member 15 act in the direction to press the elastic member 45 down, but also in the direction to spread the elastic member 45 in the radius direction of the recess 17*a*. However, the elastic member 45 is confined in the recess 17*a*, being prevented from expanding in the radius direction, by the wall of the recess 17*a*. As a result, pressure is generated in the elastic member 45 in the direction to concentrate to the center of the elastic member 45.

In this state, the compression stress in the elastic member 45 varies depending on which portion of the elastic member 45 is pressed by the retaining member 15. If the elastic member 45 is in the form of a plane dome, as the retaining member 15 is pressed down on the elastic member 45, the lip portion of the hole of the retaining member 15 comes into contact with the elastic member 45, indenting the elastic member 45 is in the pattern of a ring. If the diameter of the flat top surface 45*b* of the elastic member 45 is greater than the diameter of the bottom lip of the hole of the retaining member 15, the compression stress which occurs at the contact surface between the flat bottom surface of the retaining member 15 and the flat top surface 45*b* of the elastic member 45 can be better regulated than otherwise.

Therefore, the contact pressure is more evenly distributed across the area of the elastic member 45 which comes into contact with the retaining member 15, and therefore, the compression stress which occurs across the area of the elastic member 45 which comes into contact with the retaining member 15 is less likely to become uneven, than other wise.

Providing the top portion of the dome-shaped portion 45*a* of the elastic member 45 with a flat surface 45*b* as shown in FIGS. 32 and 33 prevents the top portion of the dome-shape portion 45*a* of the elastic member 45 from bulging upward as designated by a referential code 43*d* in FIG. 22.

Also, it causes the elastic member 45 to form an indentation (similar to the portion 43*e* in FIG. 21), which serves as a guide for leading the connective needle into the aforementioned slit, as the elastic member 45 is pressed down by the retaining member 15.

However, the conical indentation which can be realized with the provision of the above described structural arrangement is shallower than the conical indentation realized by providing the top portion of the elastic member 43 with the slight but definitely conical indentation 43*a*, in the third embodiment, as shown in FIG. 18.

Therefore, attention should be paid to the correlation between the angle of the side wall of the conical indentation to be realized, and the angle a at which the tip of the connective needle 7 is tapered.

Referring to FIG. 36 which shows the state of the elastic member 45 in the recess 17*a*, only the dome-shaped portion of the elastic member 45 has been compressed toward its axial line by the pressing portion 23 and the wall of the recess 17*a*.

Figure 37:
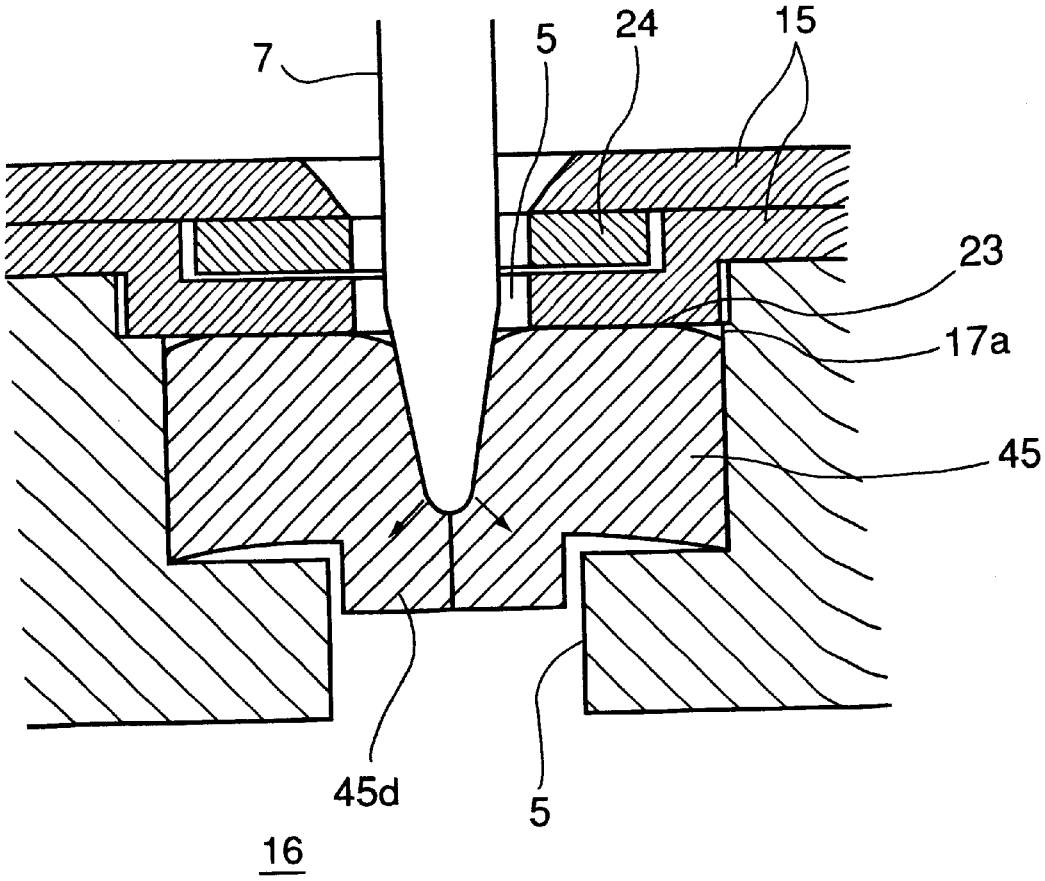
FIG. 37 is a drawing for showing the behavior (elastic deformation) of the elastic member, shown in FIGS. 32 and 33, in the recess, while the connective needle is inserted into the liquid container.

FIG. 37 shows the behavior (elastic deformation) of the elastic member 45 during the insertion of the connective needle 7. As shown in FIG. 37, as an attempt is made to insert a relatively thick connective needle 7 into the elastic member 45, the elastic member 45 deforms.

However, the elastic member 45 is provided with the cylindrical portion 45*b*, which is located on the downstream side in terms of the direction in which the connective needle 7 is inserted. In other words, the space into which the portion of the elastic member 45, which came in contact with the connective needle 7, is dragged by the connective needle 7 if the elastic member 45 were not provided with the cylindrical portion 45*b*, has been occupied with the cylindrical portion 45*b*.

Figure 39:
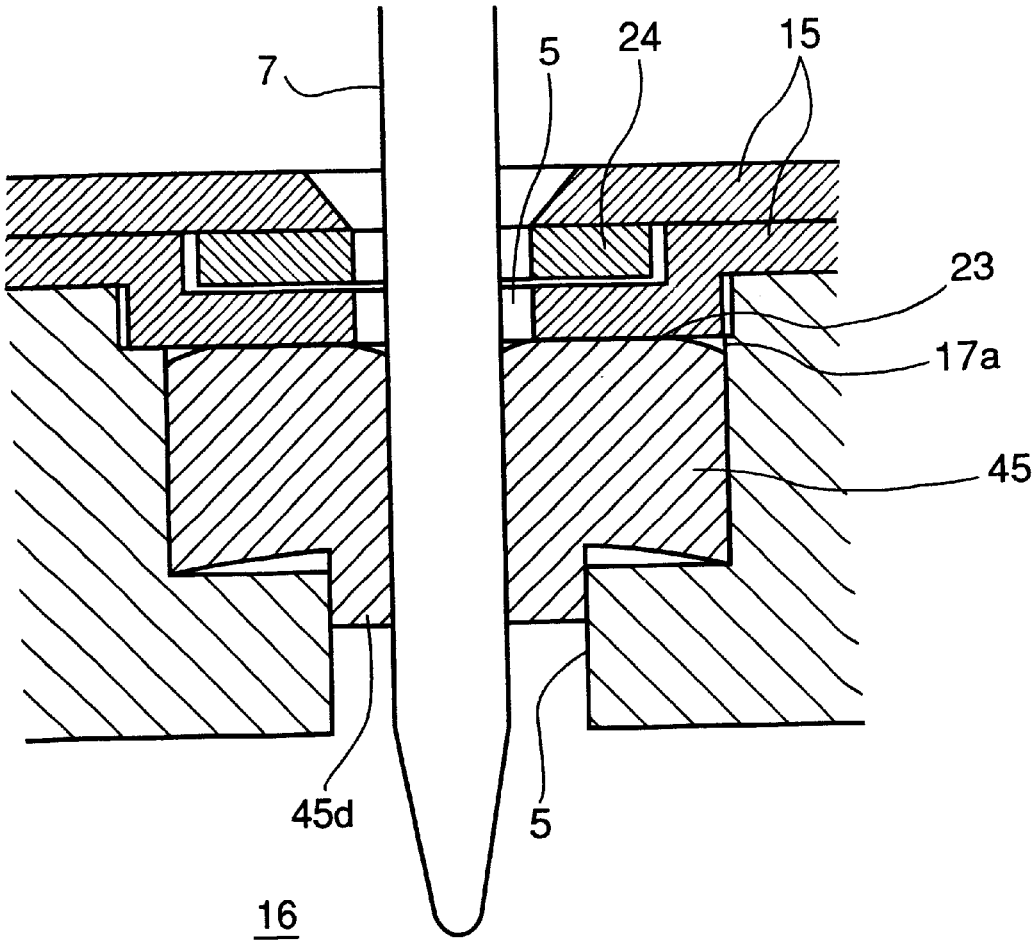
FIG. 39 is a drawing for showing the state of the elastic member, shown in FIGS. 32 and 33, in the recess, after the completion of the insertion of the connective needle into the liquid container.

Further, the cylindrical portion 45*b* is relatively rigid. Therefore, in comparison to the provision of no cylindrical portion 45*b*, the provision of the cylindrical portion 45*b* makes it less likely to occur that as the end portion of the connective needle 7 is pushed past the elastic member 45, the internal portion of the elastic member 45, which came into contact with the connective needle 7 as the connective needle 7 is inserted into the elastic member 45, is dragged out of the elastic member 45 by the connective needle 7, and conically peels away from the connective needle 7 in a manner to create a conical hole (FIG. 49(*b*). Consequently, the connective needle 7 is properly inserted as shown in FIG. 39. In other words, according to this embodiment, the contact area formed between the connective needle 7 and the internal portion of the elastic member 45 is prevented from being reduced by the conical separation of the internal portion of the elastic member 45 from the connective needle 7. Further, the provision of the cylindrical portion 45*b* increases the contact area between the connective needle 7 and elastic member 45, improving the elastic member 45 in its ability to prevent the liquid within the liquid container from being leaked by the changes in the internal or ambient pressure of the liquid container.

Further, the top portion of the dome-shaped portion of the elastic member 45 may be provided with a shallow recess with a flat bottom surface 45*b*, instead of the aforementioned simple flat surface, so that the flat bottom surface 45*b* can be coated with lubricant with the use of a simply coating method such as stamping. Obviously, even if the top portion of the dome-shaped portion of the elastic member 45 is provided with only a simple flat surface, instead of the above described shallow recess with the flat bottom surface, a simple coating method such as stamping can be used.

In the case of the elastic member 45, the flat top portion 45*b* of which is slightly recessed as shown in FIG. 32, the lubricant coated on the flat top surface 45*b* is prevented from spreading to the other portions of the connective hole, which makes it possible to use lubricant with lower viscosity, increasing the number of lubricant selections.

Referring to FIGS. 33(*c*), the width L of the slit of the elastic member 45 does not need to be even from the top to bottom surfaces of the elastic member 45. However, in order to prevent the cylindrical portion 45*d* from being severed into two pieces by the spreading of the slit after the complete penetration of the elastic member 45, it is desired that the external diameter D2 of the cylindrical portion 45*d*, the diameter D of the connective needle 7, and the width L of the slit portion within the cylindrical portion 45*d*, satisfy the following inequity:

$$D2>2\ L/\pi>D.$$

Figure 40:
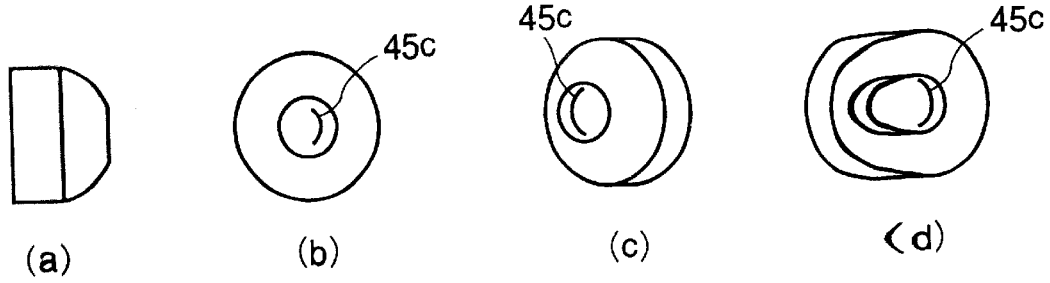
FIG. 40 is a drawing for showing a variation of the slit of the elastic member shown in FIGS. 32 and 33.

When the concerns regarding product structure makes it impossible to make the diameter of the hole of the retaining member 15 large, the elastic member 45 may be provided with an arcuate slit 45*c*, shown in FIG. 40, which satisfies the following inequity: $2\ L>\pi D$. This is also true with the preceding embodiments.

Figure 41:
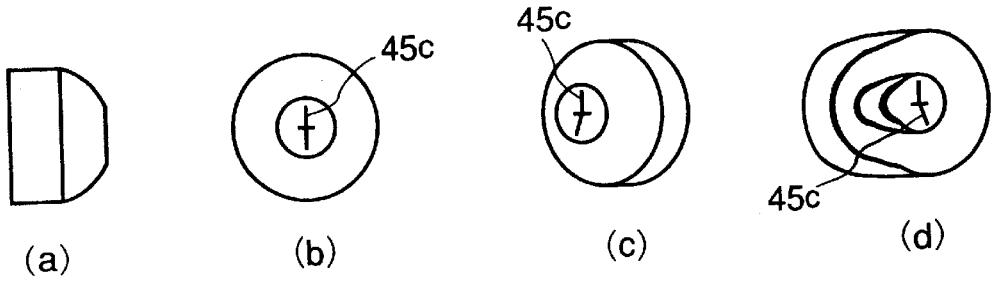
FIG. 41 is a drawing for showing another variation of the slit of the elastic member shown in FIGS. 32 and 33.

For the same reason, the elastic member 45 may be provided with a compound slit 42*c* made up of a pair of mutually intersecting sub-slits, shown in FIG. 41, which also satisfies the following inequity: $2\ L>\pi D$. However, as a liquid container is repeatedly mounted and dismounted, the portion of the elastic member 45 adjacent to the intersection of the sub-slits is repeatedly damaged, and in the worst case, it becomes detached from the surrounding portion of the elastic member 45. In other words, this compound slit 42*c* is inferior to a simple slit, in terms of sealing performance; it is inferior in terms of the caving resistance of the elastic member 45.

Thus, when the compound slit 42*c* is used, it is desired, for the following reason, that one of the pair of sub-slits is made shorter than the other.

That is, with such an arrangement, even if a given portion of the elastic member 45 around the intersection of the two sub-slits will become detached from the elastic member 45 due to the repeated mounting and dismounting of the liquid container, the length of this portion will be relatively short, and therefore, the caving of the elastic member 45, which will result from such a detachment will be insignificant. Therefore, the resultant decrease in the sealing performance of the elastic member 45 will be insignificant.

Further, if the elastic member 45 must be provided with a compound slit, such as the above described one, owing to unavoidable circumstances, the direction in which the connective needle 7 enters the elastic member 45 cannot be controlled.

Therefore, it is desired that the intersection of the sub-slits coincides with the axial line of the elastic member 45.

If the slit is too long in terms of the direction perpendicular to the axial direction of the elastic member 45, the portion of the elastic member 45 immediately next to the slit intersection becomes detached from the surrounding portion of the elastic member 45, causing the elastic member 45 to cave around the slit intersection, which result in the deterioration of the sealing performance of the elastic member 45.

Therefore, it is desired that the following inequity is satisfied:

$$1.5\ \pi D > L.$$

Further, the portion of the connective hole 5 of the retaining member 15, on the elastic member side, is desired to be gradually reduced in diameter in terms of the connective needle insertion direction, in order to assure that the connective needle 7 is guided toward the slit 45*c* of the elastic member 45.

Figure 38:
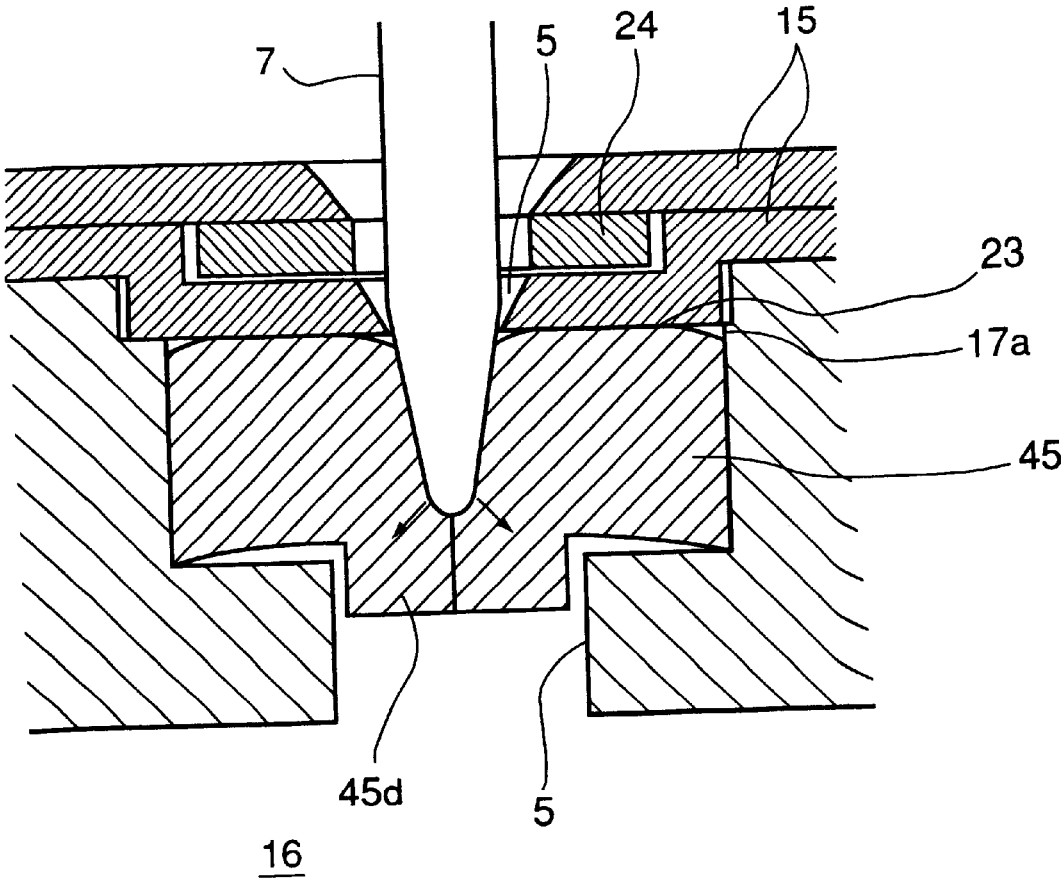
FIG. 38 is a drawing for showing a variation of the connective hole of the retaining member of the liquid container shown in FIG. 37.

Incidentally, the deformations of the elastic member 45, shown in FIGS. 37–39, which occur during the insertion of the connective needle 7 through the elastic member 45 plugging the first connective hole 5 are the same as those which occur during the insertion of the connective needle 9 through the elastic member 45 plugging the second connective hole 6.

In the above described embodiments, in which the elastic member comprised a dome-shaped main portion, and a cylindrical portion attached to the concaved side of the main portion, the cylindrical portion was on the liquid chamber side.

However, when the diameter of the connective needle 7 is relatively small, the cylindrical portion may be placed on the side from which the connective needle 7 enters the elastic member.

The elastic member with this positional arrangement of the cylindrical portion is just as effective as any of the elastic member without a cylindrical portion, in accordance with the present invention.

The following structural arrangement is not shown in FIGS. 2, 3, and 12–16, but is shown in FIGS. 19–25, 28–31, and 34–39. The retaining member 15 is made up of first and second sections. The first section is fixed to the elastic member holding member 17 in a manner to press the elastic member, and the second section is fixed to the first section in a manner to cover an absorbent member 34. The absorbent member 24 is fixed to the first section of the retaining member 15 in a manner to surround the hole (5) of the retaining member 15, through which the connective needle 7 is put.

The absorbent member 24 absorbs and retains the small amount of liquid droplets formed when the connective needles 7 and 9 are extracted from a liquid container, preventing therefore a user of an ink jet recording apparatus employing a liquid container in accordance with this embodiment of the present invention, the recording apparatus itself, the things surrounding the recording apparatus, from being contaminated with the liquid droplets (ink droplets) which are formed when the liquid container is removed.

Figure 42:
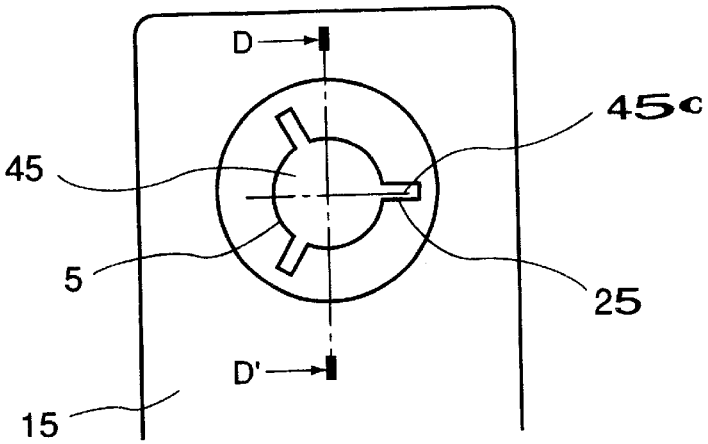
FIG. 42 is a bottom plan view of the liquid container equipped with the elastic member shaped as shown in FIGS. 32 and 13, depicting the preferable structural arrangement for the connective hole in the bottom wall of the liquid container, and its adjacencies.

When placing an absorbent member such as the above described one at the connective hole of a liquid container, the absorbent member is desired to be configured as shown in FIG. 42, which is a plan view of the connective hole, and its adjacencies, in the bottom portion of the liquid container in this embodiment, as seen from the side from which the connective needle is inserted.

The sectional view of the portion of the liquid container in FIG. 42, at the plane D-D in FIG. 42, is similar FIGS. 29 and 36 (sectional views).

In this embodiment, when the liquid container is provided with the above described absorbent member, the retaining member 15 is provided with a plurality of grooves 25, the depth direction of which coincides with the radius direction of the elastic member, as shown in FIG. 42. With this structural arrangement, the small amount of the liquid droplets (ink droplets) which are formed when a liquid container is removed from the connective needle are very effectively guided to the absorbent member, by the capillary force, better preventing therefore a user of an ink jet recording apparatus, the recording apparatus itself, and the things surrounding the recording apparatus, from being contaminated with the liquid droplets (ink droplets) which are formed when the liquid container is removed.

Further, at least one of the grooves 25 is aligned with the slit 45*c* of the elastic member 45 to connect the microscopic groove at the lip of the slit 45*c* and this groove 25. With this arrangement, the liquid droplets (ink droplets) which have adhered to the surface of the elastic member 45 are more efficiently guided to the absorbent member.

Figure 43:
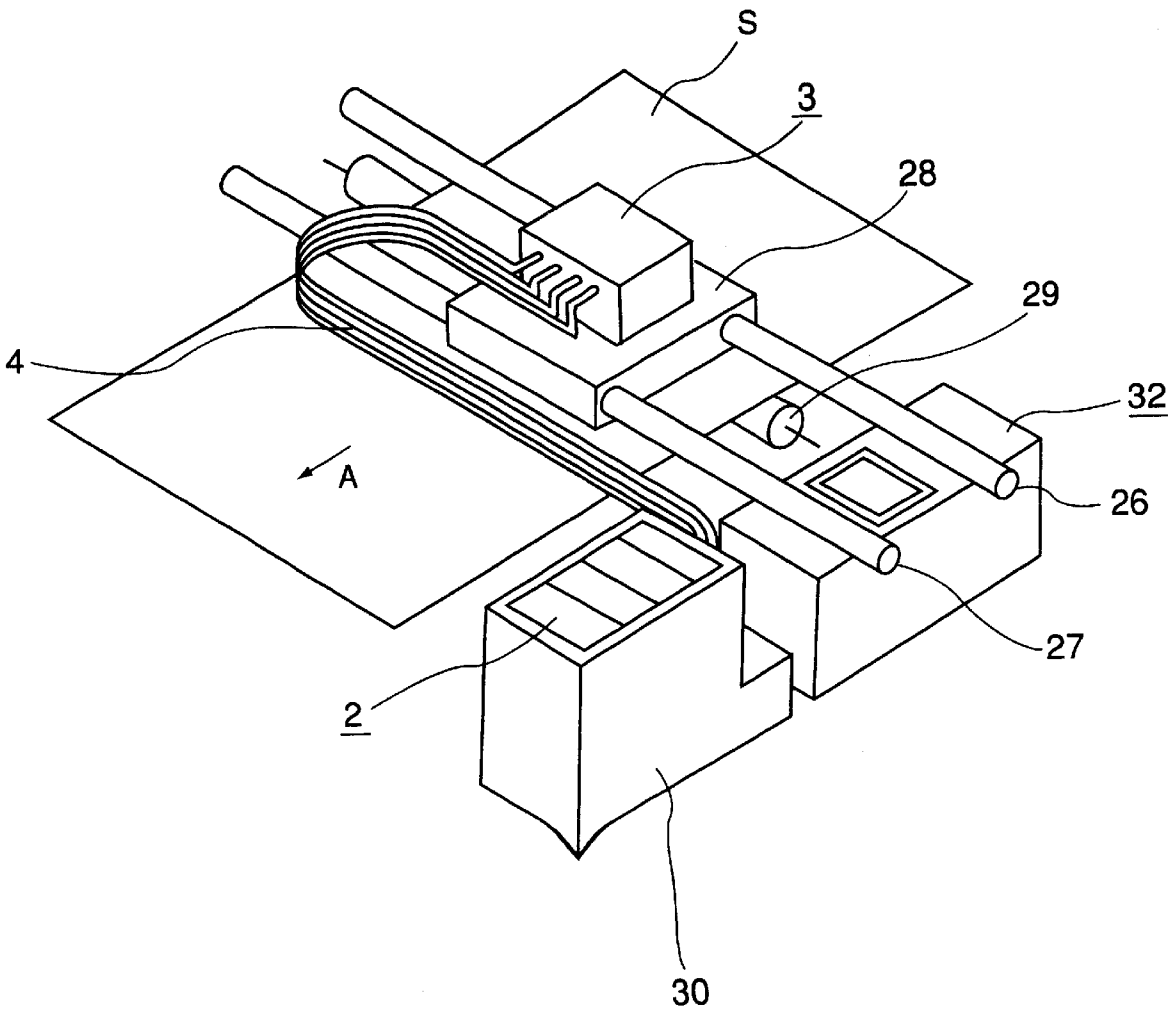
FIG. 43 is a schematic perspective view of an ink jet recording apparatus as an example of a recording apparatus compatible with a liquid container in accordance with the present invention.
Figure 44:
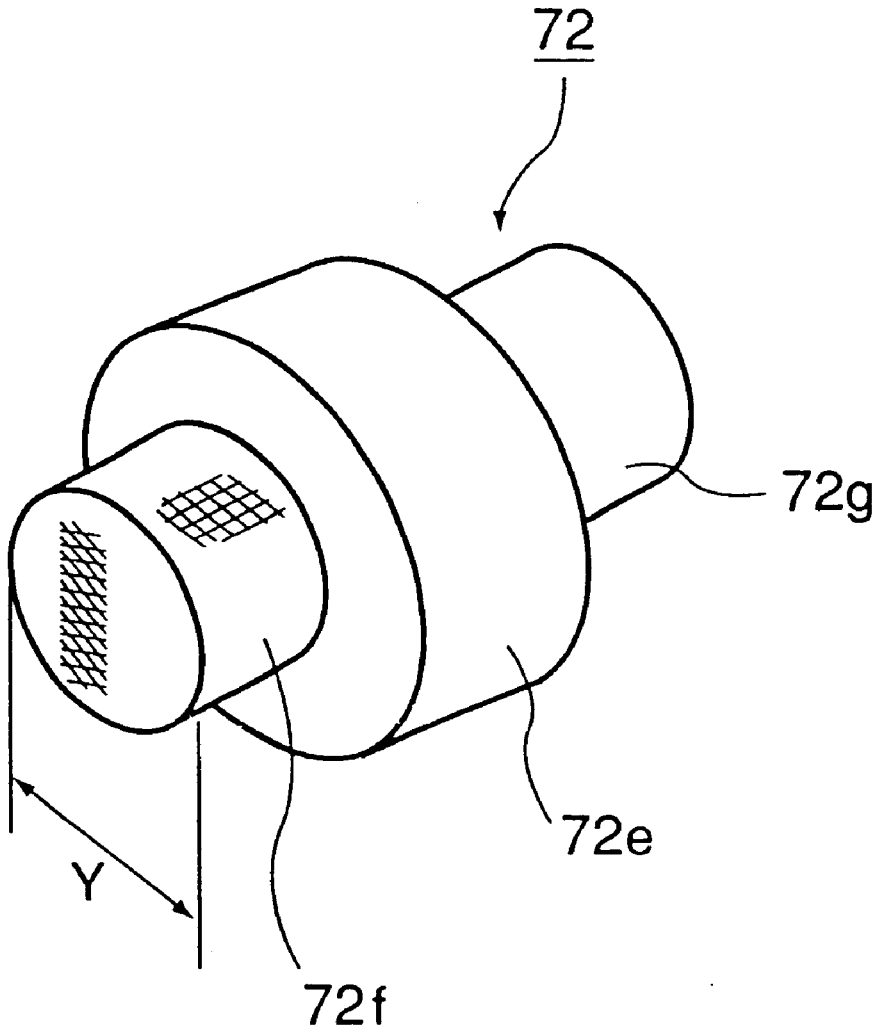
FIG. 44 PRIOR ART
FIG. 44 is a perspective view of the ink drawing member for the replaceable liquid container in accordance with the prior arts, disclosed in Japanese Laid-open patent Application 5-162333.
Figure 45:
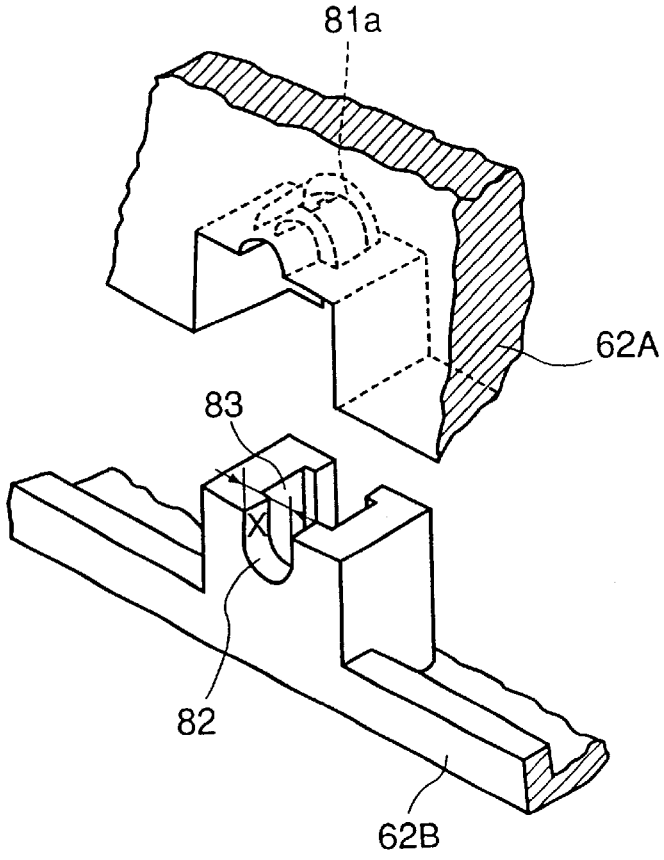
FIG. 45 PRIOR ART
FIG. 45 is a drawing for showing the location of the ink container in accordance with the prior arts, in which the ink drawing member shown in FIG. 44 is placed.
Figure 46:
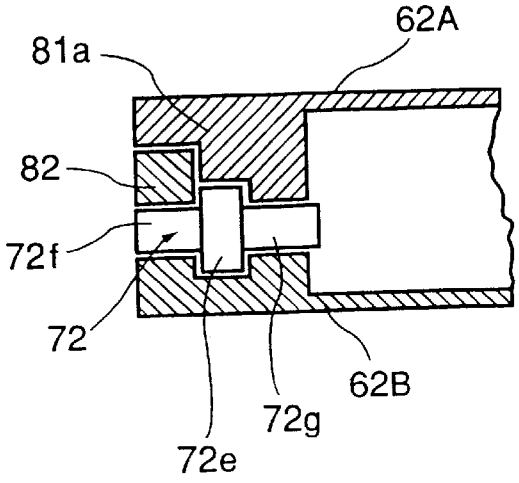
FIG. 46 PRIOR ART
FIG. 46 is a sectional view of the essential portion of the liquid container, inclusive of the portion in which the ink drawing member shown in FIG. 44 is placed.

Next, a recording apparatus equipped with a liquid supplying system (FIG. 1) compatible with a liquid container structured as described above will be described. FIG. 43 shows an ink jet recording apparatus as an example of an apparatus compatible with a liquid container in accordance with the present invention.

The ink jet recording apparatus shown in FIG. 43 is a serial type recording apparatus. In the apparatus, the reciprocal movement (primary scanning) of the ink jet head 3, and the conveyance, at a predetermined pitch, of a recording sheet S, such as a sheet of ordinary paper, special purpose paper, OHP film, or the like (secondary scanning), are alternately repeated. In synchronism with these movements, ink is selectively ejected from the ink jet head 3 to adhere the ink to the recording sheet S so that characters, signs, pictorial images, and/or the like are formed on the recording sheet S.

Referring to FIG. 43, the ink jet head 3 is removably mounted on the carriage 28, which is supported by a pair of guide rails 26 and 27, being enabled to slide on the guide rails 26 and 27, and which is reciprocally moved on the guide rails 26 and 27 by an unshown driving means such as a motor. The recording sheet S is conveyed by the conveying roller 29 in the direction intersectant with the moving direction of the carriage 2 (for example, the direction indicated by an arrow mark A, which is perpendicular to the moving direction of the carriage 2), facing the ink ejection surface of the ink jet head 3 while being kept a predetermined distance away from the ink ejection surface of the ink jet head 3.

In order to eject plural inks different in color, the ink jet head 3 has plural columns of nozzles different in ink color. For each ink ejected from the ink jet head 3, one ink container 2, which is one of the main containers, is removably mounted in the ink supplying unit 30.

The ink supplying unit 30 and ink jet head 3 are connected with plural liquid supply tubes 4, the number of which equals to the number of the inks different in color. As each liquid container 2 is mounted in the ink supplying unit 30, it becomes possible for the ink therein to be supplied to the ink nozzle column of the same color, independently from the other ink containers and inks therein.

The recording apparatus is provided with a recovery unit 32, which is disposed within the reciprocating range of the ink jet head 3, but outside the path of the recording sheet S, that is, out side the recording range of the ink jet head 3, being enabled to face the ink ejection surface of the ink jet head 3. The recovery unit 32 has: a cap for covering the ink ejection surface of the ink jet head 3; a suctioning mechanism for forcefully suctioning ink out of the ink jet head 3, with the ink ejection surface of the ink jet head 3 covered with the cap; a cleaning blade for wiping away the contaminant on the ink ejection surface; and the like.

In the above, the embodiments of the present invention were described with reference to a serial type ink jet recording apparatus. However, the present invention is also applicable to an ink jet recording apparatus having a line type ink jet head in which a single or plural rows of nozzles extend from one end to the other of the recording range of the ink jet head 3 in terms of the widthwise direction of a recording medium.

As described above, according to the first embodiment of the present invention, a liquid container for an ink jet recording apparatus comprises a connective hole for connecting the inside and outside of the container, and an elastic member placed at the opening of the connective hole. The inside and outside of the liquid container are connected as a cylindrical needle is put through the elastic member. The elastic member has first and second portions. In terms of the direction in which the cylindrical needle is inserted, the first and second portions are on the trailing and leading sides, respectively. The first portion remains compressed even before the insertion of the cylindrical needle, whereas before the insertion of the cylindrical needle, the second portion is not in the compressed state, in practical terms.

However, after the insertion of the cylindrical needle, both the first and second portions remains compressed. With the provision of this structural arrangement, the amount of the deterioration of the elasticity of the second portion resulting from the elapse of time is smaller than that of the first portion. In other words, the amount of the creep (phenomenon that if an elastic member is left alone, under a given pressure, for a long period of time, the elastic member does not revert to its original shape; it becomes permanently deformed) which occurs to the second portion is far smaller than the amount of the creep which occurs to the first portion. Therefore, even when the cylindrical needle is extracted after being left in the elastic member for a long period time, the second portion of the elastic member, to which virtually no creep, or permanent deformation, occurs, keeps the connective hole satisfactorily sealed. Further, the provision of the second portion increases the size of the contact surface between the elastic member and cylindrical needle, improving the ability of the elastic member to keep the connective hole sealed against the changes in the internal and/or ambient pressure of the liquid container.

According to another aspect of the present invention, an elastic member is monolithic, and also has first and second portions. The first portion remains compressed even before the insertion of the cylindrical needle, whereas before the insertion of the cylindrical needle, the Second portion is not in the compressed state, in practical terms. However, after the insertion of the cylindrical needle, both the first and second portions remains compressed. In terms of the cylindrical needle insertion direction, the first and second portions are on the trailing and leading sides, respectively. Also in terms of the direction in which the cylindrical needle is inserted, the first portion bulges in the direction from which the cylindrical needle is inserted, and concaves on the side opposite to the bulging side. It is uniform in thickness in terms of the cylindrical needle insertion direction. The second portion is cylindrical before the insertion of the cylindrical needle. It projects from the concaved side of the first portion.

With the provision of this structural arrangement, it is easy to compress, and keep compressed, the elastic member toward its axial line. Further, with the cylindrical portion of the elastic member protruding in the cylindrical needle insertion direction, it is not likely that when the leading end portion of the cylindrical needle comes out of the other side of the elastic member, the internal portion of the elastic member, which has come into contact with the advancing cylindrical needle, is partially dragged out of the elastic member, and conically peels away from the cylindrical needle in a manner to create a conical recess around the cylindrical needle; in other words, it is possible to prevent the elastic member from being conically caved around the cylindrical needle by the insertion of the cylindrical needle. Therefore, the elastic member in accordance with this aspect of the present invention is greater in the contact surface between the cylindrical needle and elastic member than an elastic member in accordance with the prior arts. The elastic member in accordance with this aspect of the present invention may be provided with a slit, which is cut in the direction parallel to the direction in which the cylindrical needle is advanced through the elastic member. With the provision of this structural arrangement, the cylindrical needle is guided by the slit, being enabled to properly penetrate the elastic member. Therefore, the elastic member is less likely to be damaged by the insertion of the cylindrical needle, assuring that the connective hole remains satisfactorily sealed.

Further, the external diameter of the cylindrical portion of the elastic member is made smaller than the internal diameter of the connective hole. With the provision of this structural arrangement, compression force is generated only as the cylindrical needle is inserted into the cylindrical portion of the elastic member. Therefore, the cylindrical portion of the elastic member is less likely to permanently deform with the elapse of time. Even when the cylindrical needle is extracted from the elastic member after it has been left alone in the elastic member for a long period of time, liquid is not likely to drip from the connective hole.

Further, the top portion of the bulging portion of the elastic member may be provided with a conical recess, a simple flat surface perpendicular to the cylindrical needle insertion direction, or a shallow recess with a flat bottom surface perpendicular to the cylindrical needle insertion direction. With the provision of this structural arrangement, it is possible to limit to the radius direction of the elastic member, the direction in which the internal portion of the elastic member is pushed out as the cylindrical needle is inserted through the elastic member.

Therefore, the caving of the elastic member which is caused by the insertion of the cylindrical needle is more effectively prevented.

Further, the recess in which the elastic member is retained by the retaining member for retaining the elastic member in the compressed state is made virtually cylindrical.

Therefore, as the elastic member is pressed down in the retaining member, the contact surface between the elastic member and the recess wall becomes cylindrical, causing the compression pressure generated in the elastic member by the pressure from the retaining member, to concentrate toward the axial line of the elastic member, which is desirable from the standpoint of the sealing performance of the elastic member.

According to the second embodiment of the present invention, a liquid container for an ink jet recording apparatus has a connective hole for connecting the inside and outside of the container, an elastic member for keeping the connective hole sealed, and a recess in which the elastic member is retained. The elastic member is provided with a slit, which extends inward of the elastic member, from the surface of the elastic member, on the side from which the cylindrical needle is inserted into the container, in the direction in which the cylindrical needle is inserted. The elastic member in the recess, which has been compressed toward the center of the recess, is in the compressed state. Thus, when a cylindrical needle is inserted into the elastic member, it advances in the elastic member, following the slit. Consequently, the cylindrical needles goes through virtually the same path as the path made when the cylindrical needle was previously put though the elastic member, minimizing the damage which occurs to the elastic member as the cylindrical needle is put through the elastic member. This assures that the elastic member keeps the connective hole satisfactorily sealed.

In the case of the above structural arrangement, the elastic member is made up of a dome-shaped portion and a cylindrical portion. In terms of the direction in which the cylindrical needle is inserted, one side of the dome-shaped portion is bulged, and the other side of the dome-shaped portion is concaved. The dome-shaped portion is uniform in the thickness in terms of the cylindrical needle insertion direction. The cylindrical portion projects from the concaved side of the dome-shaped portion. The aforementioned slit is formed so that it is positioned in the center of the elastic member, and that its dimension in terms of the radius direction of the elastic member does not exceed the diameter of the cylindrical portion. As the elastic member placed in the aforementioned recess is pressed down by the retaining member, compression pressure is easily generated in the dome-shaped portion and is directed toward the axial line of the elastic member, increasing the amount by which contact pressure is generated between the cylindrical needle and the internal portion of the elastic member as the cylindrical needle is inserted. This improves the reliability of the elastic member in its ability to keep the connective hole sealed. Next, the cylindrical needle on the concaved side of the elastic member projects in the cylindrical needle insertion direction, making it difficult for the phenomenon that when the leading end portion of the cylindrical needle is pushed past the bottom surface of the elastic member, the internal portion of the elastic member around the needle path in the elastic member made by the advancement of the elastic member through the elastic member is partially dragged out of the elastic member from the bottom surface of the elastic member, by the cylindrical needle, and conically peels away from the cylindrical needle in a manner to create a conical recess around the cylindrical needle, to occur. In other words, this structural arrangement prevents the elastic member from becoming conically caved due to the insertion of the cylindrical needle. Therefore, the contact area between the cylindrical needle and the elastic member in this embodiment is greater than that between the cylindrical needle and an elastic member in accordance with the prior arts. Next, the elastic member is provided with a slit, which is cut in the direction in which the cylindrical needle inserted. Therefore, the cylindrical needle is guided through the elastic member by the slit, being prevented from damaging the elastic member. In other words, the elastic member in accordance with this embodiment assures that the connective hole is kept satisfactorily sealed.

Providing the elastic member with only a single slit assures that each time the cylindrical needle is inserted in the elastic member, the cylindrical needle follows virtually the same path as that which the cylindrical needle followed when it was previously inserted. The slit may be cut in such a manner that it falls slightly short of reaching the bottom surface of the elastic member. With this arrangement, the connective hole is kept perfectly sealed even when a liquid container is placed in the adverse environment in terms of the leakage during the period from the liquid container manufacture to the beginning of its usage; in other words, this arrangement makes a liquid container more tolerant to environmental changes. Next, the relationship between the length L of the slit in terms of the direction perpendicular to the direction in which the cylindrical needle is inserted, and the diameter D of the cylindrical needle, is made to satisfy the following inequity: $2L>\pi D$. With this arrangement, the slit does not tear (it does not widen) when the cylindrical needle is put all the way through the elastic member, following the slit.

Further, an absorbent member is attached to the retaining member to absorb liquid droplets. Also, the wall of the connective hole of the retaining member is provided with plural grooves, the depth direction of which coincides with the radius direction of the connective hole. With this arrangement, a small amount of liquid droplets (ink droplets if the liquid within the liquid container is ink) which are formed when a liquid container is moved away from the cylindrical needle, are efficiently guided to the absorbent member by capillary force. Therefore, a user of an ink jet recording apparatus, the recording apparatus itself, and the things around the recording apparatus, can be prevented from being contaminated by ink.

Further, the elastic member may be provided with a compound slit made up of a pair of sub-slits, which intersect each other, and the intersection of which virtually coincides with the axial line of the elastic member. With this arrangement, the cylindrical needle is inserted into the elastic member in a satisfactory manner even when the cylindrical needle is not strictly regulated in terms of the direction in which it is inserted.

Regarding the elastic member with a compound slit, if the shorter sub-slit is excessively long in terms of the direction perpendicular to the cylindrical needle insertion direction, the portion of the elastic member immediately next to the intersection of the sub-slits is isolated from the surrounding portion of the elastic member, adversely affecting the ability of the elastic member to resist caving. Therefore, the relationship between the length L of the sub-slit in terms of the direction perpendicular to the cylindrical needle insertion direction, and the diameter D of the cylindrical needle, is desired to satisfy the following inequity:

$$1.5\ \pi D>L.$$

According to the third and fourth embodiments of the present invention, a liquid container for an ink jet recording apparatus comprises a connective hole for connecting the inside and outside of the container, and an elastic member placed at the opening of the connective hole. The inside and outside of the liquid container are connected as a cylindrical needle is put through the elastic member. The elastic member has first and second portions. In terms of the direction in which the cylindrical needle is inserted, the first and Second portions are on the trailing and leading sides, respectively. The first portion remains compressed even before the insertion of the cylindrical needle, whereas before the insertion of the cylindrical needle, the second portion is not in the compressed state, in practical terms. However, after the insertion of the cylindrical needle, both the first and second portions remains compressed. In terms of the cylindrical needle insertion direction, the first portion is dome-shaped, being bulged on the side from which the cylindrical needle is inserted, and concaved on the opposite side. The top portion of the dome-shaped first portion is provided with a simple flat surface, which is virtually perpendicular to the cylindrical needle insertion direction, or is provided with a shallow recess with a flat bottom surface, which is virtually perpendicular to the cylindrical needle insertion direction. The second portion is a cylindrical, protruding from the concaved side of the dome-shaped portion. Further, the elastic member is provided with a slit, which extends in the direction parallel to the cylindrical needle insertion direction from the surface from which the cylindrical needle is inserted. The slit is cut so that it is positioned in the approximate center of the elastic member, and its dimension in terms of the radius direction of the elastic member does not exceed the diameter of the cylindrical portion. Thus, when the elastic member is in the recess, compression pressure is present in the dome-shaped portion, and acts toward the axial line of the elastic member.

Also with this structural arrangement, in which the elastic member is provided with the dome-shaped portion, such compression pressure that acts toward the axial line of the elastic member is easily generated in the elastic member, increasing the amount by which contact pressure is generated between the cylindrical needle and the internal portion of the elastic member as the cylindrical needle is inserted. This improves the reliability of the elastic member in its ability to keep the connective hole sealed. Further, the provision of the cylindrical portion prevents the elastic member from conically caving. Therefore, the contact area between the cylindrical needle and the elastic member in this embodiment is greater than that between the cylindrical needle and an elastic member in accordance with the prior arts. Further, with the provision of the slit, which is cut in the direction in which the cylindrical needle inserted, the cylindrical needle is guided by the slit through the elastic member.

In the third embodiment of the present invention, the slit was virtually straight, or arcuate. When the requirement regarding the product design makes it necessary for the cylindrical portion of the elastic member to be small in diameter, an arcuate slit is advantageous. Further, according to the second and third embodiments of the present invention, a liquid container is provided with an elastic member retaining member, and the leading end, in terms of the insertion direction, of a cylindrical needle which is inserted into the elastic member is tapered. The retaining member is provided with a hole for guiding the entry of the cylindrical needle into the elastic member. The lip of one end of this hole is in contact with the elastic member, and has a predetermined diameter. In terms of the cylindrical needle insertion direction, the depth of this hole is made greater than the length of the tapered portion of the cylindrical needle. With this arrangement, it is prevented that the tip of the cylindrical needle reaches the top surface of the elastic member while the tapered portion of the cylindrical needle is still in contact with the wall of the above described guiding hole. Therefore, the connective needle is guided to the center of the elastic member.

In this case, it is desired that the aforementioned flat surface perpendicular to the direction in which the cylindrical needle enters the elastic member is a circular surface with a diameter greater than that of the guiding hole of the elastic member retaining member. With this arrangement, the compression stress, which is generated toward the axial line of the elastic member as the elastic member is placed in the recess, can be regulated by the flat bottom surface of the retaining member and the flat top surface of the elastic member. In other words, the compression stress is evenly distributed in the elastic member.

According to the first to third embodiments of the present invention, the top surface of the elastic member is coated with lubricant. With this arrangement, the friction which occurs between the top surface of the elastic member and the tip of the cylindrical needle to be inserted into the elastic member is smaller, assuring that the cylindrical needle is guided to the slit, and also making it easier for an incompetent use to insert the cylindrical needle into the elastic member. Lubricant may be placed in the slit itself cut in the elastic member in the direction parallel to the cylindrical needle insertion direction. This will enhance the above described benefits of the coating of the top surface of the elastic member with lubricant.

Further, lubricant may be coated on the surface of the retaining member, or may be placed in the interface between the retaining member and elastic member. With this arrangement, it is possible to reduce the possibility that the elastic member is shifted by the friction which occurs between the retaining member and the elastic member, when the elastic member is placed in the recess, when the cylindrical needle is inserted into the elastic member, or when the cylindrical needle is extracted from the elastic member.

Further, lubricant may be placed in the interface between the wall of the recess and the elastic member. This arrangement makes it easier to place the elastic member in the recess.

Further, an absorbent member for absorbing liquid droplets is attached to the retaining member which presses down and holds the elastic member. Also the wall of the guiding (connective) hole of the retaining member is provided with plural grooves, the depth direction of which coincides with the radius direction of the guiding hole, and at least one of the grooves is aligned with the slit. With this arrangement, the microscopic groove created at the surface of the elastic member by the formation of the slit becomes connected with the groove of the retaining member. Therefore, the liquid droplets (ink droplets if the liquid in the liquid container is ink) is more efficiently guided to the absorbent member.

Further, according to the present invention, a liquid container is provided with a connective hole for connecting the insert and outside of the container, the inside and outside of the liquid container becomes connected as the cylindrical needle is put through the connective hole. This liquid container is also provided with an elastic member for plugging the connective hole, and a guide for guiding the cylindrical needle with a diameter of D, in such a manner that the axial line of the cylindrical needle is positioned no more than 0.5 D away from the axial line of the elastic member, reducing further the possibility that the elastic member will be damaged.

While the invention has been described with reference to the structures disclosed herein, it is not confined to the details set forth, and this application is intended to cover such modifications or changes as may come within the purposes of the improvements or the scope of the following claims.

While the invention has been described with reference to the structures disclosed herein, it is not confined to the details set forth and this application is intended to cover such modifications or changes as may come within the purpose of the improvements or the scope of the following claims.

What is claimed is:

1. A liquid container for an ink jet recording apparatus, comprising:

a connection opening connectable with an outside;

an elastic member provided in said connection opening, said elastic member being adapted to be penetrated by a cylindrical member for fluid communication with the outside;

said elastic member including a compressed region and a substantially non-compressed region in a state without said cylindrical member penetrated, disposed in this order in a direction of insertion of said cylindrical member, wherein said compressed region and said non-compressed region are capable of being compressed when they are penetrated by said cylindrical member, wherein a length, measured in the direction of insertion of the cylindrical member, of said compressed region of said elastic member, is longer than a length, measured in the direction, of said non-compressed region of said elastic member in the state without said cylindrical member penetrated.

2. A liquid container for an ink jet recording apparatus, comprising:

a connection opening connectable with an outside;

an elastic member provided in said connection opening, said elastic member being adapted to be penetrated by a cylindrical member for fluid communication with the outside;

said elastic member including a compressed region and a substantially non-compressed region in a state without said cylindrical member penetrated, disposed in this order in a direction of insertion of said cylindrical member, wherein said compressed region and said non-compressed region are capable of being compressed when they are penetrated by said cylindrical member, wherein said compressed region and said non-compressed region of said elastic member are portions of a single member, in the state without the cylindrical member penetrated.

3. A container according to claim 2, wherein one of opposite end surfaces of said elastic member with respect to the direction of the insertion of said cylindrical member has a protruded form, and the other has a recessed form to provide a substantially uniform thickness, and wherein said non-compressed region has a configuration protruded toward said recessed form in the state without the cylindrical member penetrated.

4. A container according to claim 3, wherein the cylindrical member is inserted at the end having the protruded form.

5. A container according to claim 3, further comprising a housing, provided in said connection opening, for housing said elastic member, said housing having an inner diameter which is substantially equal to an outer diameter of said elastic member, wherein said elastic member is compressed toward a center of said elastic member by a fixing member compressing the end of the elastic member having the protruded form.

6. A container according to claim 5, wherein said fixing member is provided with an absorbing material for absorbing a droplet.

7. A container according to claim 6, wherein said fixing member is provided with grooves extending radially from said connection opening.

8. A container according to claim 3, wherein when the end of said elastic member having the protruded form is compressed to the fixing member having an opening through which the cylindrical member is penetrated, the elastic member is not pressed into the opening of said fixing member.

9. A container according to claim 8, wherein the end having the protruded form has a conical portion at a top of the protruded form.

10. A container according to claim 8, wherein the end having the protruded form has a flat surface substantially perpendicular to the direction of insertion of the cylindrical member or a stepped-down surface.

11. A liquid container for an ink jet recording apparatus, comprising:

a connection opening connectable with an outside;

an elastic member plugged in said connection opening;

a housing for housing said elastic member, said elastic member being adapted to be penetrated by a cylindrical member for fluid communication with the outside;

a slit provided in said elastic member and extended from an end at which said cylindrical member is insertable in a direction of insertion of said cylindrical member, wherein said elastic member is compressed inwardly in said housing, wherein said elastic member is in the form of a dome having a protruded form on one side and a recessed form on the other side in the direction of insertion of the cylindrical member, the dome having a substantially uniform thickness, and said elastic member is provided with a column configuration portion of the recessed form side, wherein the slit is within the column configuration portion.

12. A liquid container for an ink jet recording apparatus, comprising a connection opening connectable with an outside;

an elastic member provided in said connection opening, said elastic member being adapted to be penetrated by a cylindrical member for fluid communication with the outside; said elastic member including a compressed region and a substantially non-compressed region in a state without said cylindrical member penetrated, disposed in this order in a direction of insertion of said cylindrical member, wherein said compressed region is in the form of a dome having a protruded form on one side and a recessed form on the other side in the direction of insertion of the cylindrical member, wherein a top portion of said protruded form has a flat surface substantially perpendicular to the direction of insertion of the cylindrical member or a stepped-down surface, wherein said non-compressed region is provided with a column configuration portion of the recessed form side, wherein the slit is within the column configuration portion, wherein said compressed region and said non-compressed region are capable of being compressed when they are penetrated by said cylindrical member, wherein said elastic member has a slit provided in said elastic member and extended from an end at which said cylindrical member is insertable in a direction of insertion of said cylindrical member, and the slit is within the column configuration portion, wherein said elastic member is compressed inwardly in said housing.

13. A liquid container for an ink jet recording apparatus, comprising:

a connection opening connectable with an outside;

an elastic member provided in said connection opening, said elastic member being adapted to be penetrated by a cylindrical member for fluid communication with the outside, said elastic member including a compressed region and a substantially non-compressed region in a state without said cylindrical member penetrated, disposed in this order in a direction of insertion of said cylindrical member, wherein said compressed region is in the form of a dome having a protruded form on one side and a recessed form on the other side in the direction of insertion of the cylindrical member, wherein a top portion of said protruded form has a flat surface substantially perpendicular to the direction of insertion of the cylindrical member or a stepped-down surface, wherein said non-compressed region is provided with a column configuration portion of the recessed form side, wherein said compressed region and said non-compressed region are capable of being compressed when they are penetrated by said cylindrical member, wherein said elastic member has a slit provided in said elastic member and extended from an end at which said cylindrical member is insertable in a direction of insertion of said cylindrical member, and the slit is within the column configuration portion, wherein said elastic member is compressed inwardly in said housing.

14. A liquid container for an ink jet recording apparatus, comprising:

a connection opening connectable with an outside;

an elastic member plugged in said connection opening;

a housing for housing said elastic member, said elastic member being adapted to be penetrated by a cylindrical member for fluid communication with the outside;

a slit provided in said elastic member and extended from an end at which said cylindrical member is insertable in a direction of insertion of said cylindrical member, and a fixing member for pressing and fixing said elastic member, said fixing member being provided with an absorbing material for absorbing a droplet and being provided with grooves extending radially from said connection opening, wherein at least one of said grooves extends along said slit wherein said elastic member is compressed inwardly in said housing.

15. A liquid container for an ink jet recording apparatus, comprising:

a connection opening connectable with an outside;

an elastic member provided in said connection opening, said elastic member being adapted to be penetrated by a cylindrical member for fluid communication with the outside; and a fixing member for pressing and fixing said elastic member, wherein a free end of the cylindrical member to be inserted into seven elastic member is tapered, and said affixing member has an opening contacted to the elastic member to guide insertion of the cylindrical member into said elastic member, wherein the opening has a length, measured in the direction of insertion of the cylindrical member, is larger than a length of the tapered portion of the cylindrical member, wherein said elastic member including a compressed region and a substantially non-compressed region in a state without said cylindrical member penetrated, disposed in this order in a direction of insertion of said cylindrical member, wherein said compressed region and said non-compressed region are capable of being compressed when they are penetrated by said cylindrical member.

16. A container according to claim 15, wherein the plane perpendicular to the direction of insertion of the cylindrical member has a circular flat plane having a diameter larger than the diameter of the opening provided in the fixing member.

* * * * *

UNITED STATES PATENT AND TRADEMARK OFFICE

CERTIFICATE OF CORRECTION

PATENT NO. : 6,712,458 B2
DATED : March 30, 2004
INVENTOR(S) : N. Hatasa et al.

It is certified that error appears in the above-identified patent and that said Letters Patent is hereby corrected as shown below:

Column 3,
Line 25, “length” should read -- length of --.

Column 5,
Line 58, “pen-” should read -- being pen- --.
Line 65, “penetrated.” should read -- being penetrated. --.

Column 6,
Lines 2 and 8, “penetrated.” should read -- being penetrated. --.

Column 7,
Line 31, “penetrates” should read -- penetrate --.

Column 9,
Line 10, “seven” should read -- said --.

Column 12,
Line 55, “View as Seen” should read -- view as seen --.

Column 15,
Line 43, “I” should read -- 1 --.

Column 16,
Line 15, “shield” should read -- shielded --.
Line 44, “1k” should be deleted.
Line 45, “t” should be deleted.

Column 23,
Line 36, “2” should be deleted.
Line 39, “Seen” should read -- seen --.

Column 26,
Line 18, “be conically peels” should read -- to be conically peeled --.

Column 28,
Line 5, “Seen” should read -- seen --.

Column 31,
Line 1, “reducing” should read -- reduces --.

UNITED STATES PATENT AND TRADEMARK OFFICE

CERTIFICATE OF CORRECTION

PATENT NO. : 6,712,458 B2
DATED : March 30, 2004
INVENTOR(S) : N. Hatasa et al.

It is certified that error appears in the above-identified patent and that said Letters Patent is hereby corrected as shown below:

Column 32,
Line 34, “1k” should be deleted.
Line 53, “budging” should read -- bulging --.

Column 35,
Line 17, “result” should read -- results --.

Column 37,
Line 66, “Second” should read -- second --.

Column 38,
Line 2, “remains” should read -- remain --.

Column 41,
Line 4, “Second” should read -- second --.
Line 11, “remains” should read -- remain --.
Line 61, “lip” should read -- tip --.

Column 44,
Line 45, “comprising” should read -- comprising: --.

Column 46,
Line 26, “seven” should read -- said --.

Signed and Sealed this

Fourteenth Day of December, 2004

JON W. DUDAS
*Director of the United States Patent and Trademark Office*